US009685112B2

(12) United States Patent
Omoto et al.

(10) Patent No.: US 9,685,112 B2
(45) Date of Patent: Jun. 20, 2017

(54) DISPLAY UNIT, DISPLAY PANEL, AND METHOD OF DRIVING THE SAME, AND ELECTRONIC APPARATUS

(71) Applicant: JOLED Inc., Tokyo (JP)

(72) Inventors: Keisuke Omoto, Kanagawa (JP); Junichi Yamashita, Tokyo (JP); Naobumi Toyomura, Kanagawa (JP)

(73) Assignee: JOLED Inc., Tokyo (JP)

( * ) Notice: Subject to any disclaimer, the term of this patent is extended or adjusted under 35 U.S.C. 154(b) by 154 days.

(21) Appl. No.: 14/354,748

(22) PCT Filed: Nov. 19, 2012

(86) PCT No.: PCT/JP2012/079927

§ 371 (c)(1),
(2) Date: Apr. 28, 2014

(87) PCT Pub. No.: WO2013/084702

PCT Pub. Date: Jun. 13, 2013

(65) Prior Publication Data

US 2014/0333604 A1 Nov. 13, 2014

(30) Foreign Application Priority Data

Dec. 9, 2011 (JP) ..... 2011-269988
Dec. 15, 2011 (JP) ..... 2011-274444
Mar. 16, 2012 (JP) ..... 2012-059695

(51) Int. Cl.
*G09G 3/32* (2016.01)
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0452* (2013.01);
(Continued)

(58) Field of Classification Search
CPC ..... G09G 3/3233; G09G 3/3258; G09G 2300/0866; G09G 2310/0251; G09G 2320/045; G09G 2330/0828
See application file for complete search history.

(56) References Cited

U.S. PATENT DOCUMENTS

2008/0246747 A1* 10/2008 Taneda ..... G09G 3/3233 345/204
2009/0244050 A1 10/2009 Yamamoto
(Continued)

FOREIGN PATENT DOCUMENTS

JP 08-248385 9/1996
JP 2008-083272 A 4/2008
(Continued)

OTHER PUBLICATIONS

Japanese Office Action issued Sep. 1, 2015 for corresponding Japanese Application No. 2012-059695.
(Continued)

*Primary Examiner* — Sahlu Okebato
(74) *Attorney, Agent, or Firm* — Michael Best & Friedrich LLP

(57) ABSTRACT

A display unit (1) includes a light-emitting device (13) and a pixel circuit (12) in each pixel (11), and a drive section (20) configured to drive the pixel circuit (12). The pixel circuit (12) includes a drive transistor (Tr1) configured to drive the light-emitting device (13), and a write transistor (Tr2) configured to control application of a signal voltage corresponding to an image signal to a gate of the drive transistor (Tr1). The drive section (20) performs Vth correction that allows a gate-source voltage of the drive transistor (Tr1) to be brought close to a threshold voltage of the drive transistor (Tr1) on all pixel rows, and then performs writing of the
(Continued)

signal voltage corresponding to the image signal to gates of the drive transistors (Tr1) in all pixel rows.

5 Claims, 41 Drawing Sheets

(52) U.S. Cl.
CPC ..... *G09G 2300/0819* (2013.01); *G09G 2300/0866* (2013.01); *G09G 2310/0251* (2013.01); *G09G 2310/06* (2013.01); *G09G 2320/045* (2013.01); *G09G 2330/028* (2013.01)

(56) References Cited

U.S. PATENT DOCUMENTS

2009/0273617 A1* 11/2009 Tanikame ..... G09G 3/3233 345/690
2009/0315812 A1 12/2009 Yamamoto et al.
2011/0096065 A1 4/2011 Handa et al.
2012/0113168 A1* 5/2012 Seo ..... G09G 3/003 345/691

FOREIGN PATENT DOCUMENTS

JP 2009-244666 A 10/2009
JP 2010-002498 A 1/2010
JP 2010-002796 A 1/2010
JP 2011-090241 A 5/2011
JP 2011-123184 A 6/2011
JP 2011-145396 A 7/2011

OTHER PUBLICATIONS

Japanese Office Action issued Jan. 19, 2016 for corresponding Japanese Application No. 2011-269988.

* cited by examiner

[ FIG. 1 ]
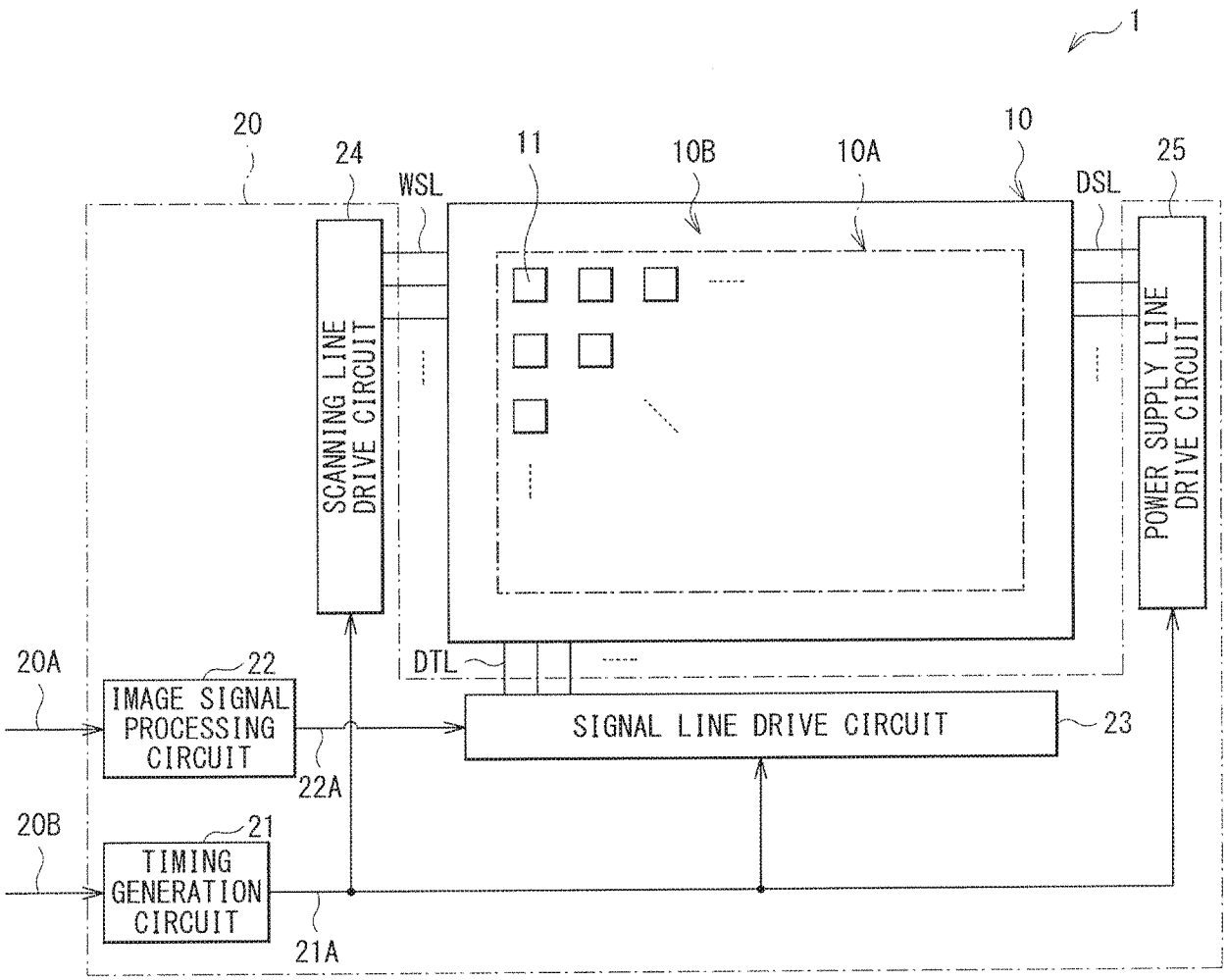

[ FIG. 2 ]
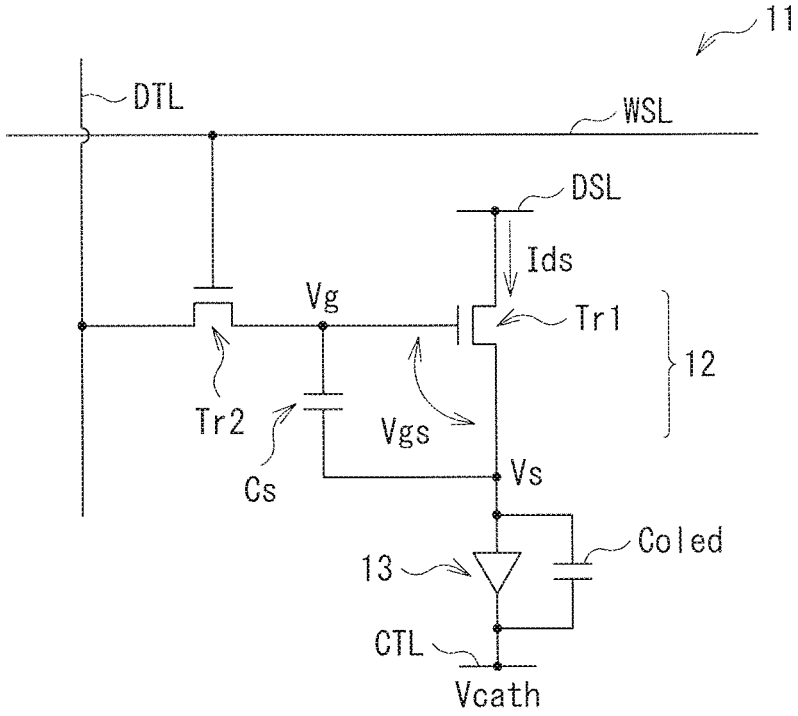

[ FIG. 3 ]
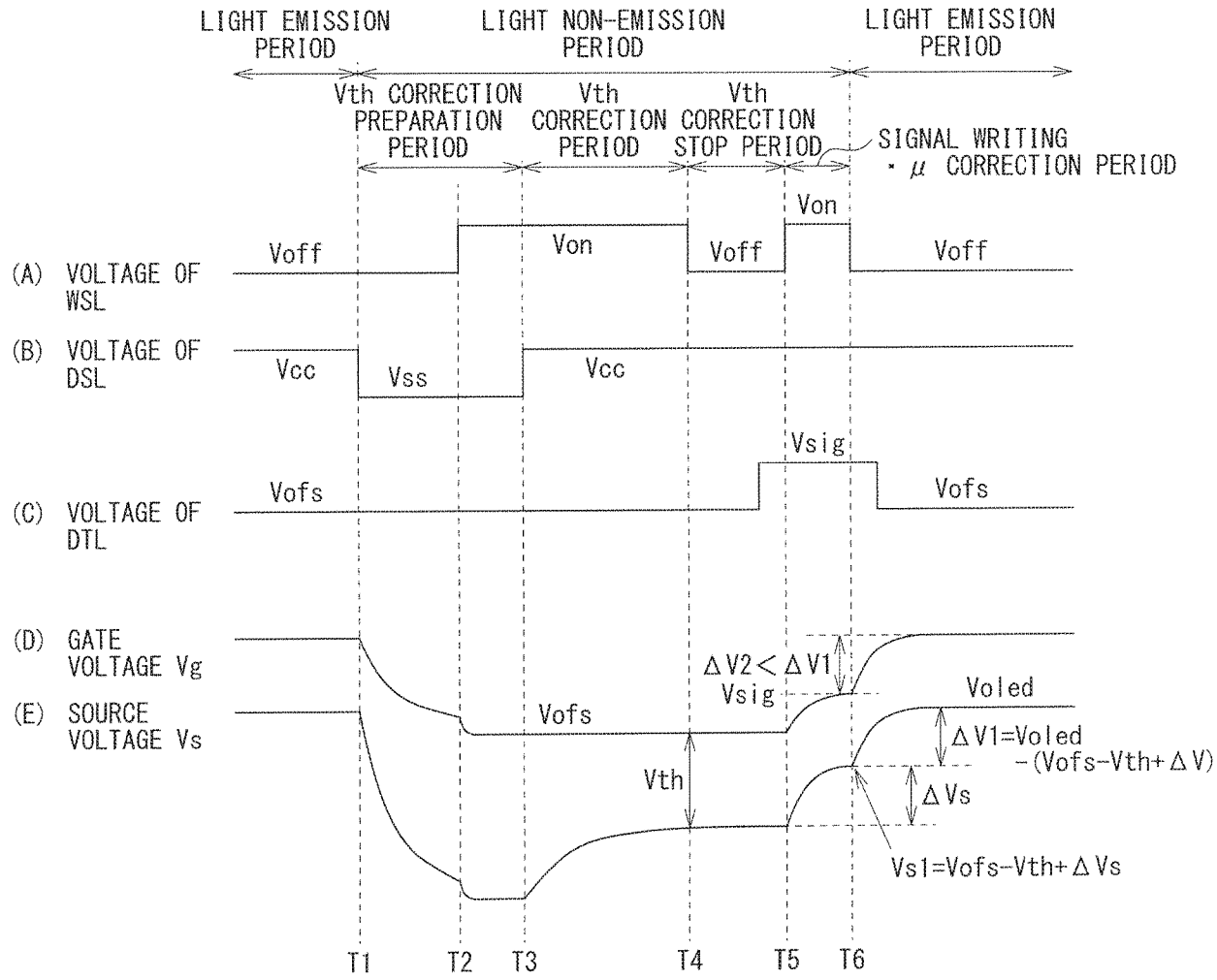

[ FIG. 4 ]
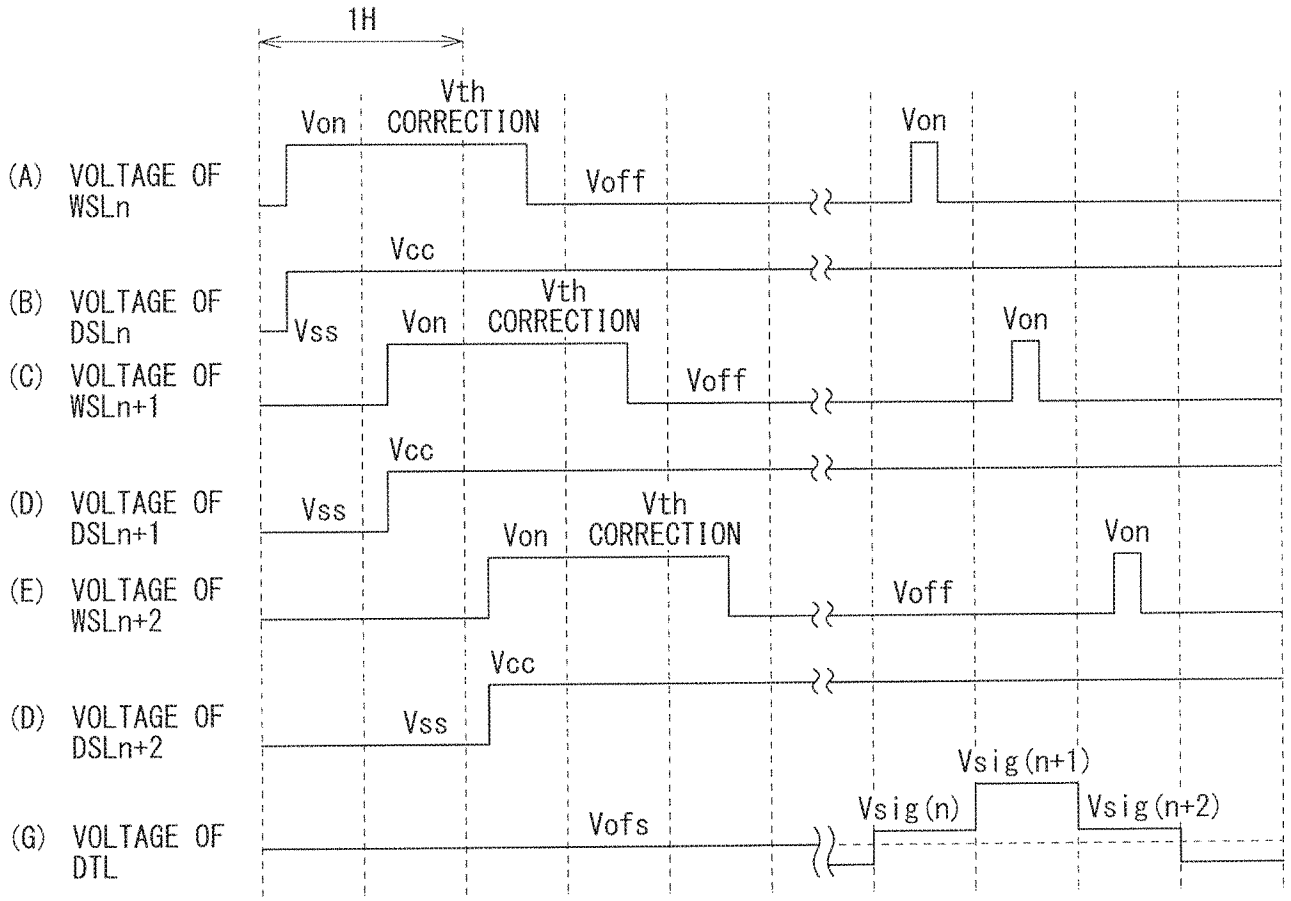

[ FIG. 5 ]
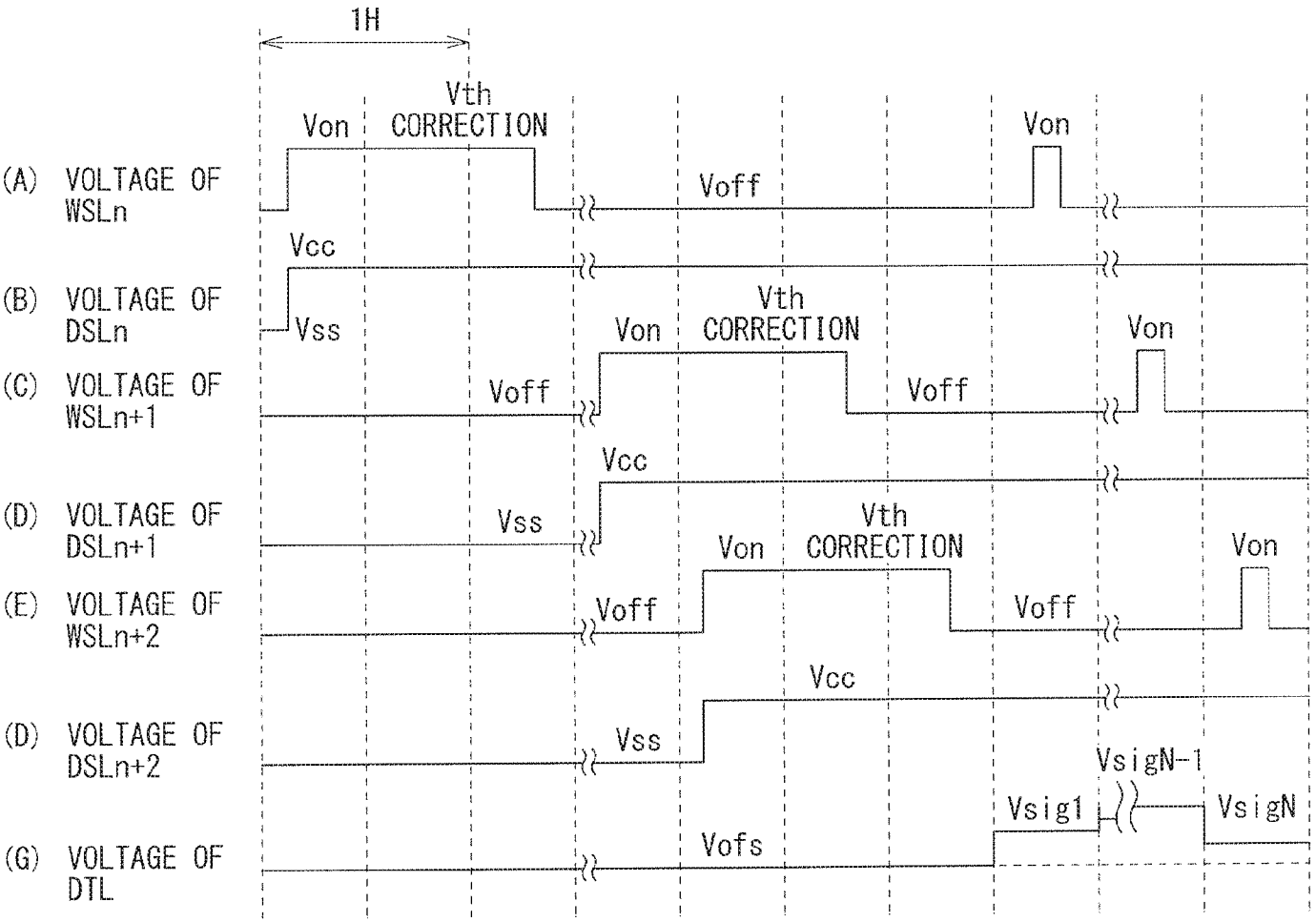

[ FIG. 6 ]
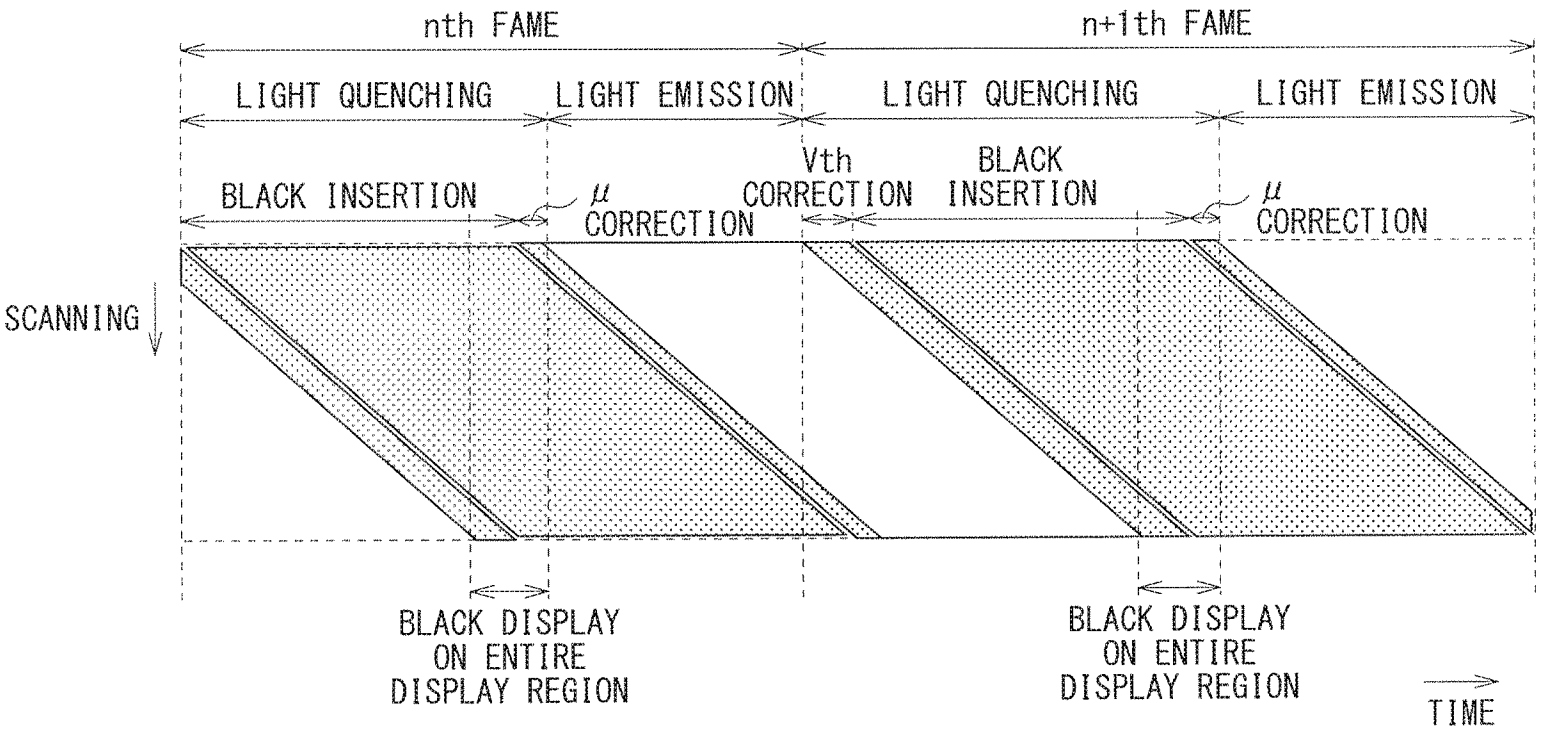

[ FIG. 7 ]
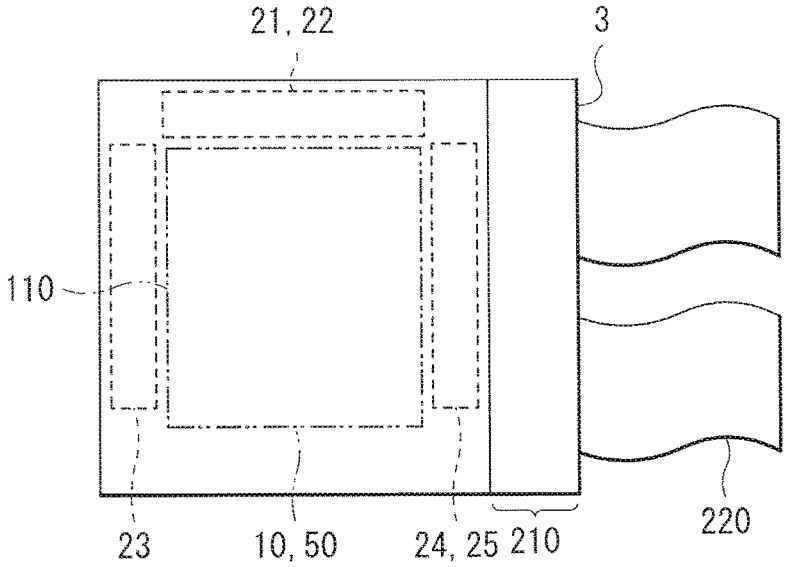

[ FIG. 8 ]
[ RELATED ART ]
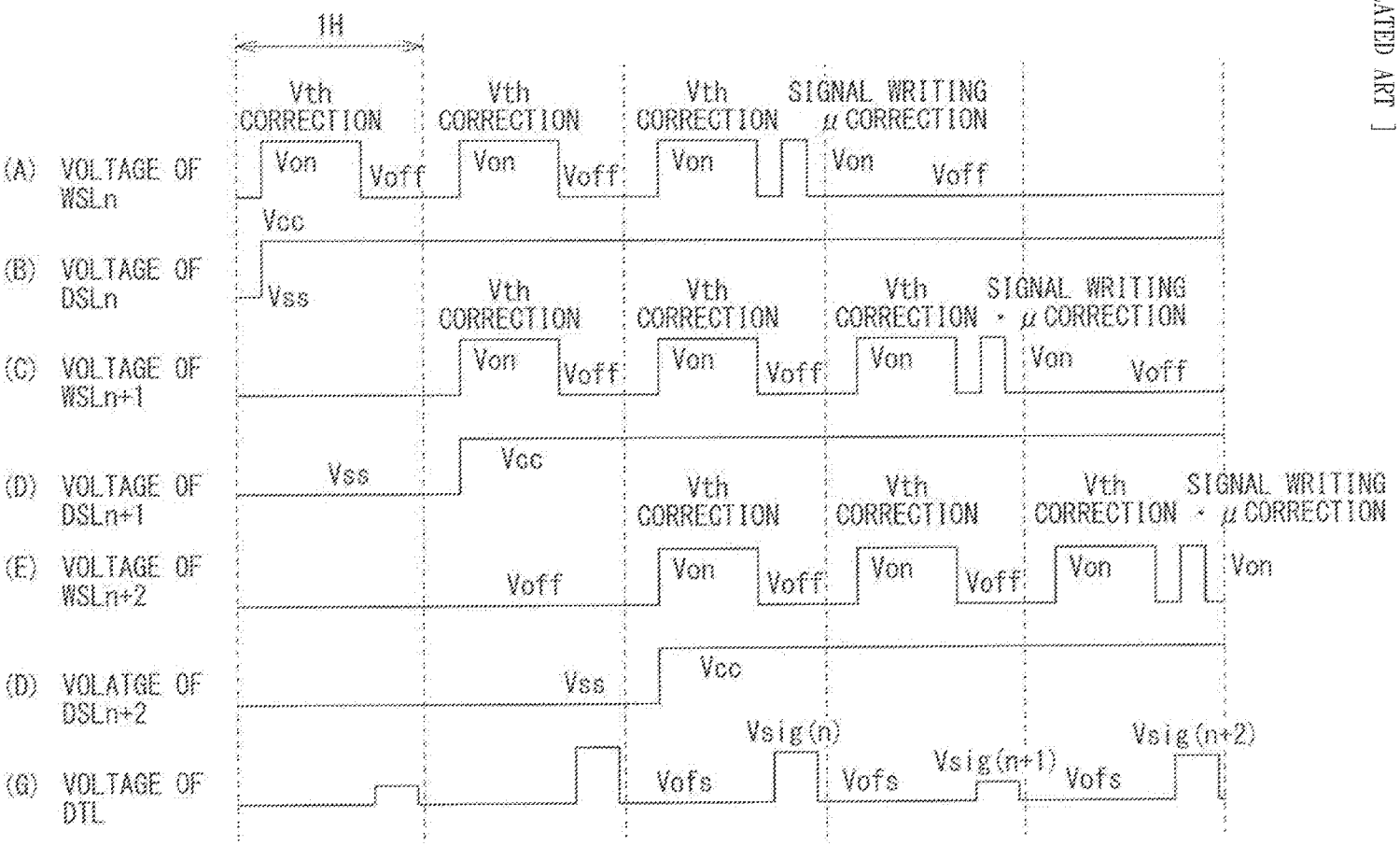

[ FIG. 9 ]
[ RELATED ART ]
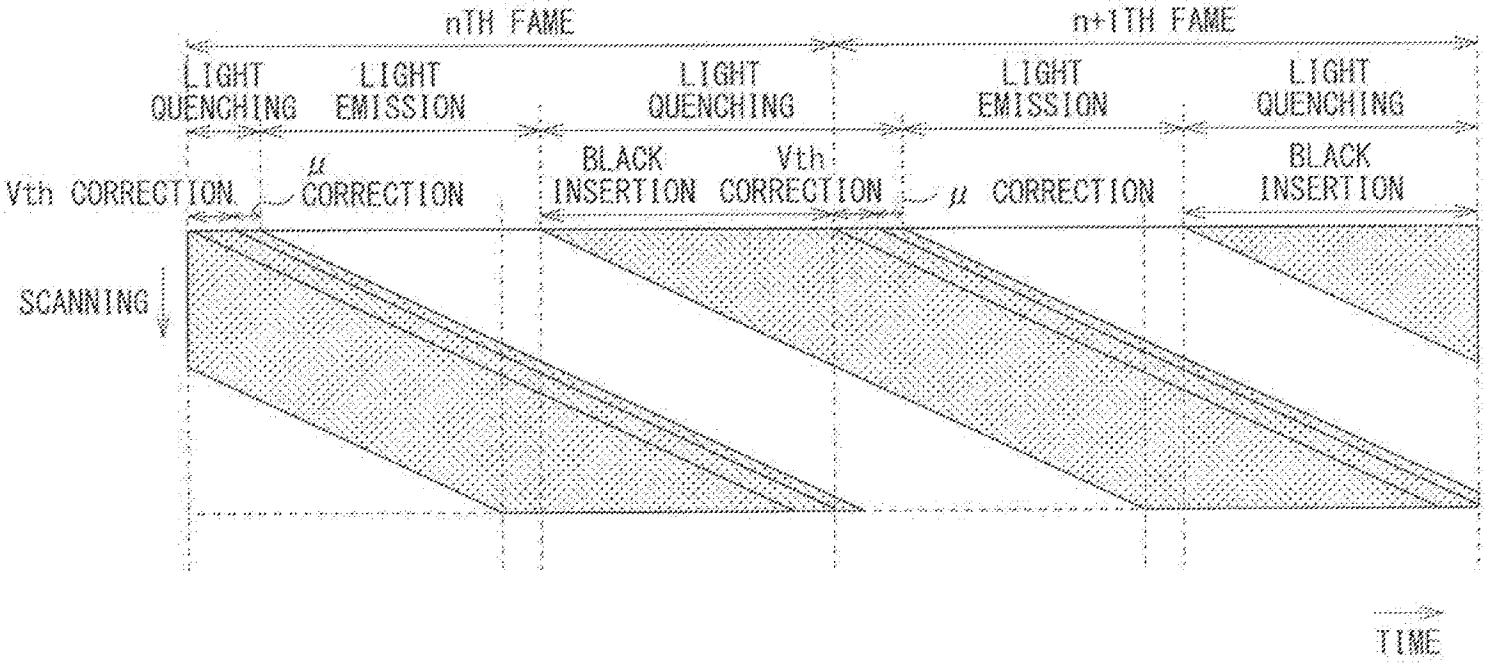

[ FIG. 10 ]
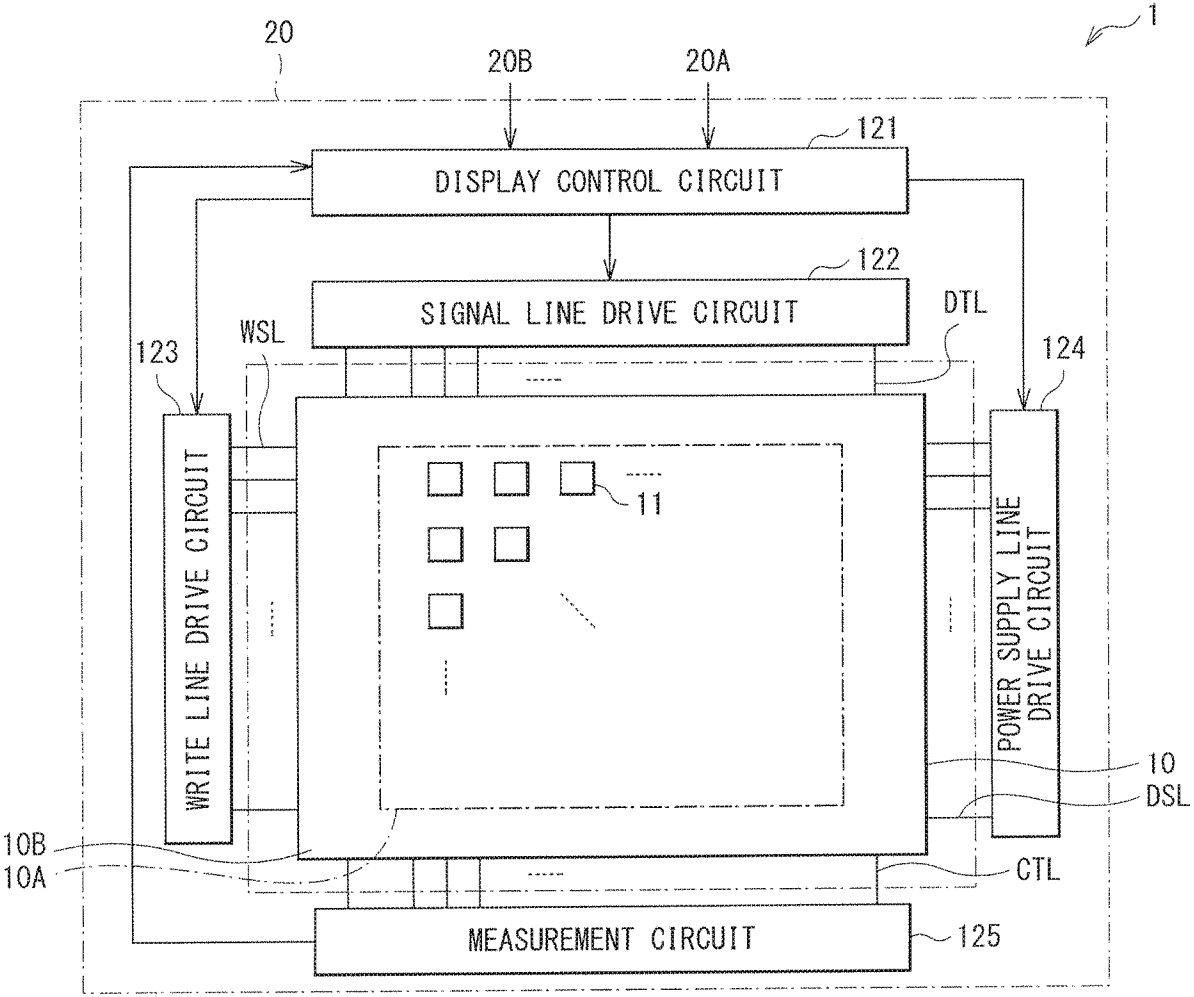

[ FIG. 11 ]
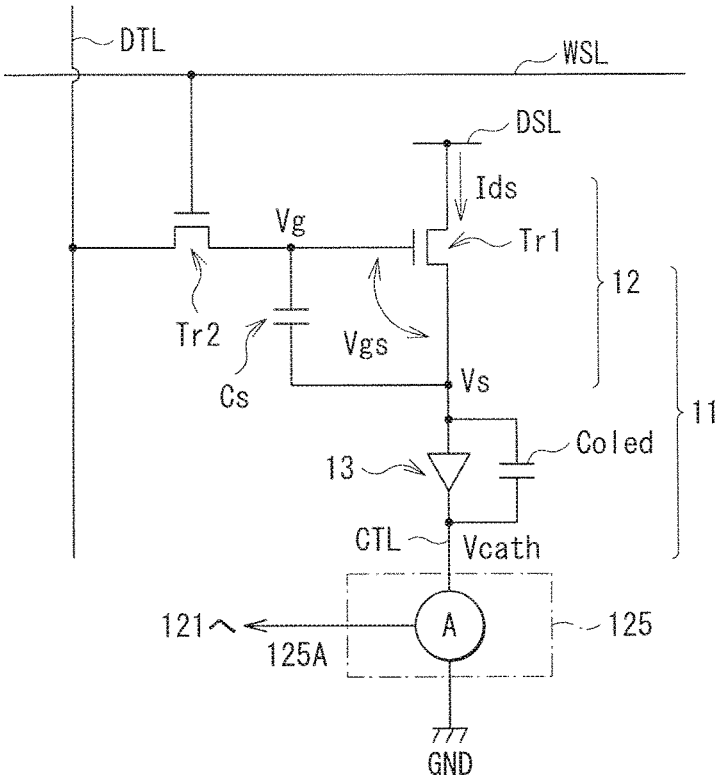
[ FIG. 12 ]
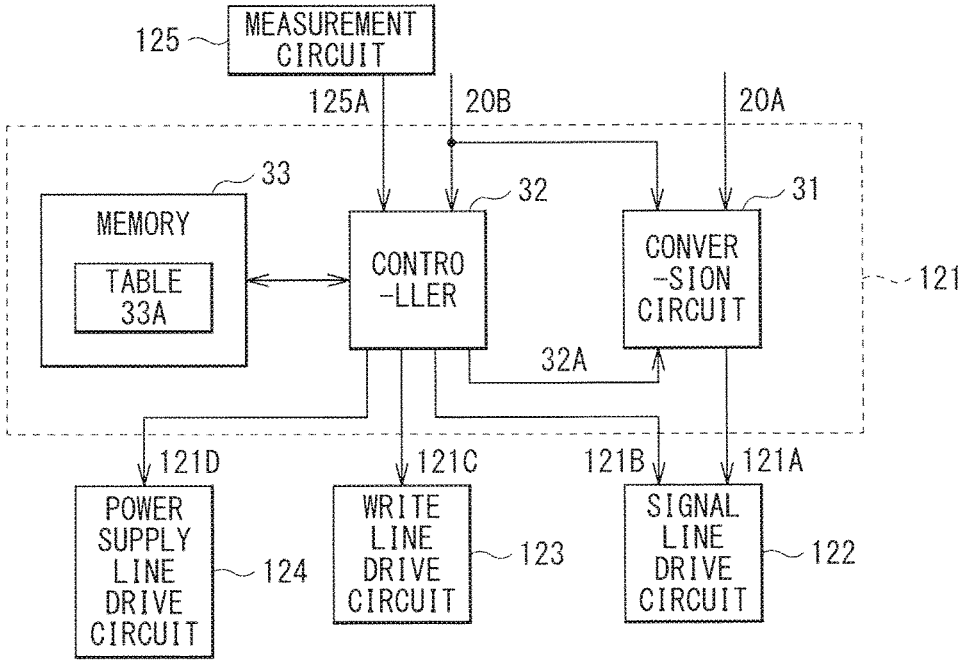

[ FIG. 13 ]

33A

| CURRENT VALUE | WRITE PULSE WIDTH (ON PERIOD OF Tr2) |
|---|---|
| Ids0 | Pw0 |
| ・ | ・ |
| ・ | ・ |
| Ids1 | Pw1 |
| ・ | ・ |
| ・ | ・ |

[ FIG. 14A ]
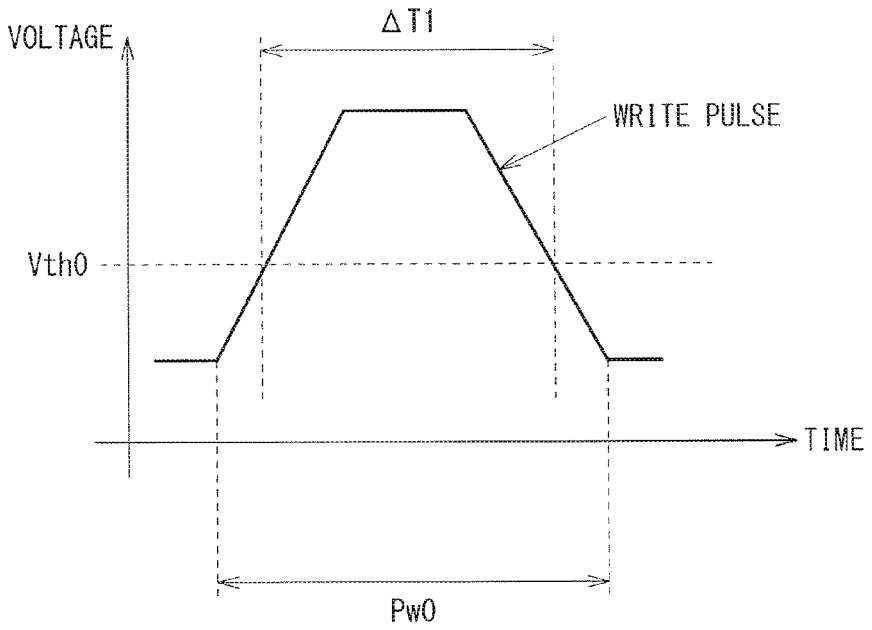
[ FIG. 14B ]
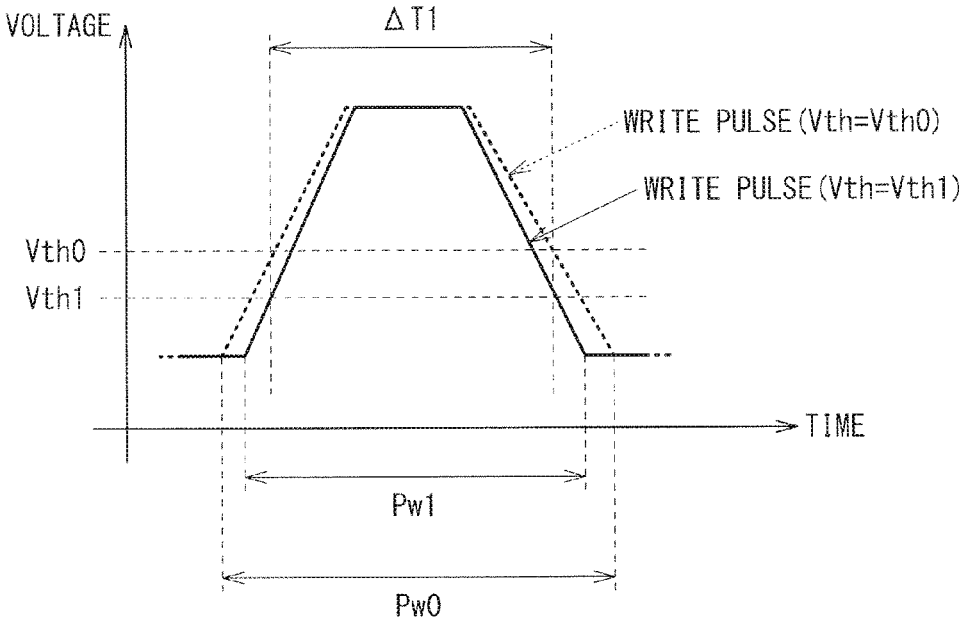

[ FIG. 15 ]
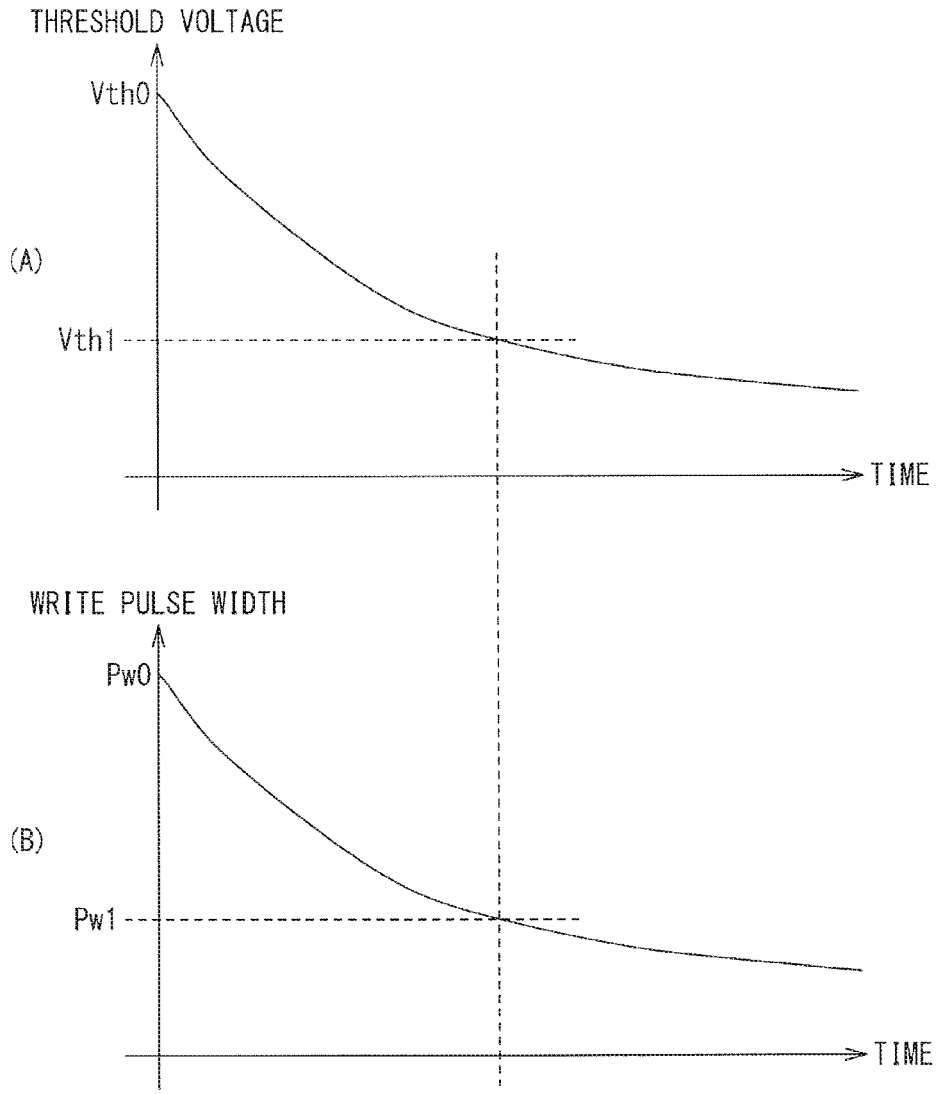

[ FIG. 16 ]
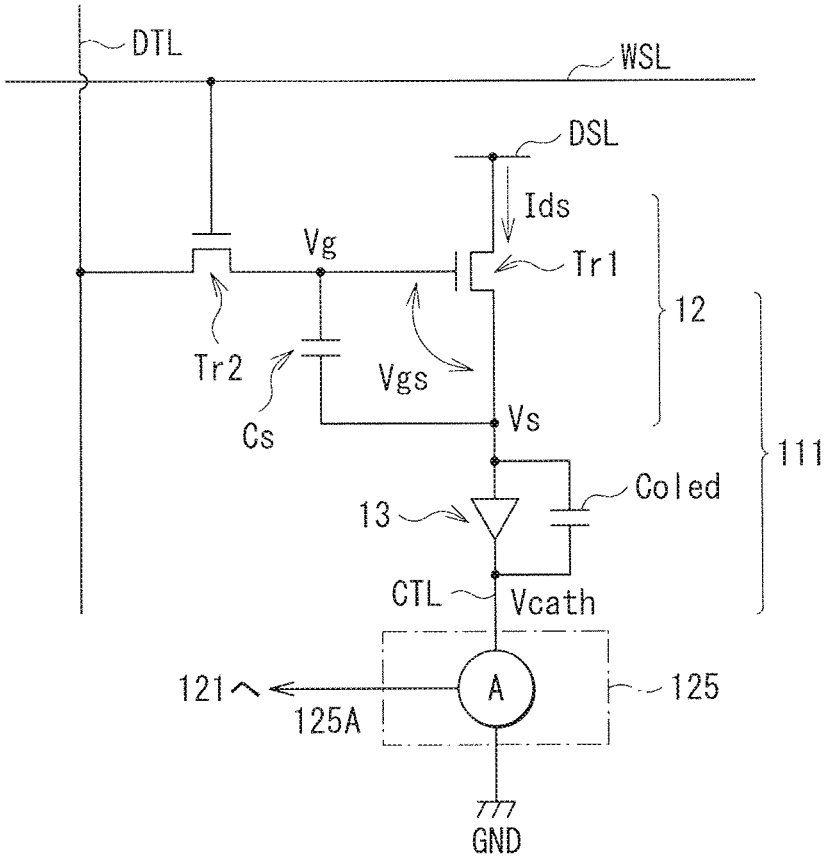

[ FIG. 17 ]
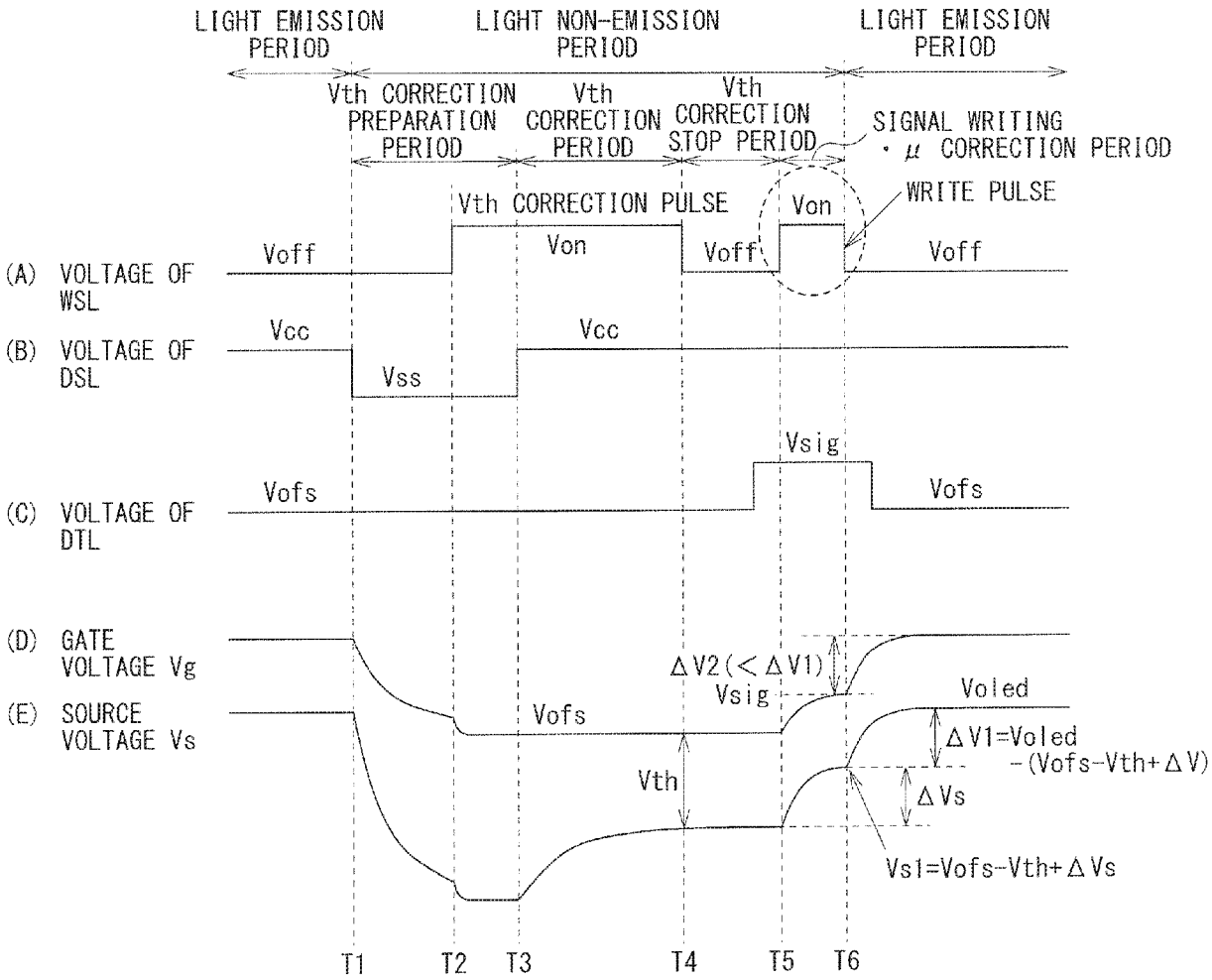

[ FIG. 18 ]
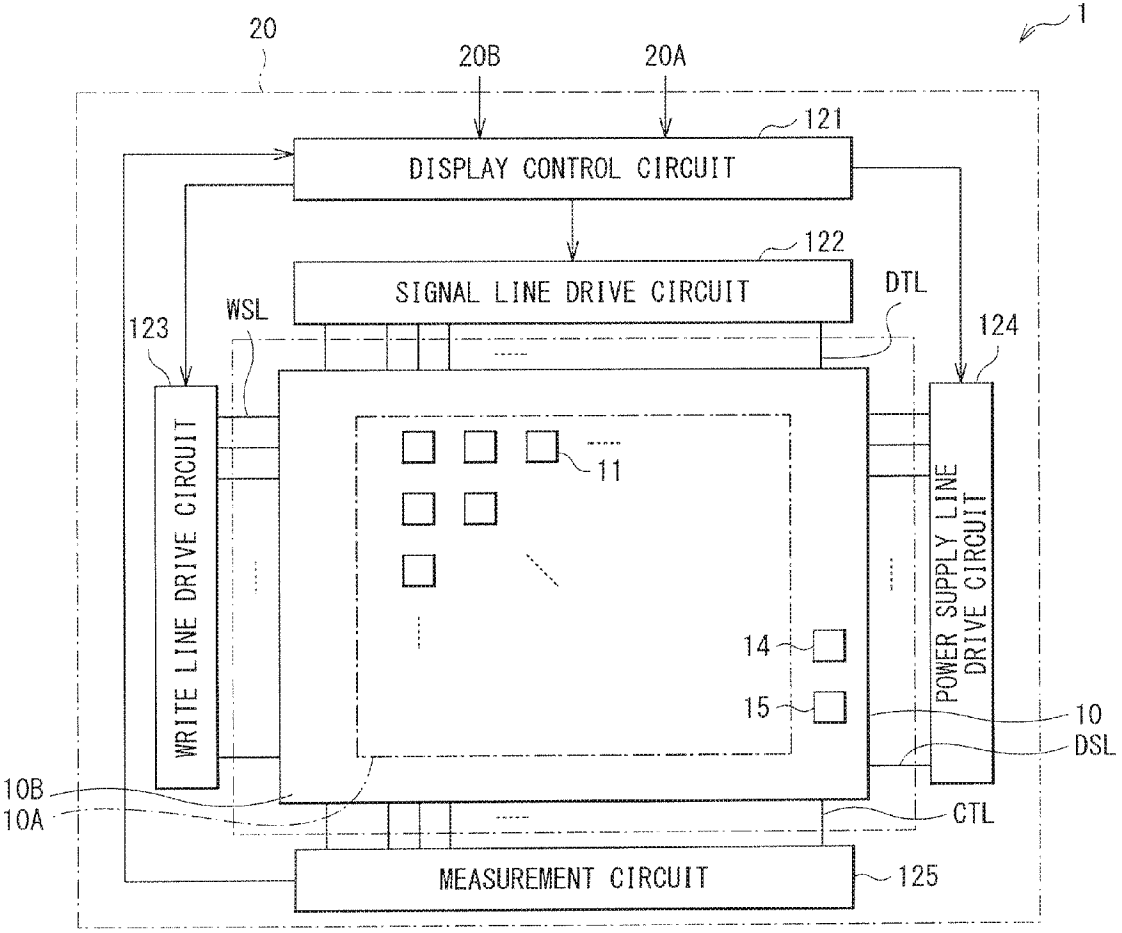

[ FIG. 19A ]
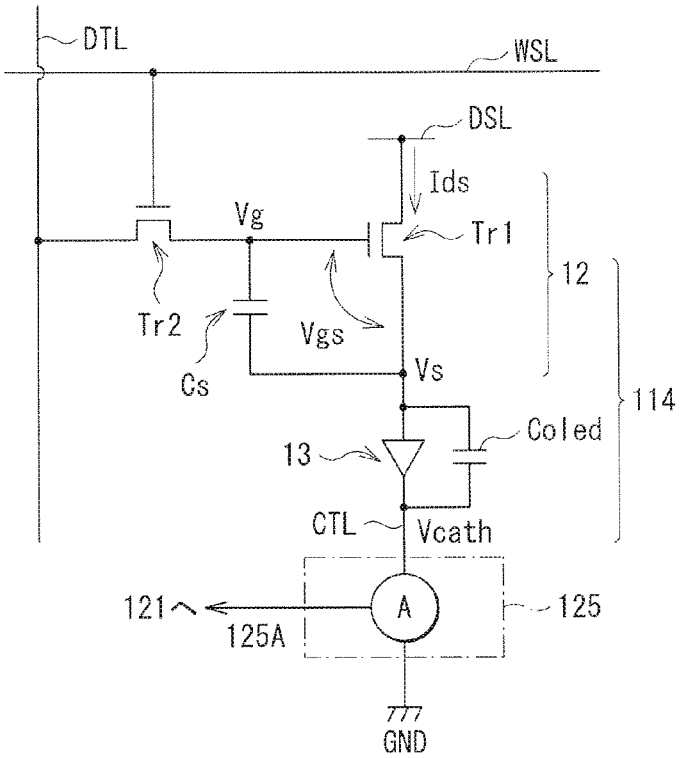
[ FIG. 19B ]
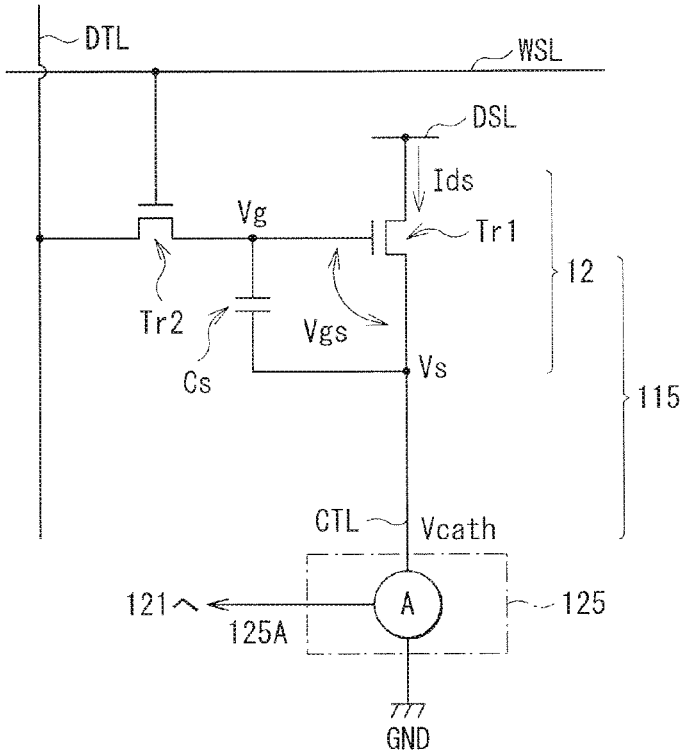

[ FIG. 20 ]
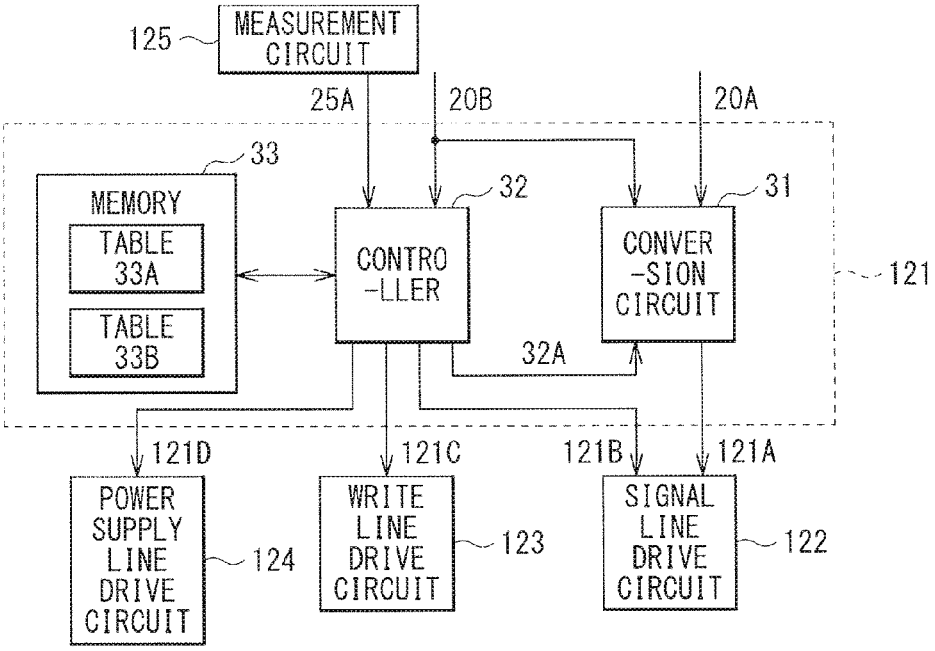
[ FIG. 21 ]
33B
| CURRENT VALUE | Vth CORRECTION PULSE WIDTH (ON PERIOD OF Tr2) |
|---|---|
| Ids0 | Pc0 |
| · | · |
| · | · |
| Ids1 | Pc1 |
| · | · |
| · | · |

[ FIG. 23 ]
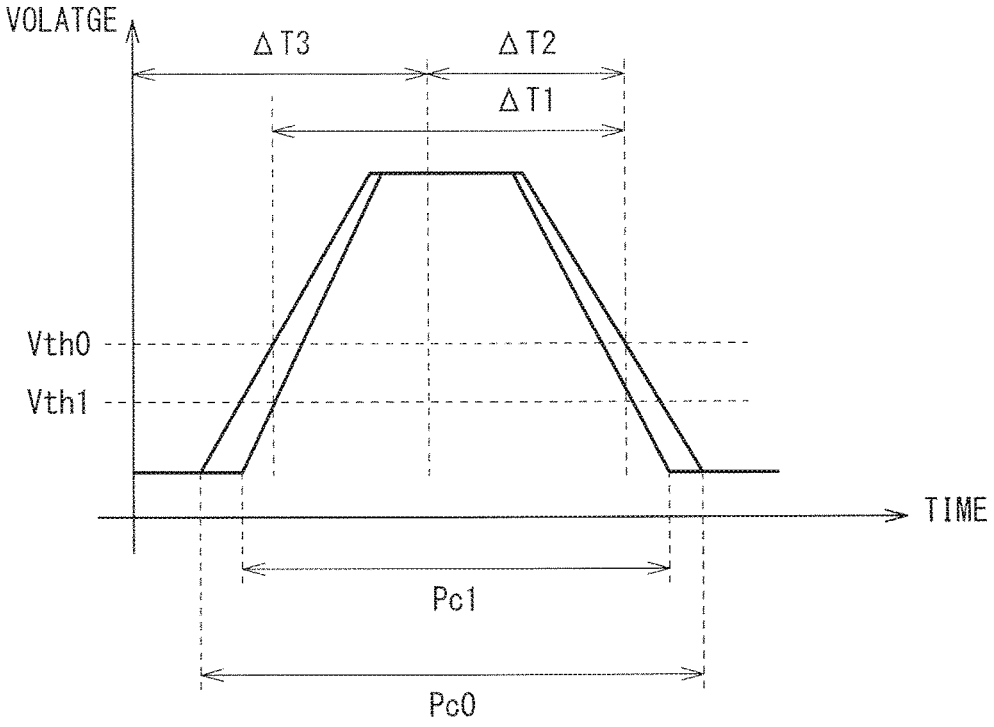

[ FIG. 24 ]
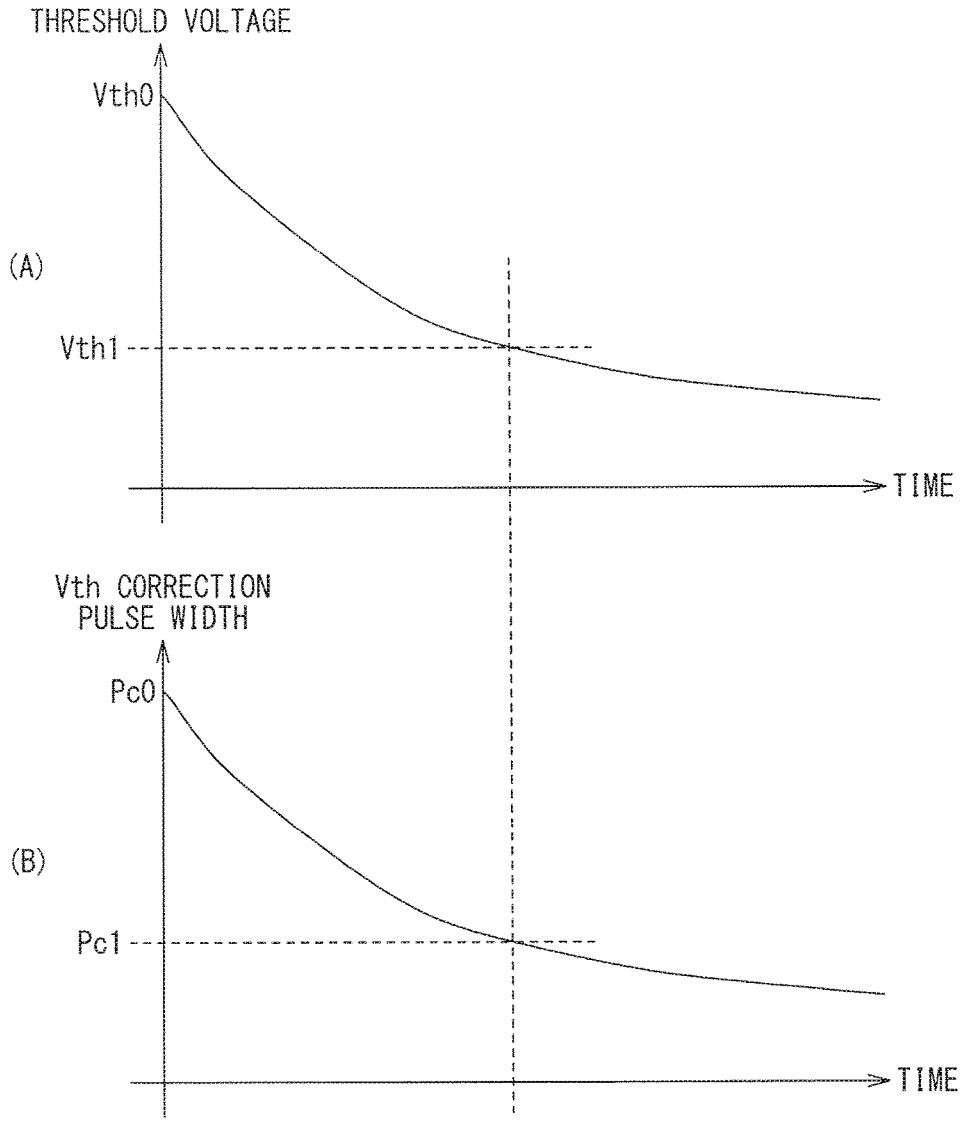

[ FIG. 25 ]
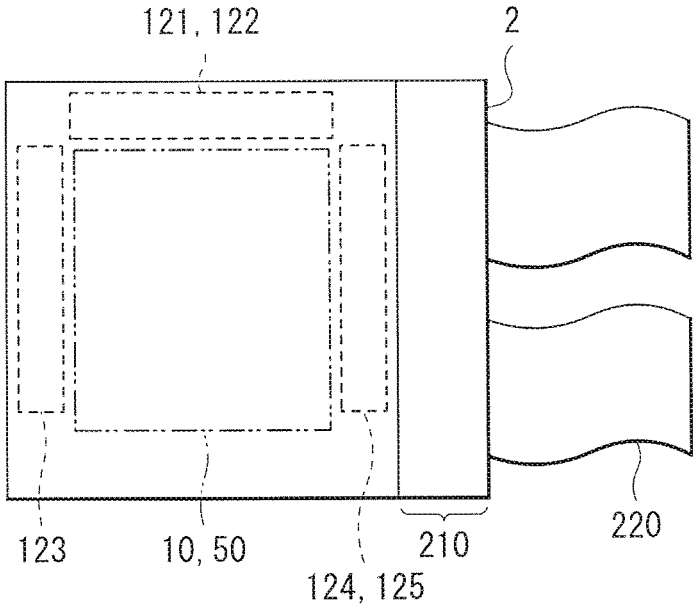

[ FIG. 26A ]
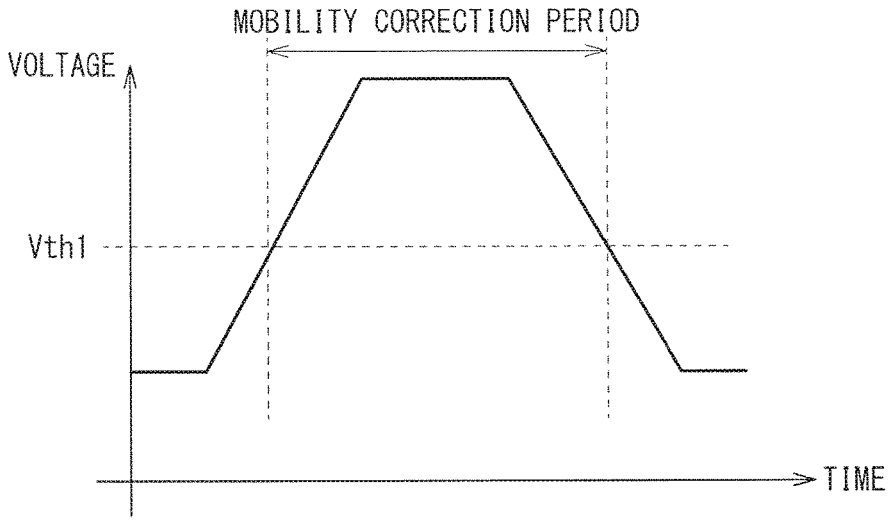
[ FIG. 26B ]
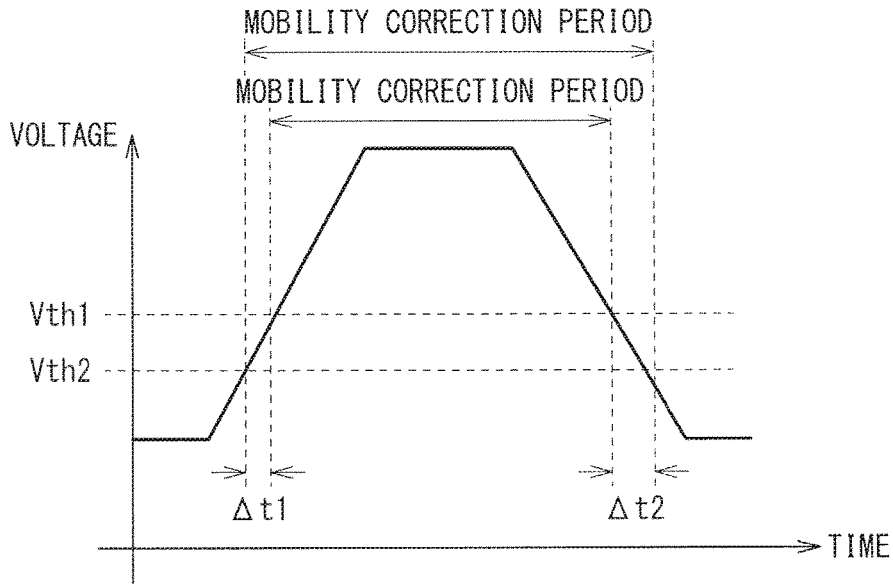

[ FIG. 27 ]
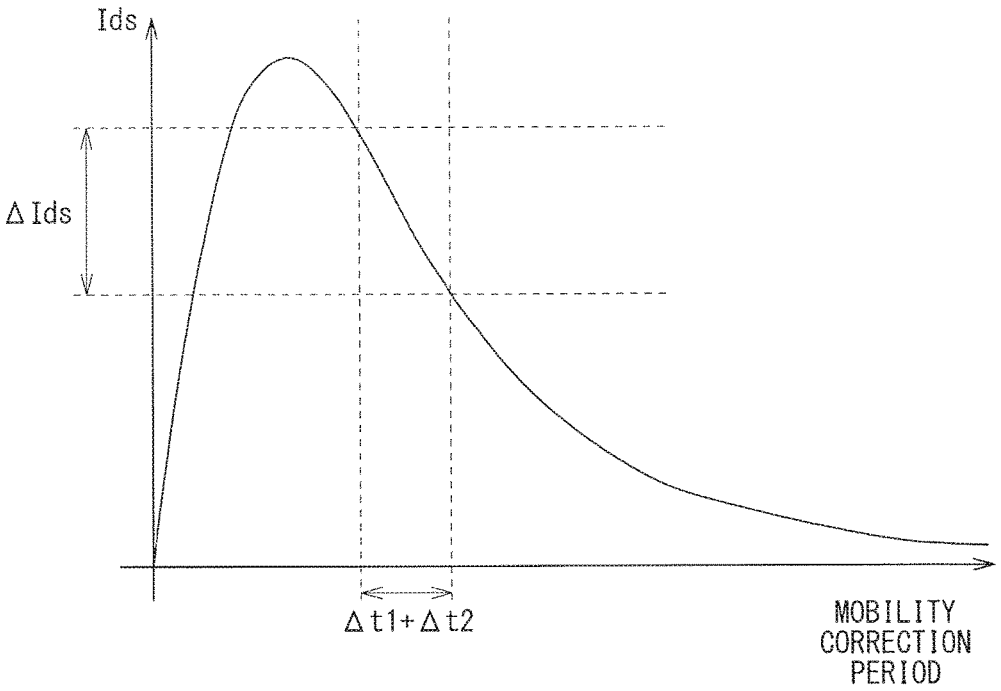

[ FIG. 28 ]
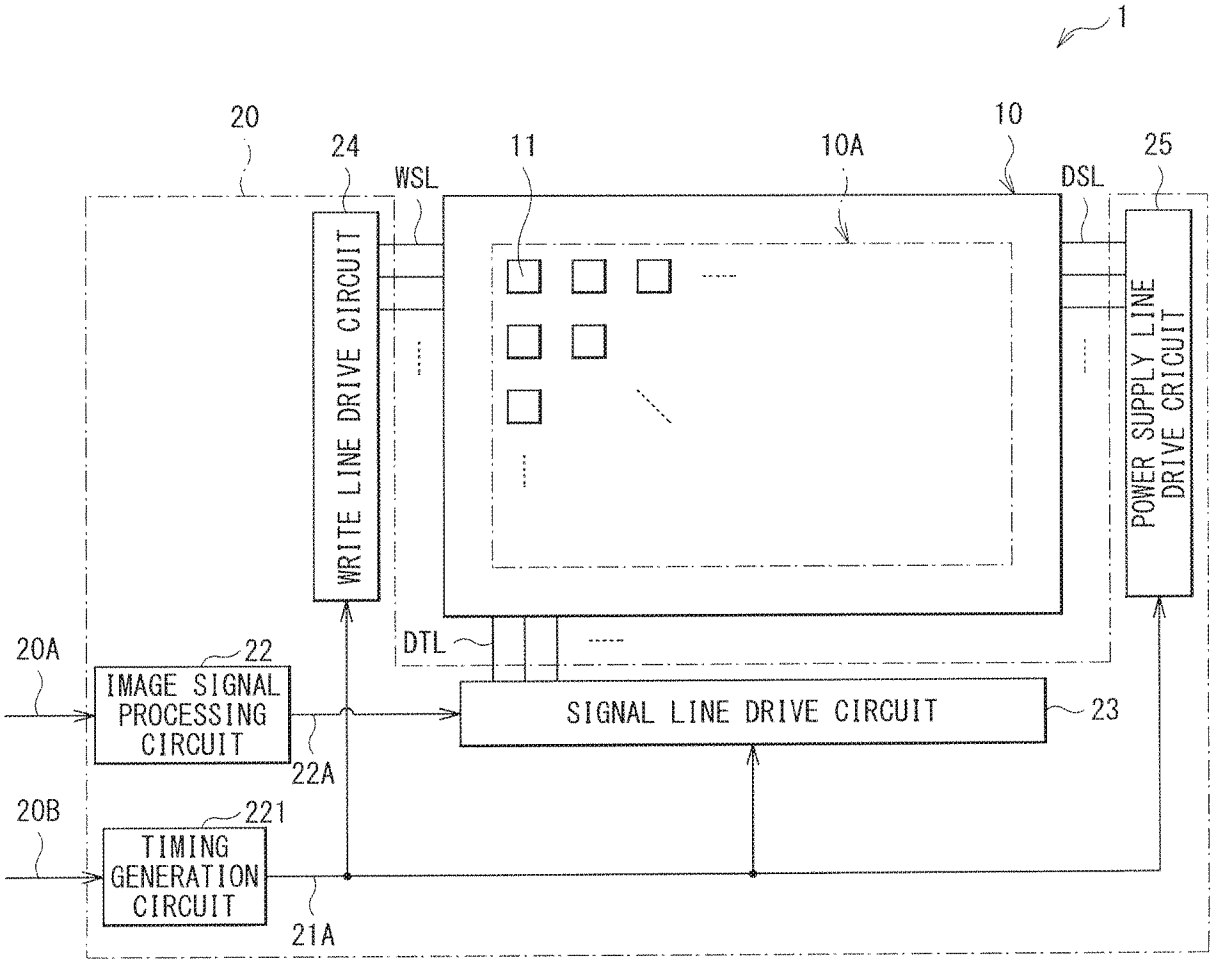

[ FIG. 29 ]
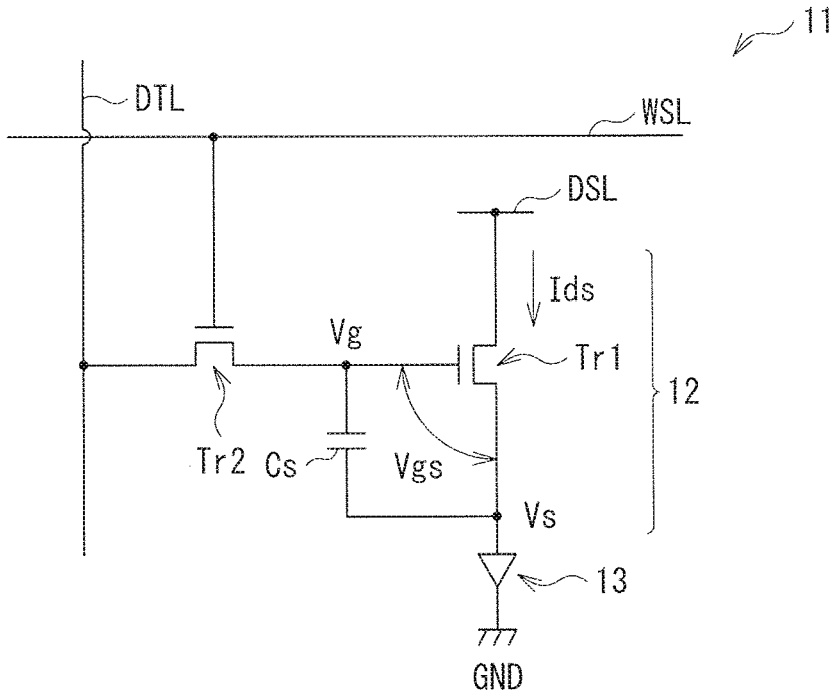

[ FIG. 30 ]
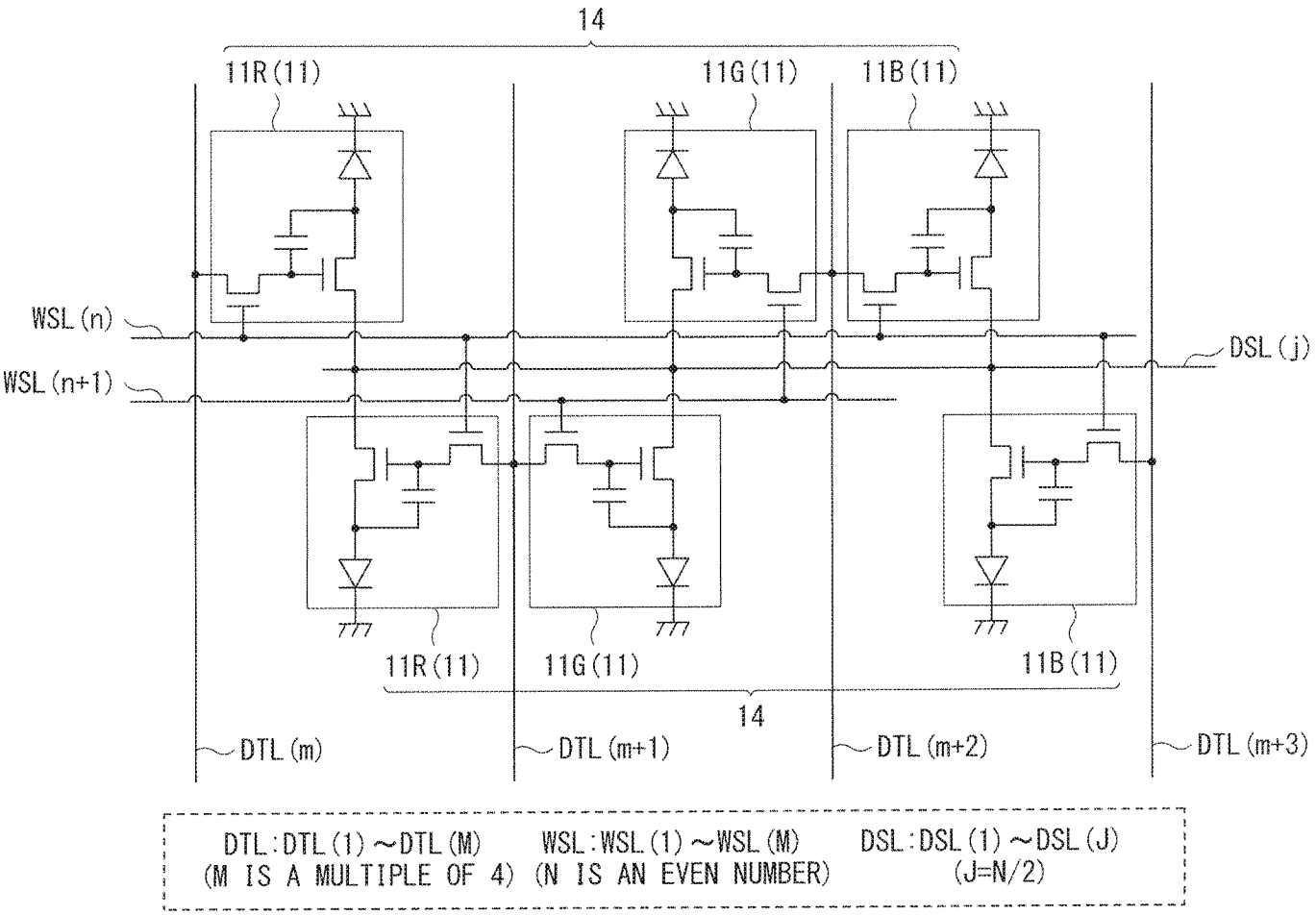

[ FIG. 31 ]
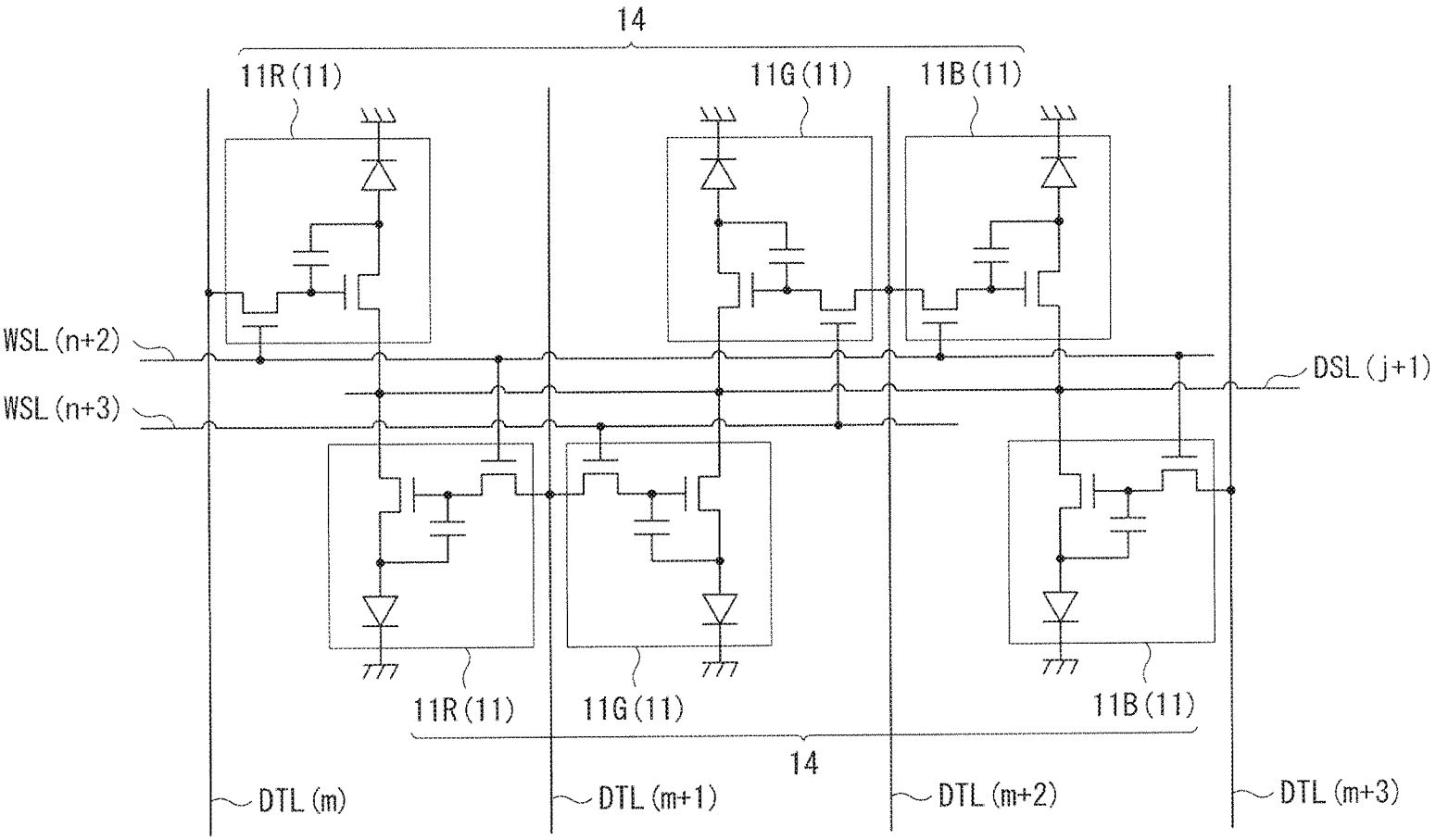

[ FIG. 32 ]
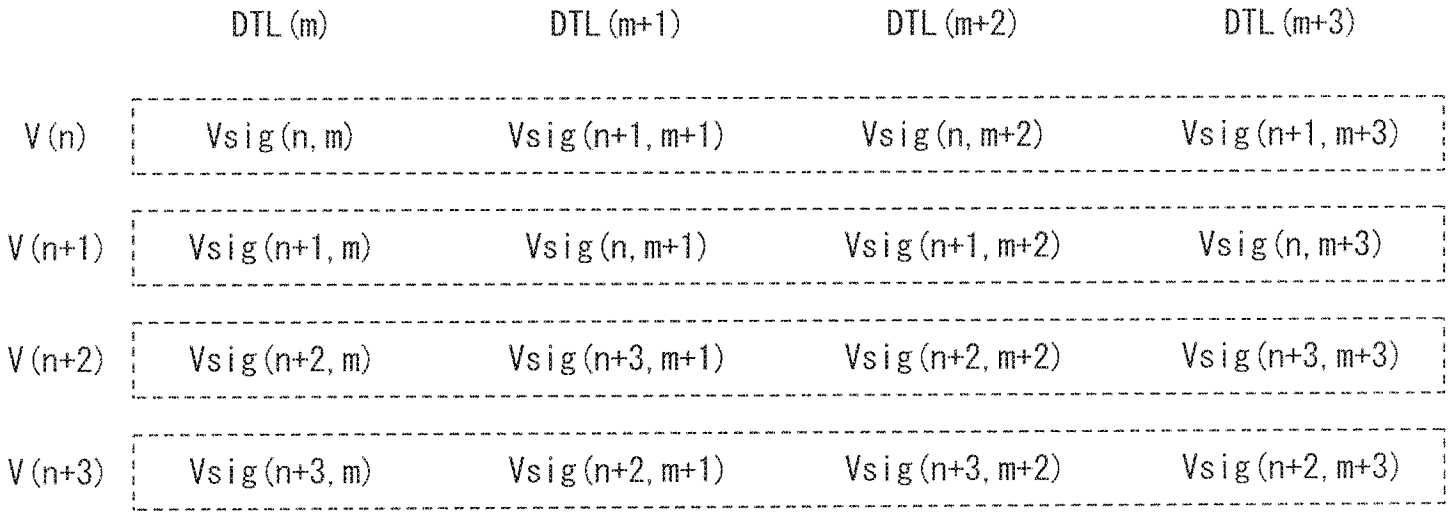

[ FIG. 33 ]
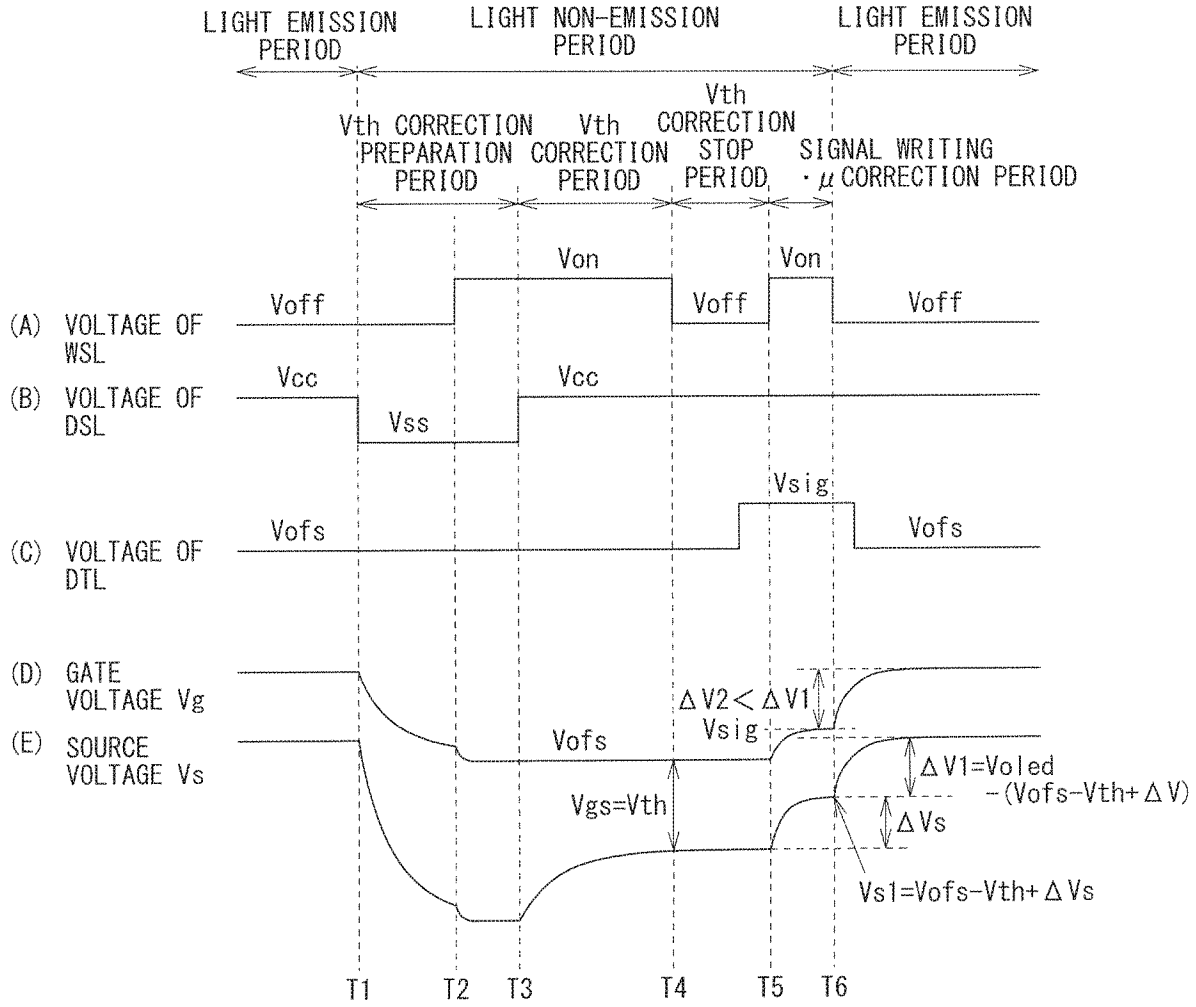

[ FIG. 34 ]
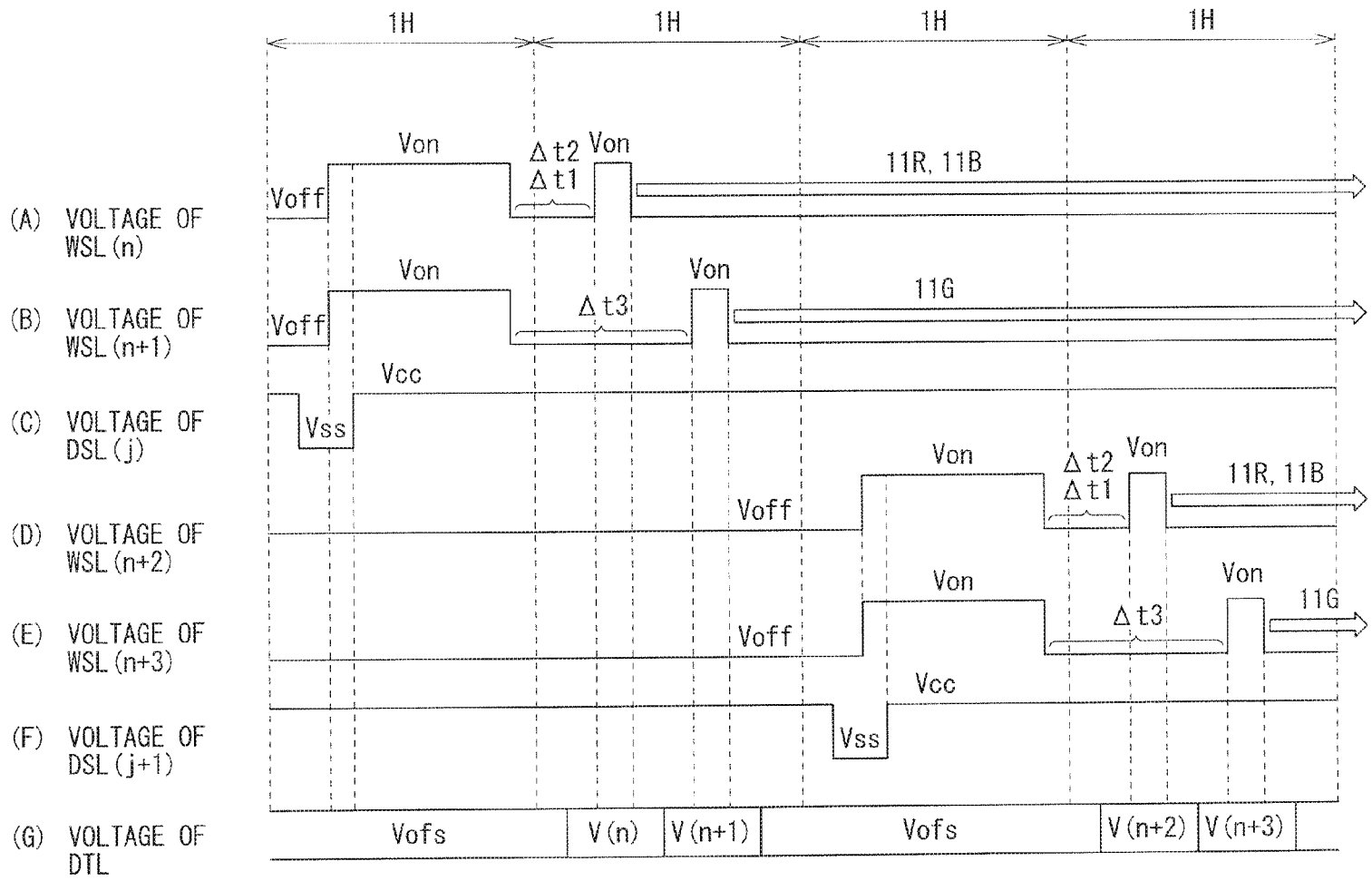

[ FIG. 36 ]
[ RELATED ART ]
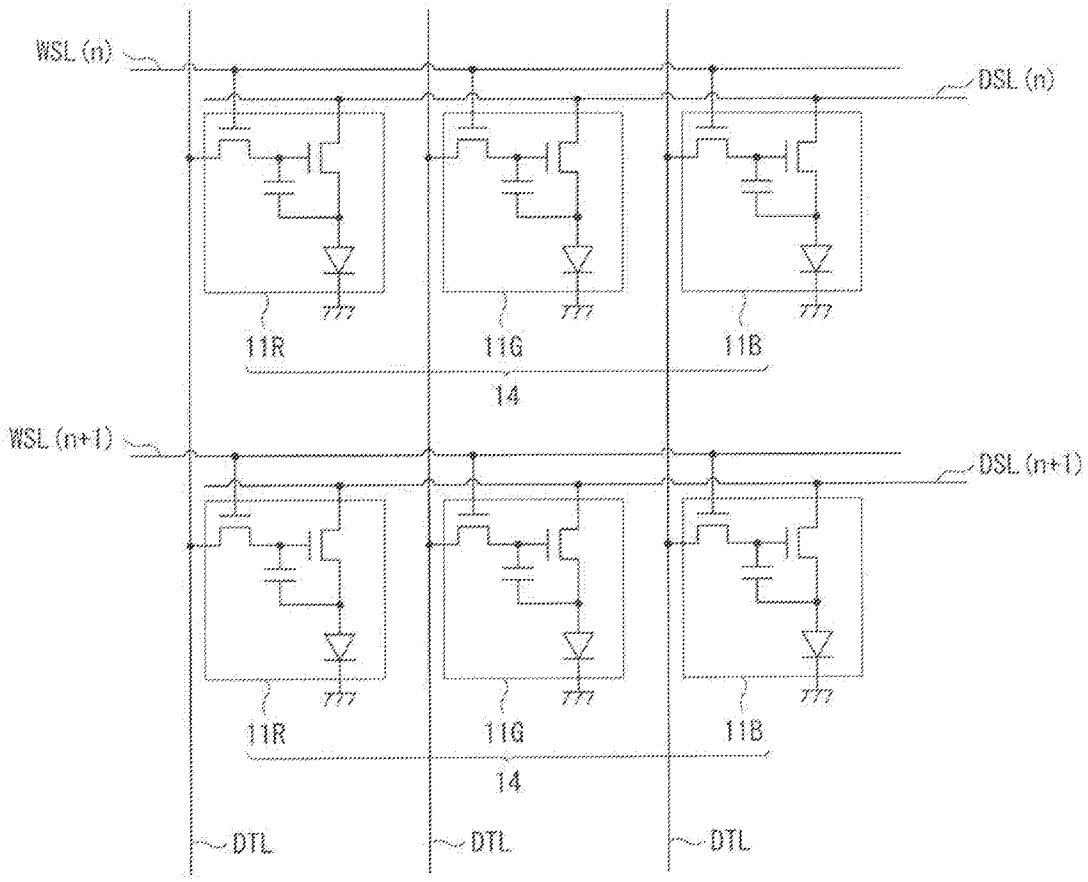

[ FIG. 36 ]
[ RELATED ART ]
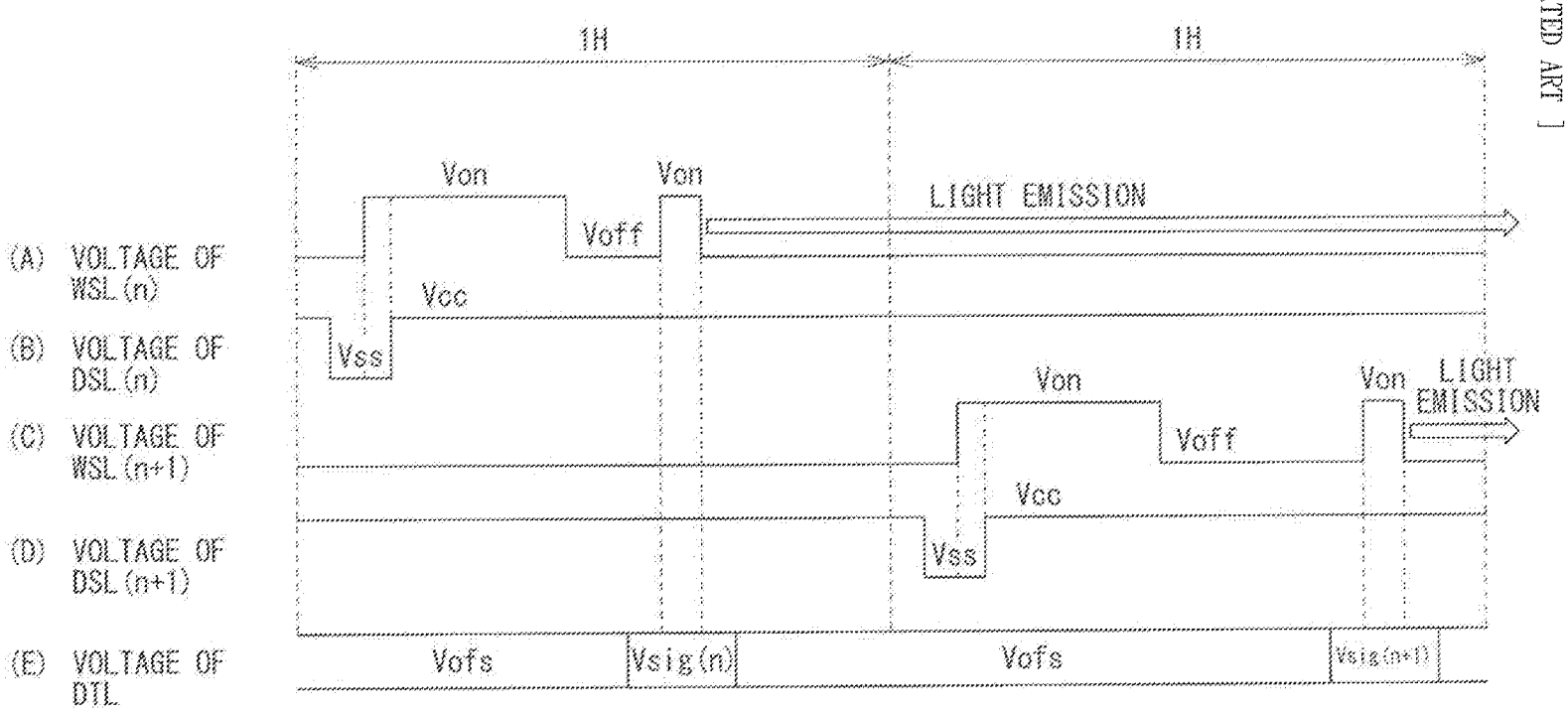

[ FIG. 37 ]
[ RELATED ART ]
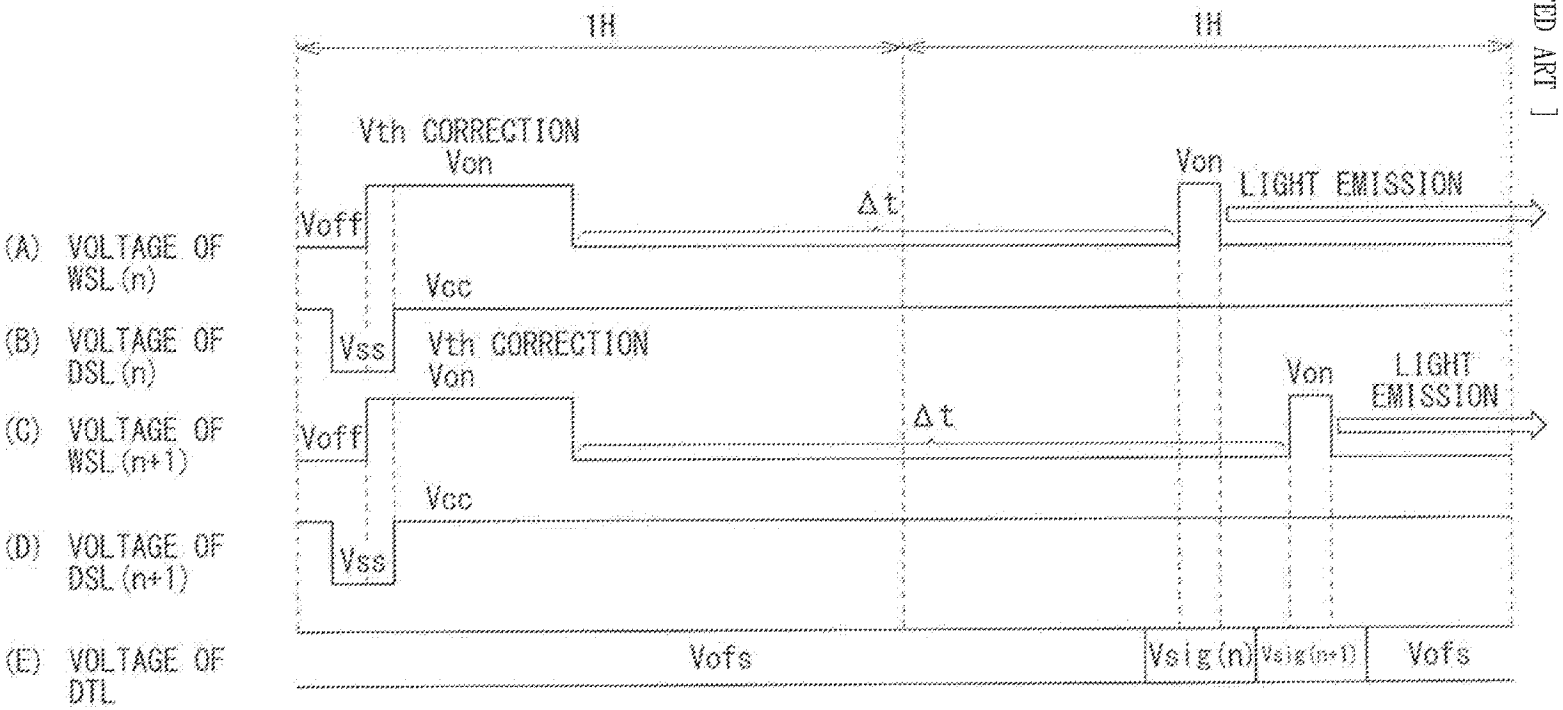

[ FIG. 38 ]
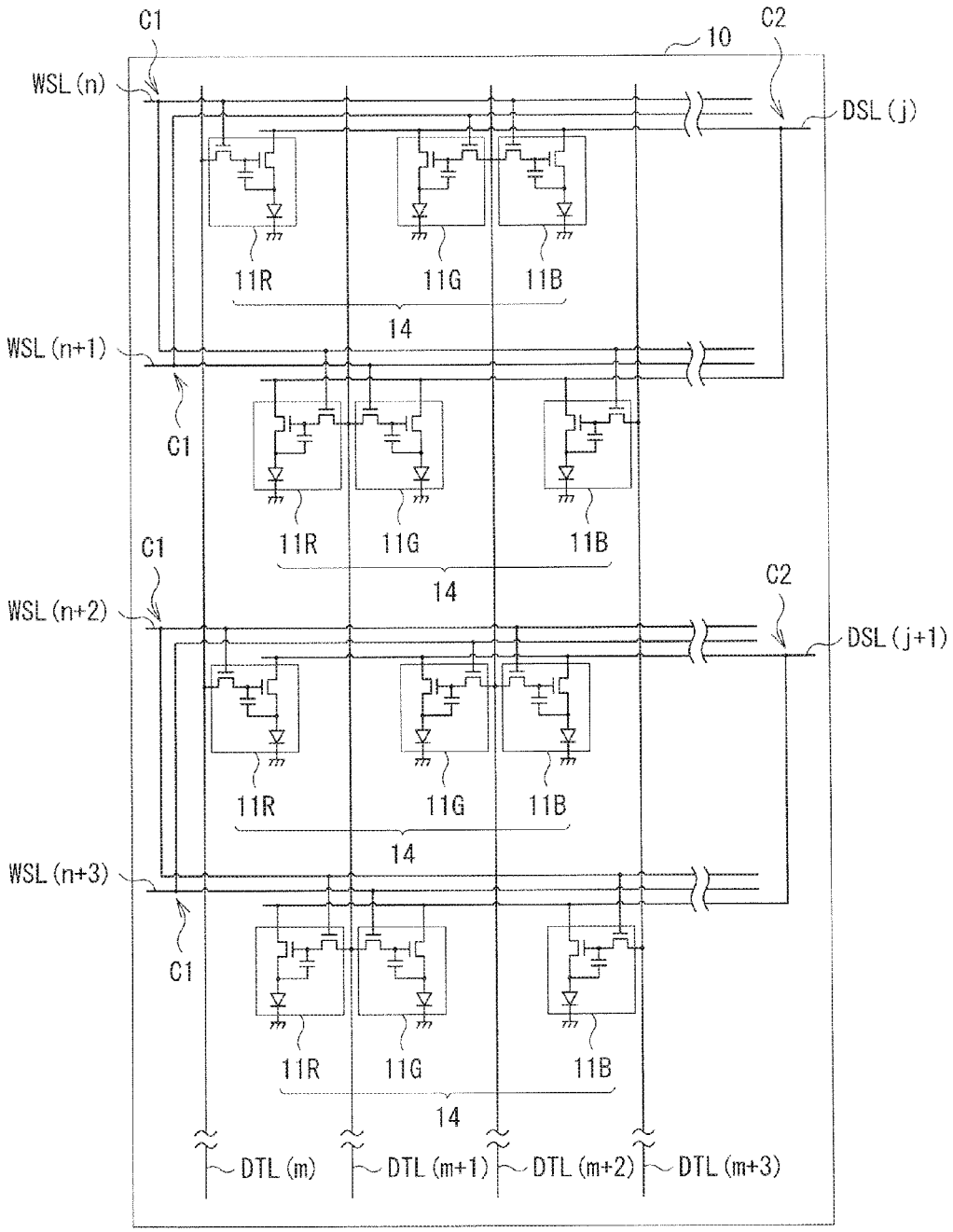

[ FIG. 39 ]
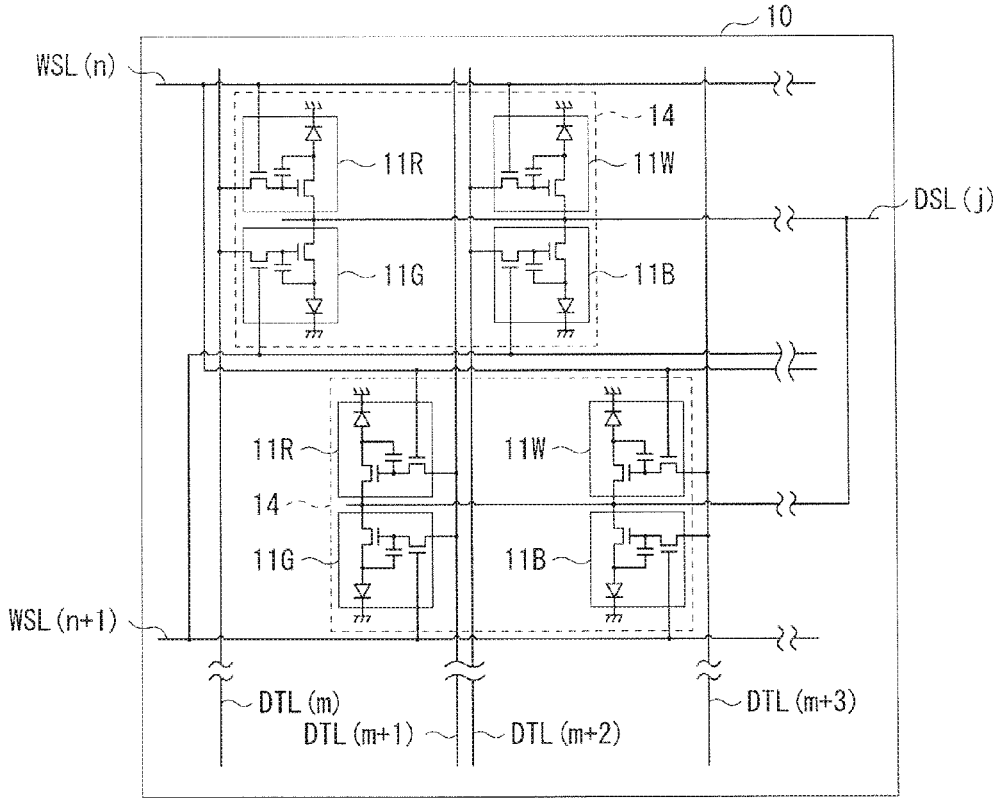

[ FIG. 40 ]
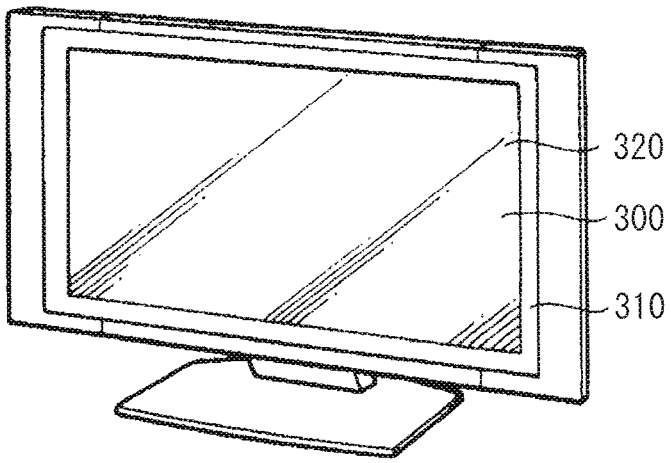
[ FIG. 41A ]
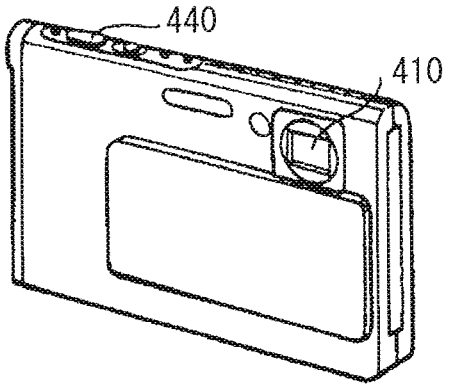
[ FIG. 41B ]
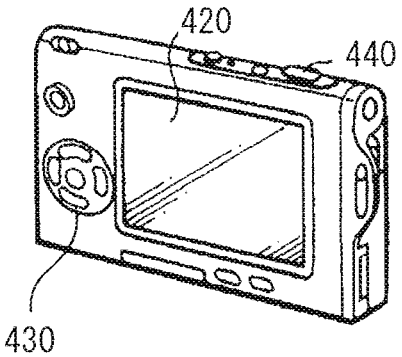

[ FIG. 42 ]
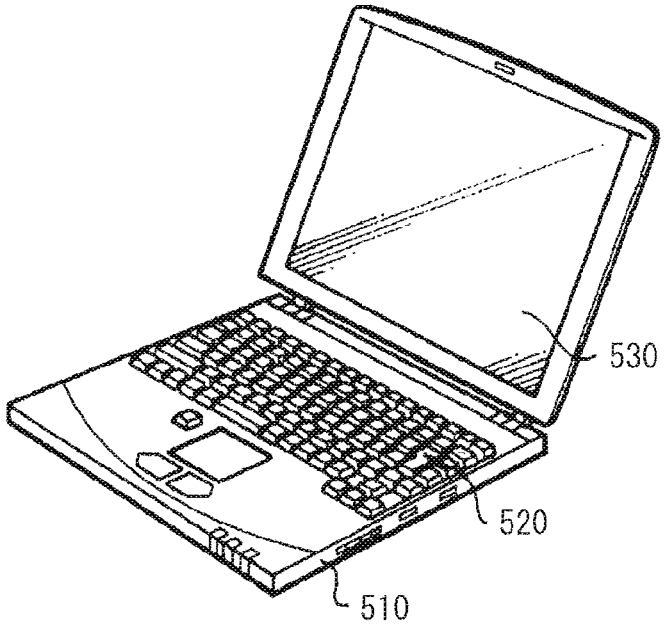
[ FIG. 43 ]
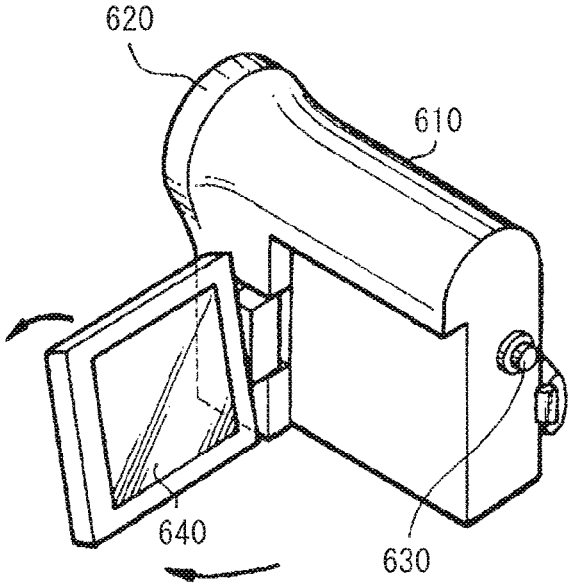

[ FIG. 44A ]
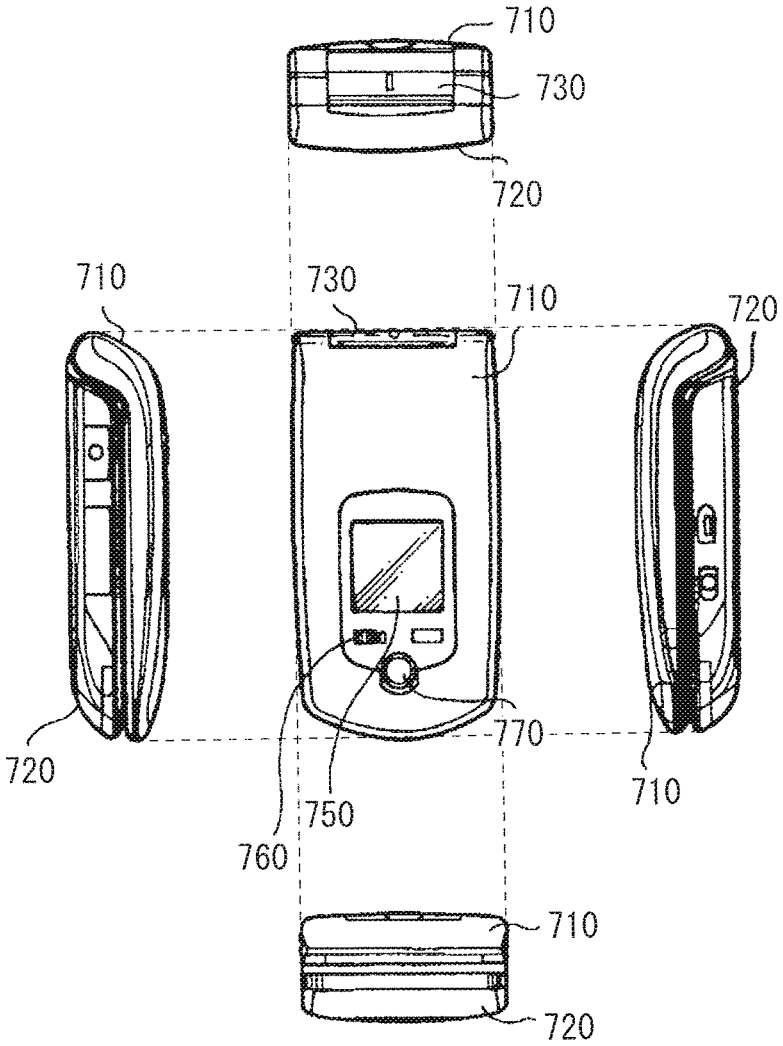

[ FIG. 44B ]
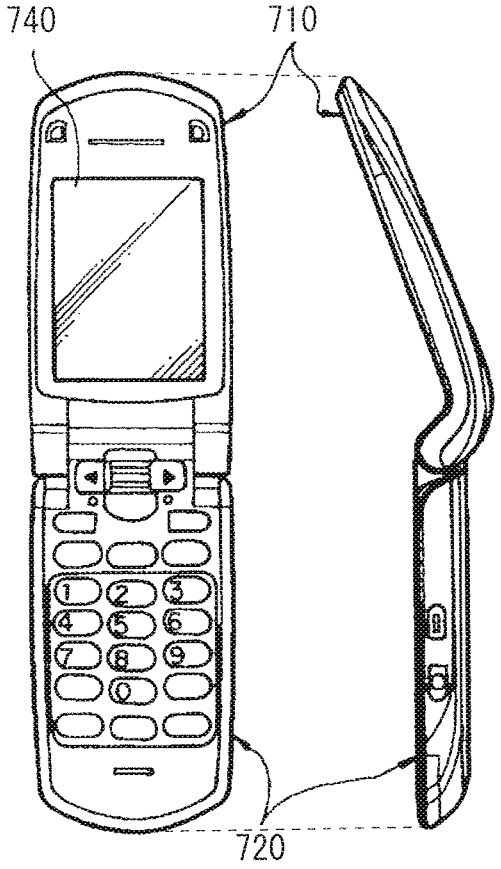

DISPLAY UNIT, DISPLAY PANEL, AND METHOD OF DRIVING THE SAME, AND ELECTRONIC APPARATUS

TECHNICAL FIELD

The present technology relates to a display unit including, for example, light-emitting devices such as organic EL (Electro Luminescence) devices in respective pixels, a display panel, and a method of driving the same. Moreover, the present technology relates to an electronic apparatus including the above-described display unit.

BACKGROUND ART

In recent years, in the field of display units displaying an image, display units using, as light-emitting devices of pixels, current drive type light-emitting devices of which light emission luminance changes with a value of a current flowing therethrough, for example, organic EL devices have been developed for commercialization. Unlike liquid crystal devices and the like, the organic EL devices are self-luminous devices. Therefore, in a display unit (an organic EL display unit) using the organic EL devices, since a light source (a backlight) is not necessary, compared to a liquid crystal display unit needing a light source, a reduction in thickness of the display unit and an increase in luminance of the display unit are achievable. In particular, in a case where the display unit uses an active matrix system as a drive system, each pixel is allowed to continuously emit light, and a reduction in power consumption is achievable. Therefore, the organic EL display unit is expected to become a mainstream of next-generation flat panel display.

Incidentally, current-voltage (I-V) characteristics of a typical organic EL device deteriorate with the lapse of time (deteriorate with time). In a pixel circuit that drives the organic EL device with a current, when the I-V characteristics of the organic EL device change with time, a division ratio between the organic EL device and a drive transistor connected in series to the organic EL device changes; therefore, a gate-source voltage of the drive transistor also changes. As a result, a value of a current flowing through the drive transistor changes; therefore, a value of a current flowing through the organic EL device voltage also changes, and light emission luminance also changes with the current value accordingly.

Moreover, a threshold voltage (Vth) or mobility (μ) of the drive transistor may change with time, or Vth or μ may differ for each pixel circuit due to variation in manufacturing processes. In a case where Vth or μ of the drive transistor differs for each pixel circuit, the value of the current flowing through the drive transistor varies for each pixel circuit; therefore, even if a same voltage is applied to a gate of the drive transistor, light emission luminance of the organic EL device varies, and uniformity of a screen is impaired.

Therefore, even if the I-V characteristics of the organic EL device change with time, or Vth or μ changes with time, to keep light emission luminance of the organic EL device constant without being affected by them, a display unit having a compensation function for variation in the I-V characteristics of the organic EL device and a correction function for variation in Vth or μ has been developed (for example, refer to PTL 1).

CITATION LIST

Patent Literature

[PTL 1] Japanese Unexamined Patent Application Publication No. 2008-083272

SUMMARY

FIG. 8 illustrates an example of existing drive timings. In FIG. 8, WSLn represents an nth scanning line, WSLn+1 represents an n+1th scanning line, and WSLn+2 represents an n+2th scanning line. Moreover, DSLn represents an nth power supply line, DSLn+1 represents an n+1th power supply line, and DSLn+2 represents an n+2th power supply line. Further, DTL represents a signal line corresponding to a given pixel column. Furthermore, 1H represents one horizontal period.

Typically, scanning for Vth correction and scanning for μ correction are performed simultaneously. Therefore, it is difficult to successively perform the Vth correction over a plurality of horizontal periods, and, for example, as illustrated in FIG. 8, it is desirable to divide and perform the Vth correction for each one horizontal period. Therefore, it is difficult to perform scanning for the Vth correction at high speed.

Thus, it is desirable to provide a display unit capable of performing scanning for Vth correction at higher speed and a method of driving the same, and an electronic apparatus including the above-described display unit.

Incidentally, a mobility correction period is determined by a width of a write pulse applied to a gate of a write transistor connected to the gate of the drive transistor (i.e., an ON period of the write transistor). However, the write pulse does not have a perfect square wave, but has rounding as illustrated in FIG. 26A. Therefore, in actuality, as illustrated in FIG. 26B, the mobility correction period may vary with a threshold voltage of the write transistor. When the mobility correction period varies, as illustrated in FIG. 27, magnitude of a current Ids flowing through the organic EL device when the organic EL device emits light changes, and light emission luminance also changes accordingly. Therefore, the mobility correction period preferably varies as little as possible.

The threshold voltage of the write transistor changes (decreases), for example, by continuously applying a negative bias to a gate-source voltage of the write transistor. In other words, threshold voltage characteristics of the write transistor are shifted from enhancement to depression. As used herein, the negative bias refers to a bias state in which a gate potential is negative with respect to a source potential. Enhancement refers to a state in which a channel is formed when the write pulse is applied to a gate, and a current flows between a source and a drain. Moreover, depression refers to a state in which a current flows between the source and the drain without application of the write pulse to the gate.

Typically, the negative bias is applied to the write transistor in a light emission period or a light quenching period of the organic EL device. When the negative bias is continuously applied to the gate-source voltage of the write transistor, a depression shift occurs in the threshold voltage characteristics of the write transistor, and, for example, as illustrated in FIG. 26B, the threshold voltage changes (decreases) from Vth1 to Vth2. Therefore, the mobility correction period becomes longer by Δt1+Δt2 than an initial period. As a result, as illustrated in FIG. 27, the current Ids flowing through the organic EL device when the organic EL device emits light is decreased by ΔIds, and light emission luminance is also decreased accordingly. In other words, the light emission luminance is decreased with the duration of use of the organic EL display unit.

Therefore, it is desirable to provide a display unit capable of reducing a decrease in light emission luminance caused by the depression shift and a method of driving the same, and an electronic apparatus including the above-described display unit.

Incidentally, for example, in an existing driving method illustrated in FIG. 36, Vth correction that allows the gate-source voltage of the drive transistor to be brought close to the threshold voltage of the drive transistor and signal writing in which a signal voltage corresponding to an image signal is written to the gate of the drive transistor are performed in each 1H period. Therefore, in this driving method, it is difficult to shorten the 1H period and shorten a scanning period per 1F (i.e., to achieve speed-up of driving). Therefore, for example, as illustrated in FIG. 37, after the Vth correction is performed collectively on two lines in a common 1H period, the signal writing is performed from one line to another in the next 1H period. Since the Vth correction is performed collectively on lines, this driving method is suitable for high-speed driving. However, a waiting period Δt from end of the Vth correction to start of the signal writing differs for each line. Therefore, even if a signal voltage with a same gray scale is applied to the gates of the drive transistors on respective lines, light emission luminance differs for each line, thereby causing an issue that luminance unevenness occurs.

Therefore, it is desirable to provide a display panel capable of reducing occurrence of luminance unevenness caused by performing Vth correction collectively on a plurality of lines and a method of driving the same, and a display unit and an electronic apparatus each of which includes such a display panel.

A display unit according to a first embodiment of the present technology includes: a display section including a light-emitting device and a pixel circuit in each pixel; and a drive section configured to drive the pixel circuit, based on an image signal. The pixel circuit includes a drive transistor configured to drive the light-emitting device, and a write transistor configured to control application of a signal voltage corresponding to the image signal to a gate of the drive transistor. The drive section performs, on all pixel rows, Vth correction that allows a gate-source voltage of the drive transistor to be brought close to a threshold voltage of the drive transistor, and then performs writing of the signal voltage corresponding to the image signal to gates of the drive transistors in all pixel rows.

An electronic apparatus according to a first embodiment of the present technology includes the display unit according to the above-described first embodiment.

A method of driving a display unit according to a first embodiment of the present technology is a method of driving a display unit that includes a light-emitting device and a pixel circuit in each pixel. The pixel circuit includes a drive transistor configured to drive the light-emitting device, and a write transistor configured to control application of a signal voltage corresponding to an image signal to a gate of the drive transistor. The method of driving the display unit according to the first embodiment of the present technology includes: in the display unit with such a configuration, performing, on all pixel rows, Vth correction that allows a gate-source voltage of the drive transistor to be brought close to a threshold voltage of the drive transistor, and then performing writing of the signal voltage corresponding to the image signal to gates of the drive transistors in all pixel rows.

In the display unit according to the first embodiment of the present technology, the method of driving the display unit according to the first embodiment of the present technology, and the electronic apparatus according to the first embodiment of the present technology, the Vth correction that allows the gate-source voltage of the drive transistor to be brought close to the threshold voltage of the drive transistor is performed on all pixel rows, and then the writing of the signal voltage corresponding to the image signal to gates of the drive transistors in all the pixel rows is performed. Therefore, it is not necessary to divide and perform the Vth correction for each horizontal period.

A display unit according to a second embodiment of the present technology includes: a display section including a light-emitting device and a pixel circuit in each pixel in a display region; and a drive section configured to drive the pixel circuit, based on an image signal. The pixel circuit includes a drive transistor configured to drive the light-emitting device, and a write transistor configured to control application of a signal voltage corresponding to the image signal to a gate of the drive transistor. The drive section changes a pulse width of a pulse applied to a gate of the write transistor according to a first characteristic amount. As used herein, the first characteristic amount is a parameter corresponding to or relevant to an amount of decrease in a threshold voltage of the write transistor.

An electronic apparatus according to a second embodiment of the present technology includes the display unit according to the above-described second embodiment.

A method of driving a display unit according to a second embodiment of the present technology is a method of driving a display unit including a light-emitting device and a pixel circuit in each pixel in a display region. The pixel circuit includes a drive transistor configured to drive the light-emitting device, and a write transistor configured to control application of a signal voltage corresponding to an image signal to a gate of the drive transistor. The method of driving the display unit according to the second embodiment of the present technology includes: in the display unit with such a configuration, changing a pulse width of a pulse applied to a gate of the write transistor according to a first characteristic amount. As used herein, the first characteristic amount is a parameter corresponding to or relevant to an amount of decrease in a threshold voltage of the write transistor.

In the display unit according to the second embodiment of the present technology, the method of driving the display unit according to the second embodiment of the present technology, and the electronic apparatus according to the second embodiment of the present technology, the pulse width of the pulse applied to the gate of the write transistor is changed according to the first characteristic amount. Therefore, change in an ON period of the write transistor caused by a depression shift in threshold voltage characteristics of the write transistor is allowed to be reduced.

A display panel according to a third embodiment of the present technology includes: a plurality of pixels each including a plurality of sub-pixels of emission colors different from one another; a plurality of first wiring lines used to select the respective pixels; and a plurality of second wiring lines used to supply a drive current to the respective pixels. A k (k≥2) number of the plurality of first wiring lines are assigned to each one unit, the one unit including the k number of pixel rows, and each of the first wiring lines is connected to a plurality of the sub-pixels of a same emission color in the one unit. On the other hand, one of the plurality of second wiring lines is assigned to the one unit, and each of the second wiring lines is connected to all of the sub-pixels in the one unit.

A display unit according to a third embodiment of the present technology includes a display panel and a drive circuit configured to drive the display panel. The display panel included in the display unit includes the same components as those of the above-described display panel.

An electronic apparatus according to a third embodiment of the present technology includes the display unit according to the above-described third embodiment.

A method of driving a display panel according to a third embodiment of the present technology is a driving method when all of the sub-pixels in one unit are divided into groups by the first wiring lines connected thereto in the above-described display panel. This driving method includes: simultaneously performing Vth correction that allows a gate-source voltage of the drive transistor to be brought close to a threshold voltage of the drive transistor on all of the groups in the one unit, and then performing writing of the signal voltage to all of the groups in the one unit from one group to another.

In the display panel according to the third embodiment of the present technology, the display unit according to the third embodiment of the present technology, the electronic apparatus according to the third embodiment of the present technology, and the method of driving the display unit according to the third embodiment of the present technology, each of the first wiring lines used to select the respective pixels is connected to a plurality of sub-pixels of a same emission color in one unit. Moreover, each of the second wiring lines used to supply a drive current to the respective pixels is connected to all of the sub-pixels in the one unit. Therefore, for example, after the Vth correction is simultaneously performed on all of the groups in the one unit, the writing of the signal voltage is allowed to be performed on all of the groups in the one unit from one group to another. As a result, periods (so-called waiting periods) from end of the Vth correction to start of μ correction in the respective sub-pixels of a same color coincide with one another; therefore, the waiting periods of the sub-pixels of a same color in each line coincide with one another.

A method of driving a display panel according to a fourth embodiment of the present technology is a driving method in which, in the following display panel, a plurality of pixel rows are considered as one unit, and all sub-pixels in the one unit are divided into groups each including a plurality of the sub-pixels, based on emission colors as a classification criterion.

As used herein, a display panel to which the driving method is applied includes a plurality of pixels each of which includes a plurality of sub-pixels of emission colors different from one another. In the display panel, each of the sub-pixels includes a light-emitting device, a drive transistor connected in series to the light-emitting device, and a write transistor configured to write a signal voltage corresponding to an image signal to a gate of the drive transistor. Then, this driving method includes: in the display panel with such a configuration, simultaneously performing Vth correction that allows a gate-source voltage of the drive transistor to be brought close to a threshold voltage of the drive transistor on all of the groups in the one unit, and then performing writing of the signal voltage to all of the groups in the one unit from one group to another.

In the method of driving the display panel according to the fourth embodiment of the present technology, after the Vth correction is simultaneously performed on all of the groups in the one unit, the writing of the signal voltage is performed on all of the groups in the one unit from one group to another. As a result, periods (so-called waiting periods) from end of the Vth correction to start of μ correction in the respective sub-pixels of a same color coincide with one another; therefore, the waiting periods of the sub-pixels of a same color in each line coincide with one another.

In the display unit according to the first embodiment of the present technology, the driving method according to the first embodiment of the present technology, and the electronic apparatus according to the first embodiment of the present technology, it is not necessary to divide and perform the Vth correction for each horizontal period; therefore, scanning for the Vth correction is allowed to be performed at higher speed than that in a case where the Vth correction is divided for each horizontal period.

Moreover, in the display panel according to the second embodiment of the present technology, the driving method according to the second embodiment of the present technology, and the electronic apparatus according to the second embodiment of the present technology, change in the ON period of the write transistor caused by a depression shift in the threshold voltage characteristics of the write transistor is allowed to be reduced; therefore, for example, change in a period of writing of the signal voltage corresponding to the image signal or change in a period of the Vth correction that allows the gate-source voltage Vgs of the drive transistor to be brought close to the threshold voltage of the drive transistor is allowed to be reduced. Therefore, a decrease in light emission luminance caused by the depression shift is allowed to be reduced.

Further, in the display panel according to the third embodiment of the present technology, the display unit according to the third embodiment of the present technology, the electronic apparatus according to the third embodiment of the present technology, the method of driving the display panel according to the third embodiment of the present technology, and the method of driving the display panel according to the fourth embodiment of the present technology, the waiting periods of the sub-pixels of a same color in each line coincide with one another; therefore, the occurrence of luminance unevenness by performing the Vth correction collectively on a plurality of lines is allowed to be reduced.

BRIEF DESCRIPTION OF DIAGRAMS

FIG. 1 is a schematic configuration diagram of a display unit according to a first embodiment of the present technology.

FIG. 3 is a waveform diagram for describing an example of an operation of the display unit in FIG. 1.

FIG. 4 is a waveform diagram for describing an example of scanning for Vth correction and signal writing•μ correction in the display unit in FIG. 1.

FIG. 5 is a waveform diagram for describing another example of the scanning for the Vth correction and the signal writing•μ correction in the display unit in FIG. 1.

FIG. 6 is a diagram representing the scanning in FIG. 5 with light emission•light quenching.

FIG. 7 is a plan view illustrating a schematic configuration of a module including the display unit according to each above-described embodiment.

FIG. 8 is a waveform diagram for describing an example of scanning for Vth correction and signal writing•μ correction in a display unit according to a reference example.

FIG. 9 is a diagram representing the scanning in FIG. 8 with light emission•light quenching.

FIG. 10 is a schematic configuration diagram of a display unit according to a second embodiment of the present technology.

FIG. 11 is a diagram illustrating an example of a circuit configuration of a pixel in FIG. 10.

FIG. 12 is a diagram illustrating an example of a configuration of a display control circuit in FIG. 10.

FIG. 13 is a diagram illustrating an example of a table created with use of a display unit including a pixel for table creation.

FIG. 14A is a diagram describing an example of a pulse waveform applied to a gate of a write transistor.

FIG. 14B is a diagram describing an example of a state in which an ON period of the write transistor varies with a threshold voltage of the write transistor.

FIG. 15(A) is a diagram describing an example of a relationship between the threshold voltage and a lapse of time in a write transistor in FIG. 11. FIG. 15(B) is a diagram describing an example of change in a write pulse width with variation in the threshold voltage illustrated in FIG. 14A.

FIG. 16 is a diagram illustrating an example of a configuration of the pixel in the display unit used to create the table illustrated in FIG. 13.

FIG. 17 is a waveform diagram for describing an example of an operation of the display unit in FIG. 10.

FIG. 18 is a diagram illustrating an example of a configuration of a display unit according to a first modification example.

FIG. 19A is a diagram illustrating an example of a configuration of a dummy pixel in FIG. 18.

FIG. 19B is a diagram illustrating another example of the configuration of the dummy pixel in FIG. 18.

FIG. 20 is a diagram illustrating an example of a configuration of a display control circuit in a display unit according to a second modification example.

FIG. 21 is a diagram illustrating another example of the table created with use of the display unit including the pixel for table creation.

FIG. 22 is a waveform diagram for describing an example of an operation of the display unit according to the second modification example.

FIG. 23 is a diagram describing an example of a pulse waveform applied to a gate of a write transistor in the display unit according to the second modification example.

FIG. 24(A) is a diagram describing an example of a relationship between a threshold voltage and a lapse of time in the write transistor in the display unit according to the second modification example. FIG. 24(B) is a diagram describing an example of change in a Vth correction pulse width with variation in the threshold voltage illustrated in FIG. 33(A).

FIG. 25 is a plan view illustrating a schematic configuration of a module including the display unit according to each above-described embodiment.

FIG. 26A is a diagram describing an example of a pulse waveform applied to the gate of the write transistor.

FIG. 26B is a diagram describing an example of a state in which a mobility correction period varies with the threshold voltage of the write transistor.

FIG. 27 is a diagram describing an example of a relationship between a length of the mobility correction period and a value of a current flowing through an organic EL device.

FIG. 28 is a schematic configuration diagram of a display unit according to a third embodiment of the present technology.

FIG. 29 is a diagram illustrating an example of a circuit configuration of a pixel in FIG. 28.

FIG. 30 is a diagram representing an example of a layout of respective pixels in FIG. 28.

FIG. 31 is a diagram representing another example of the layout of the respective pixels in FIG. 28.

FIG. 32 is a diagram representing an example of a voltage of DTL in FIGS. 30 and 31.

FIG. 33 is a waveform diagram for describing an example of an operation of the display unit in FIG. 28.

FIG. 34 is a waveform diagram for describing an example of scanning for Vth correction and signal writing•μ correction in the display unit in FIG. 28.

FIG. 35 is a diagram illustrating an example of wiring connection in a display panel according to a comparative example.

FIG. 36 is a waveform diagram for describing an example of an operation of a display unit including the display panel in FIG. 35.

FIG. 37 is a waveform diagram for describing another example of the operation of the display unit including the display panel in FIG. 35.

FIG. 38 is a diagram illustrating a modification example of a display panel in FIG. 28.

FIG. 39 is a diagram illustrating another modification example of the display panel in FIG. 28.

FIG. 40 is a perspective view illustrating an appearance of Application Example 1 of any one of light-emitting units of respective embodiments in FIGS. 1 to 7, Application Example 1 of any one of light-emitting units of respective embodiments in FIGS. 10 to 25, or Application Example 1 of a light-emitting unit of an embodiment in FIGS. 28 to 39.

FIG. 41A is a perspective view illustrating an appearance of Application Example 2 in FIGS. 1 to 7 when viewed from a front side, an appearance of Application Example 2 in FIGS. 10 to 25 when viewed from a front side, or an appearance of Application Example 2 in FIGS. 28 to 39 when viewed from a front side.

FIG. 41B is a perspective view illustrating an appearance of Application Example 2 in FIGS. 1 to 7 when viewed from a back side, an appearance of Application Example 2 in FIGS. 10 to 25 when viewed from a back side, or an appearance of Application Example 2 in FIGS. 28 to 39 when viewed from a back side.

FIG. 42 is a perspective view illustrating an appearance of Application Example 3 in FIGS. 1 to 7, an appearance of Application Example 3 in FIGS. 10 to 25, or an appearance of Application Example 3 in FIGS. 28 to 39.

FIG. 43 is a perspective view illustrating an appearance of Application Example 4 in FIGS. 1 to 7, an appearance of Application Example 4 in FIGS. 10 to 25, or an appearance of Application Example 4 in FIGS. 28 to 39.

FIG. 44A is a diagram in a state in which Application Example 5 in FIGS. 1 to 7, Application Example 5 in FIGS. 10 to 25, or Application Example 5 in FIGS. 28 to 39 is closed.

FIG. 44 is a diagram in a state in which Application Example 5 in FIGS. 1 to 7, Application Example 5 in FIGS. 10 to 25, or Application Example 5 in FIGS. 28 to 39 is opened.

DESCRIPTION OF EMBODIMENTS

Figure 2:
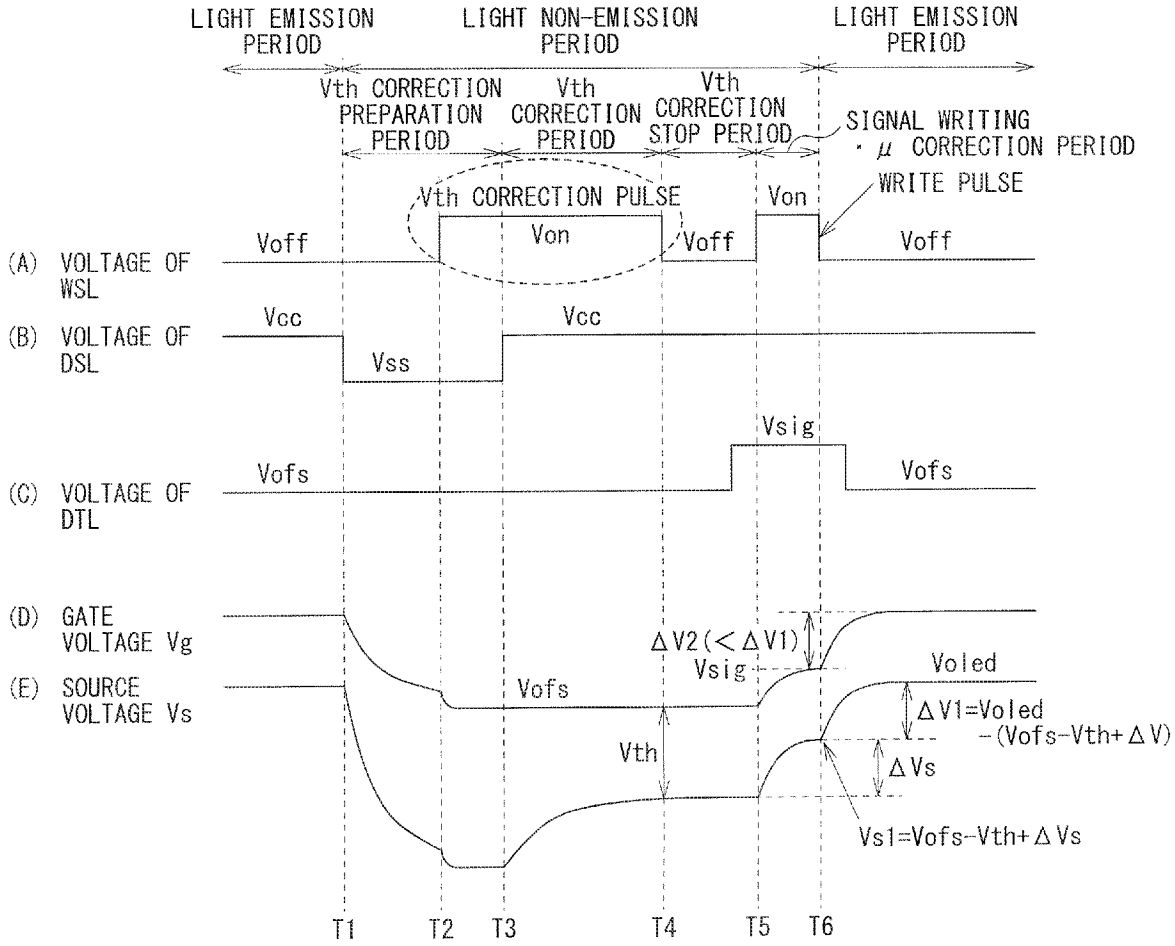
FIG. 2 is a diagram illustrating an example of a circuit configuration of a pixel in FIG. 1.

A first embodiment for embodying the present technology will be described below referring to the accompanying drawings. It is to be noted that description will be given in the following order.

1-1. Embodiment 1-2. Module and Application Examples

1-1. Embodiment

[Configuration]

FIG. 1 illustrates a schematic configuration of a display unit 1 according to a first embodiment of the present technology. This display unit 1 includes a display panel 10 and a drive circuit 20 that drives the display panel 10, based on an image signal 20A input from an external device. The drive circuit 20 includes, for example, a timing generation circuit 21, an image signal processing circuit 22, a signal line drive circuit 23, a scanning line drive circuit 24, and a power supply line drive circuit 25.

(Display Panel 10)

The display panel 10 is configured of a plurality of pixels 11 two-dimensionally arranged on an entire surface of a display region 10A of the display panel 10. The display panel 10 is configured to display an image, based on the image signal 20A input from the external device by driving respective pixels 11 in an active matrix mode by the drive circuit 20. FIG. 2 illustrates an example of a circuit configuration of the pixel 11. The pixel 11 includes, for example, a pixel circuit 12 and an organic EL device 13. The organic EL device 13 has, for example, a configuration in which an anode electrode, an organic layer, and a cathode electrode are laminated in order.

The pixel circuit 12 is configured of, for example, a drive transistor Tr1, a write transistor Tr2, and a retention capacitor Cs, and has a 2Tr1C circuit configuration. The write transistor Tr2 is configured to control application of a signal voltage corresponding to an image signal to a gate of the drive transistor Tr1. More specifically, the write transistor Tr2 is configured to sample a voltage of a signal line DTL that will be described later and write the voltage to the gate of the drive transistor Tr1. The drive transistor Tr1 is configured to drive the organic EL device 13. More specifically, the drive transistor Tr1 is configured to control a current flowing through the organic EL device 13, based on magnitude of the voltage written by the write transistor Tr2. The retention capacitor Cs is configured to keep a predetermined voltage between the gate and a source of the drive transistor Tr1. It is to be noted that the pixel circuit 12 may have a circuit configuration different from the above-described 2Tr1C circuit configuration.

Each of the drive transistor Tr1 and the write transistor Tr2 is configured of, for example, an n-channel MOS thin film transistor (TFT). It is to be noted that the kind of TFT is not specifically limited, and may be an inverted stagger configuration (a so-called bottom gate type) or a stagger configuration (a top gate type). Moreover, each of the drive transistor Tr1 and the write transistor Tr2 may be configured of a P-channel MOS TFT.

The display panel 10 includes a plurality of scanning lines WSL extending along a row direction, a plurality of signal lines DTL extending along a column direction, and a plurality of power supply lines DSL extending along the row direction. The pixel 11 is disposed near an intersection of each signal line DTL and each scanning line WSL. Each of the signal lines DTL is connected to an output end (not illustrated) of the signal line drive circuit 23 that will be described later and a source or a drain of the write transistor Tr2. Each of the scanning lines WSL is connected to an output end (not illustrated) of the scanning line drive circuit 24 that will be described later and a gate of the write transistor Tr2. Each of the power supply lines DSL is connected to an output end (not illustrated) of a power supply outputting a fixed voltage and the source or a drain of the drive transistor Tr1.

The gate of the write transistor Tr2 is connected to the scanning line WSL. The source or the drain of the write transistor Tr2 is connected to the signal line DTL, and a terminal not connected to the signal line DTL of the source and the drain of the write transistor Tr2 is connected to the gate of the drive transistor Tr1. The source or the drain of the drive transistor Tr1 is connected to the power supply line DSL, and a terminal not connected to the power supply line DSL of the source and the drain of the drive transistor Tr1 is connected to an anode of the organic EL device 13. An end of the retention capacitor Cs is connected to the gate of the drive transistor Tr1, and the other end of the retention capacitor Cs is connected to the source (a terminal located closer to the organic EL device 13 in FIG. 2) of the drive transistor Tr1. In other words, the retention capacitor Cs is inserted between the gate and the source of the drive transistor Tr1. It is to be noted that the organic EL device 13 includes a device capacitor Coled.

As illustrated in FIG. 2, the display panel 10 further includes a cathode line CTL connected to a cathode of the organic EL device 13. The cathode line CTL is configured to be electrically connected to an external circuit (not illustrated) having a reference potential (for example, a ground potential). The cathode line CTL is a sheet-shaped electrode formed over the entire display region 10A. It is to be noted that the cathode line CTL may be a strip-shaped electrode formed in a rectangular shape corresponding to a pixel row or a pixel column. The display panel 10 further includes, for example, a frame region 10B where an image is not displayed around an outer edge of the display region 10A. The frame region 10B is covered with, for example, a light-shielding member.

(Drive Circuit 20)

Next, the drive circuit 20 will be described below. As described above, the drive circuit 20 includes, for example, the timing generation circuit 21, the image signal processing circuit 22, the signal line drive circuit 23, the scanning line drive circuit 24, and the power supply line drive circuit 25. The timing generation circuit 21 is configured to control respective circuits in the drive circuit 20 to operate in conjunction with one another. The timing generation circuit 21 is configured to output, for example, a control signal 21A to the above-described respective circuits in response to (in synchronization with) a synchronization signal 20B input from an external device.

For example, the image signal processing circuit 22 is configured to perform predetermined correction on the digital image signal 20A input from the external device, and output an image signal 22A obtained by the correction to the signal line drive circuit 23. Examples of the predetermined correction include gamma correction, overdrive correction, and the like.

For example, the signal line drive circuit 23 is configured to apply an analog signal voltage corresponding to the image signal 22A input from the image signal processing circuit 22 to each of the signal lines DTL in response to (in synchronization with) input of the control signal 21A. The signal line drive circuit 23 is allowed to output, for example, two kinds of voltages (Vofs and Vsig). More specifically, the signal line drive circuit 23 is configured to supply two kinds of voltages (Vofs and Vsig) to the pixel 11 selected by the scanning line drive circuit 24 through the signal line DTL. As used herein, Vsig represents a voltage value corresponding to the image signal 20A. Vofs represents a fixed voltage unrelated to the image signal 20A. A minimum voltage of Vsig has a lower voltage value than Vofs, and a maximum voltage of Vsig has a higher voltage value than Vofs.

The scanning line drive circuit 24 is configured to sequentially select a plurality of scanning lines WSL in predetermined units in response to (in synchronization with) input of the control signal 21A. The scanning line drive circuit 24 is allowed to output, for example, two kinds of voltages (Von and Voff). More specifically, the scanning line drive circuit 24 is configured to supply two kinds of voltages (Von and Voff) to the pixel 11 targeted for driving through the scanning line WSL to perform ON/OFF control of the write transistor Tr2.

As used herein, Von is a value equal to or higher than an ON voltage of the write transistor Tr2. Von is a peak value of a write pulse output from the scanning line drive circuit 24 in "a part of a Vth correction preparation period", "a Vth correction period", "a writing•μ correction period", or the like that will be described later. Voff is a value lower than the ON voltage of the write transistor Tr2 and is a value lower than Von. Voff is a peak value of the write pulse output from the scanning line drive circuit 24 in "a part of the Vth correction preparation period", "a light emission period", or the like that will be described later.

For example, the power supply line drive circuit 25 is configured to sequentially select a plurality of power supply lines DSL in predetermined units in response to (in synchronization with) input of the control signal 21A. The power supply line drive circuit 25 is allowed to output, for example, two kinds of voltages (Vcc and Vss). More specifically, the power supply line drive circuit 25 is configured to supply two kinds of voltages (Vcc and Vss) to the pixel 11 selected by the scanning line drive circuit 24 through the power supply line DSL. As used herein, Vss is a voltage value lower than a voltage (Vel+Vcath) obtained by summing a threshold voltage Vel of the organic EL device 13 and a cathode voltage Vcath of the organic EL device 13. Vcc is a voltage value equal to or higher than the voltage (Vel+Vcath).

[Operation]

Next, an operation (an operation from light quenching to light emission) of the display unit 1 according to this embodiment will be described below. In this embodiment, even if I-V characteristics of the organic EL device 13 change with time, or even if a threshold voltage or mobility of the drive transistor Tr1 changes with time, to keep light emission luminance of the organic EL device 13 constant without being affected by them, a compensation operation for variation in the I-V characteristics of the organic EL device and a correction operation for variation in the threshold voltage or the mobility μ of the drive transistor Tr1 are adopted.

FIG. 3 illustrates an example of various waveforms in the display unit 1. FIG. 3 illustrates a state in which voltage switching between two values momentarily takes place in the scanning line WSL, the power supply line DSL, and the signal line DTL. Moreover, FIG. 3 illustrates a state in which a gate voltage Vg and a source voltage Vs of the drive transistor Tr1 momentarily change with voltage switching in the scanning line WSL, the power supply line DSL, and the signal line DTL.

(Vth Correction Preparation Period)

First, the drive circuit 20 prepares for Vth correction that allows a gate-source voltage Vgs of the drive transistor Tr1 to be brought close to a threshold voltage of the drive transistor Tr1. More specifically, when a voltage of the scanning line WSL is at Voff, a voltage of the signal line DTL is at Vofs, and a voltage of the power supply line DSL is at Vcc (i.e., when the organic EL device 13 emits light), the power supply line drive circuit 25 reduces the voltage of the power supply line DSL from Vcc to Vss in response to the control signal 21A (T1). Accordingly, the source voltage Vs is reduced to Vss, and the organic EL device 13 stops emitting light. At this time, the gate voltage Vg is also reduced by coupling through the retention capacitor Cs.

Next, while the voltage of the power supply line DSL is at Vss and the voltage of the signal line DTL is at Vofs, the scanning line drive circuit 24 increases the voltage of the scanning line WSL from Voff to Von in response to the control signal 21A (T2). Accordingly, the gate voltage Vg is reduced to Vofs. At this time, a potential difference Vgs between the gate voltage Vg and the source voltage Vs may be smaller than, equal to, or larger than the threshold voltage of the drive transistor Tr2.

(Vth Correction Period)

Next, the drive circuit 20 performs the Vth correction. More specifically, while the voltage of the signal line DTL is at Vofs and the voltage of the scanning line WSL is at Von, the power supply line drive circuit 25 increases the voltage of the power supply line DSL from Vss to Vcc in response to the control signal 21A (T3). Accordingly, the current Ids flows between the drain and the source of the drive transistor Tr1 to increase the source voltage Vs. At this time, in a case where the source voltage Vs is lower than Vofs−Vth (in a case where the Vth correction is not yet completed), the current Ids flows between the drain and the source of the drive transistor Tf1 until the drive transistor Tr1 is cut off (until the potential difference Vgs reaches Vth). Therefore, the gate voltage Vg is turned to Vofs, and the source voltage Vs is increased, and as a result, the retention capacitor Cs is charged to Vth, and the potential difference Vgs becomes Vth.

After that, before the signal line drive circuit 23 turns the voltage of the signal line DTL from Vofs to Vsig in response to the control signal 21A, the scanning line drive circuit 24 reduces the voltage of the scanning line WSL from Von to Voff in response to the control signal 21A (T4). Accordingly, the gate of the drive transistor Tr1 is turned to a floating state; therefore, the potential difference Vgs is allowed to remain at Vth irrespective of magnitude of the voltage of the signal line DTL. Thus, even in a case where the threshold voltage Vth of the drive transistor Tr1 varies for each pixel circuit 12, variation in light emission luminance of the organic EL device 13 is allowed to be eliminated by setting the potential difference Vgs to Vth.

(Vth Correction Stop Period)

After that, in a Vth correction stop period, the signal line drive circuit 23 turns the voltage of the signal line DTL from Vofs to Vsig.

(Signal Writing•μ Correction Period)

After the Vth correction stop period ends (i.e., after the Vth correction is completed), the drive circuit 20 performs writing of a signal voltage corresponding to the image signal 20A and μ correction. More specifically, while the voltage of the signal line DTL is at Vsig, and the voltage of the power supply line DSL is at Vcc, the scanning line drive circuit 24 increases the voltage of the scanning line WSL from Voff to Von in response to the control signal 21A (T5) to connect the gate of the drive transistor Tr1 to the signal line DTL. Accordingly, the gate voltage Vg of the drive transistor Tr1 becomes the voltage Vsig of the signal line DTL. At this time, an anode voltage of the organic EL device 13 is still smaller than the threshold voltage Vel of the organic EL device 13 at this stage, and the organic EL device 13 is cut off. Therefore, since the current Ids flows to the device capacitor Coled of the organic EL device 13 to charge the device capacitor Coled, the source voltage Vs is increased by ΔVs, and the potential difference Vgs reaches Vsig+Vth−ΔVs in the end. Thus, the μ correction is performed simultaneously with the writing. In this case, the larger the mobility μ of the drive transistor Tr1 is, the more ΔVs is increased; therefore, when the potential difference Vgs is reduced by ΔV before light emission, variation in mobility μ for each pixel 11 is allowed to be eliminated.

(Light Emission)

Finally, the scanning line drive circuit 24 reduces the voltage of the scanning line WSL from Von to Voff in response to the control signal 21A (T6). Accordingly, the gate of the drive transistor Tr1 is turned to a floating state, and the current Ids flows between the drain and source of the drive transistor Tr1 to increase the source voltage Vs. As a result, a voltage equal to or higher than the threshold voltage Vel is applied to the organic EL device 13, and the organic EL device 13 emits light with desired luminance.

Next, an example of scanning for the Vth correction and the signal writing•μ correction in the display unit 1 according to this embodiment will be described below referring to FIGS. 4 and 5. It is to be noted that FIG. 4 illustrates an example of scanning for the Vth correction and the signal writing•μ correction on given three successive pixel rows (an nth pixel row, an n+1th row, and an n+2th pixel row). FIG. 5 illustrates an example of scanning for the Vth correction and the signal writing•μ correction on a first pixel row, an N−1th pixel row (where N is the lowest row number), and an Nth pixel.

The drive circuit 20 sequentially performs the Vth correction from one pixel row to another and performs the Vth correction on all pixel rows, and then the drive circuit 20 sequentially performs writing of the signal voltage (Vsig) corresponding to the image signal 20A (simultaneously with the μ correction) from one pixel row to another, and performs the writing to the gates of the drive transistors Tr2 of all pixel rows. At this time, the drive circuit 20 performs scanning for the Vth correction at intervals (in FIGS. 4 and 5, (½)H) shorter than one horizontal period (1H). Moreover, the drive circuit 20 performs the Vth correction on each pixel row throughout a period (in FIGS. 4 and 5, about 2H) longer than one horizontal period. In other words, the drive circuit 20 does not divide and perform the Vth correction for each one horizontal period.

Moreover, the drive circuit 20 continuously outputs a fixed voltage (Vofs) unrelated to the image signal 20A to the signal line DTL in a period in which the Vth correction is performed, and continuously outputs the signal voltage (Vsig) to the signal line DTL in a period in which the writing of the signal voltage corresponding to the image signal 20A (simultaneously with the μ correction) is performed. In other words, the drive circuit 20 does not apply the voltage Vofs and the voltage Vsig alternately to the signal line DTL in one horizontal period, and continuously outputs only one voltage of the voltage Vofs and the voltage Vsig to the signal line DTL in one horizontal period.

It is to be noted that as illustrated in FIGS. 5(A), (B), (E), (F), and (G), the drive circuit 20 may perform the writing of the signal voltage (simultaneously with the μ correction) to a first pixel row that is the highest row in a (½)H period following the completion of the Vth correction on the Nth pixel row that is the lowest row. Moreover, although not illustrated, the drive circuit 20 may perform the writing of the signal voltage (simultaneously with the μ correction) to the first pixel row that is the highest row in an arbitrary (½)H period after the completion of the Vth correction on the Nth pixel row that is the lowest row.

FIG. 6 represents scanning in FIG. 5 with light emission•light quenching. It is to be noted that "black insertion" in FIG. 6 represents a period from after execution of the Vth correction to before start of the signal writing•μ correction. In a case where the drive circuit 20 performs the Vth correction on all pixel rows, and then performs the writing of the signal voltage (Vsig) (simultaneously with the μ correction) to the gates of the drive transistors Tr1 of all pixel rows, a light emission period and a light quenching period are as illustrated in FIG. 6. In other words, the drive circuit 20 performs the Vth correction and the signal writing•μ correction so as to keep a period in which the pixels 11 (or the organic EL devices 13) emit light in an nth frame and a period in which the pixels 11 (or the organic EL devices 13) emit light in an n+1th frame from overlapping. Accordingly, a period in which black is displayed on the entire display region 10A is present. Therefore, for example, in 3D display with use of shutter glasses, the occurrence of crosstalk is allowed to be eliminated by performing the Vth correction and the signal writing•μ correction by the drive circuit 20 so as to have the period in which black is displayed on the entire display region 10A.

In the display unit 1 according to this embodiment, as described above, when ON/OFF of the pixel circuit 12 is controlled in each pixel 11, and a drive current is injected into the organic EL device 13 of each pixel 11, holes and electrons are recombined to cause light emission. As a result, an image is displayed on the display region 10A.

[Effects]

Next, effects of the display unit 1 according to this embodiment will be described below.

FIG. 8 illustrates an example of a drive timing according to a reference example. FIG. 9 represents scanning in FIG. 8 with light emission•light quenching. Typically, scanning for the Vth correction and scanning for the μ correction are performed simultaneously. Therefore, the Vth correction is not allowed to be performed successively over a plurality of horizontal periods, and, for example, as illustrated in FIG. 8, it is necessary to divide and perform the Vth correction for each horizontal period. Therefore, it is difficult to perform scanning for the Vth correction at high speed. Moreover, since the Vth correction is divided for each horizontal period, a Vth correction period and a signal writing•μ correction period are mixed in one horizontal period. As a result, as illustrated in FIG. 8(G), the voltage Vofs used for the Vth correction and the voltage Vsig used for the signal writing•μ correction are alternately applied to the signal line DTL in one horizontal period. Therefore, power consumption is increased. Moreover, as illustrated in FIG. 9, light emission in the n+1th frame starts before light emission in the nth frame ends; therefore, crosstalk occurs in 3D display.

On the other hand, in this embodiment, after the Vth correction is performed on all pixel rows, the signal wiring•μ correction is performed on the gates of the drive transistors Tr1 of the all pixel rows. Therefore, since it is not necessary to divide and perform the Vth correction for each horizontal period, scanning for the Vth correction is allowed to be performed at higher speed than that in a case where the Vth correction is divided for each horizontal period. At this time, in particular, in a case where the Vth correction on each pixel row is performed throughout a longer period than one horizontal period, scanning for the Vth correction is allowed to be performed at higher speed while the Vth correction is reliably completed.

Moreover, since it is not necessary to divide and perform the Vth correction for each horizontal period, one of the Vth correction and the signal writing•μ correction may be performed in one horizontal period. Therefore, it is only necessary to continuously output one voltage of the voltage Vofs and the voltage Vsig to the signal line DTL in one horizontal period; therefore, lower power consumption is achievable. Further, the Vth correction and the signal writing•μ correction are allowed to be performed so as to keep the period in which the pixels 11 (or the organic EL devices 13) emit light in the nth frame and the period in which the pixels 11 (or the organic EL devices 13) emit light in the n+1th frame from overlapping; therefore, in such a case, the occurrence of crosstalk in 3D display is preventable.

1-2. Module and Application Examples

Application examples of the display unit 1 described in the above-described embodiment will be described below. The display unit 1 according to the above-described embodiment is applicable to display units of electronic apparatuses, in any fields, displaying an image signal supplied from an external device or an image signal produced inside as an image or a picture, such as televisions, digital cameras, notebook personal computers, portable terminal devices such as cellular phones, and video cameras.

(Module)

The display unit 1 according to the above-described embodiment is incorporated into various electronic apparatuses such as Application Examples 1 to 5 that will be described later as a module as illustrated in FIG. 7. In this module, for example, a region 210 exposed from a member (not illustrated) sealing the display section 10 is provided on a side of a substrate 2, and an external connection terminal (not illustrated) is formed in the exposed region 210 by extending wiring of the timing control circuit 21, the image signal processing circuit 22, the signal line drive circuit 23, the scanning line drive circuit 24, and the power supply line drive circuit 25. In the external connection terminal, a flexible printed circuit (FPC) 220 for signal input and output may be provided.

Application Example 1

FIG. 40 illustrates an appearance of a television to which the display unit 1 according to the above-described embodiment is applied. The television includes, for example, an image display screen section 300 including a front panel 310 and a filter glass 320, and the image display screen section 300 is configured of the display unit 1 according to the above-described embodiment.

Application Example 2

FIGS. 41A and 41B illustrate an appearance of a digital camera to which the display unit 1 according to the above-described embodiment is applied. The digital camera includes, for example, a light-emitting section 410 for a flash, a display section 420, a menu switch 430, and a shutter button 440, and the display section 420 is configured of the display unit 1 according to the above-described embodiment.

Application Example 3

FIG. 42 illustrates an appearance of a notebook personal computer to which the display unit 1 according to the above-described embodiment is applied. The notebook personal computer includes, for example, a main body 510, a keyboard 520 for operation of inputting characters and the like, and a display section 530 for displaying of an image, and the display section 530 is configured of the display unit 1 according to the above-described embodiment.

Application Example 4

FIG. 43 illustrates an appearance of a video camera to which the display unit 1 according to the above-described embodiment is applied. The video camera includes, for example, a main section 610, a lens 620 provided on a front surface of the main section 610 and for shooting an image of an object, a shooting start/stop switch 630, and a display section 640, and the display section 640 is configured of the display unit 1 according to the above-described embodiment.

Application Example 5

FIG. 44 illustrates an appearance of a cellular phone to which the display unit 1 according to the above-described embodiment is applied. The cellular phone is formed by connecting, for example, a top-side enclosure 710 and a bottom-side enclosure 720 to each other by a connection section (hinge section) 730, and the cellular phone includes a display 740, a sub-display 750, a picture light 760, and a camera 770. The display 740 or the sub-display 750 is configured of the display unit 1 according to the above-described embodiment.

Although the present technology is described referring to the embodiment and the application examples, the present technology is not limited thereto, and may be variously modified.

In the above-described embodiment and the like, the configuration of the pixel circuit 12 for active matrix drive is not limited to that described in the above-described embodiment, and a capacitor element or a transistor may be added as necessary. In this case, a necessary drive circuit may be included in addition to the above-described signal line drive circuit 23, the above-described scanning line drive circuit 24, the above-described power supply line drive circuit 25, and the like according to a modification of the pixel circuit 12.

Moreover, the present technology may have the following configurations.

(1) A display unit including:

a display section including a light-emitting device and a pixel circuit in each pixel; and a drive section configured to drive the pixel circuit, based on an image signal, in which the pixel circuit includes a drive transistor configured to drive the light-emitting device, and a write transistor configured to control application of a signal voltage corresponding to the image signal to a gate of the drive transistor, and the drive section performs, on all pixel rows, Vth correction that allows a gate-source voltage of the drive transistor to be brought close to a threshold voltage of the drive transistor, and then performs writing of the signal voltage corresponding to the image signal to gates of the drive transistors in all pixel rows.

(2) The display unit according to (1), in which the drive section performs scanning for the Vth correction at shorter intervals than one horizontal period.

(3) The display unit according to (1) or (2), in which the drive section performs the Vth correction on each pixel row throughout a longer period than one horizontal period.

(4) The display unit according to any one of (1) to (3), in which the display section includes a signal line connected to the gate of the drive transistor, and the drive section continuously outputs a fixed voltage unrelated to the image signal to the signal line in a period in which the Vth correction is performed, and continuously outputs the signal voltage to the signal line in a period in which the writing is performed.

(5) The display unit according to any one of (1) to (4), in which the drive section performs the correction and the writing to keep a period in which the light-emitting device emits light in an nth frame and a period in which the light-emitting device emits light in an n+1th frame from overlapping.

(6) An electronic apparatus provided with a display unit, the display unit including:

a display section including a light-emitting device and a pixel circuit in each pixel; and a drive section configured to drive the pixel circuit, based on an image signal, in which the pixel circuit includes a drive transistor configured to drive the light-emitting device, and a write transistor configured to control application of a signal voltage corresponding to the image signal to a gate of the drive transistor, and the drive section performs, on all pixel rows, Vth correction that allows a gate-source voltage of the drive transistor to be brought close to a threshold voltage of the drive transistor, and then performs writing of the signal voltage corresponding to the image signal to gates of the drive transistors in all pixel rows.

(7) A method of driving a display unit, the method including:

in the display unit including a light-emitting device and a pixel circuit in each pixel, the pixel circuit including a drive transistor configured to drive the light-emitting device and a write transistor configured to control application of a signal voltage corresponding to an image signal to a gate of the drive transistor, performing, on all pixel rows, Vth correction that allows a gate-source voltage of the drive transistor to be brought close to a threshold voltage of the drive transistor, and then performing writing of the signal voltage corresponding to the image signal to gates of the drive transistors in all pixel rows.

A second embodiment for embodying the present technology will be described in detail below referring to the accompanying drawings. It is to be noted that description will be given in the following order.

2-1. Embodiment 2-2. Modification Examples 2-3. Module and Application Examples

2-1. Embodiment

[Configuration]

FIG. 10 illustrates a schematic configuration of a display unit 1 according to the second embodiment of the present technology. This display unit 1 includes a display panel 10 and a drive circuit 20 that drives the display panel 10, based on an image signal 20A input from an external device. The drive circuit 20 includes, for example, a display control circuit 121, a signal line drive circuit 122, a write line drive circuit 123, a power supply line drive circuit 124, and a measurement circuit 125.

(Display Panel 10)

The display panel 10 is configured of a plurality of pixels 11 two-dimensionally arranged on an entire surface of a display region 10A of the display panel 10. The display panel 10 displays an image, based on the image signal 20A input from the external device by driving respective pixels 11 in an active matrix mode by the drive circuit 20. As used herein, the image signal 20A is, for example, a digital signal of an image that is to be displayed on the display panel 10 for each field, and includes digital signals for respective pixels 11. Moreover, the pixel 11 corresponds to a point that is a smallest unit configuring a screen on the display panel 10. In a case where the display panel 10 is a color display panel, the pixel 11 corresponds to, for example, a sub-pixel emitting light of a single color such as red, green, blue, or the like, and in a case where the display panel 10 is a monochrome display panel, the pixel 11 corresponds to a pixel emitting single-color light (white light). FIG. 11 illustrates an example of a circuit configuration of the pixel 11. The pixel 11 includes, for example, a pixel circuit 12 and an organic EL device 13. The organic EL device 13 has, for example, a configuration in which an anode electrode, an organic layer, and a cathode electrode are laminated in order.

The pixel circuit 12 is configured of, for example, a drive transistor Tr1, a write transistor Tr2, and a retention capacitor Cs, and has a 2Tr1C circuit configuration. The write transistor Tr2 is configured to control application of a signal voltage corresponding to an image signal to a gate of the drive transistor Tr1. More specifically, the write transistor Tr2 is configured to sample a voltage of a signal line DTL that will be described later and write the voltage to a gate of the drive transistor Tr1. The drive transistor Tr1 is configured to drive the organic EL device 13. More specifically, the drive transistor Tr1 is configured to control a current flowing through the organic EL device 13, based on magnitude of the voltage written by the write transistor Tr2. The retention capacitor Cs is configured to keep a predetermined voltage between the gate and a source of the drive transistor Tr1. It is to be noted that the pixel circuit 12 may have a circuit configuration different from the above-described 2Tr1C circuit configuration.

Each of the drive transistor Tr1 and the write transistor Tr2 is configured of, for example, an n-channel MOS thin film transistor (TFT). It is to be noted that the kind of TFT is not specifically limited, and may be an inverted stagger configuration (a so-called bottom gate type) or a stagger configuration (a top gate type). Moreover, each of the drive transistor Tr1 and the write transistor Tr2 may be configured of a P-channel MOS TFT.

The display panel 10 includes a plurality of write lines WSL extending along a row direction, a plurality of signal lines DTL extending along a column direction, and a plurality of power supply lines DSL extending along the row direction. The pixel 11 is disposed near an intersection of each signal line DTL and each write line WSL. Each of the signal line DTL is connected to an output end (not illustrated) of the signal line drive circuit 122 that will be described later and a source or a drain of the write transistor Tr2. Each of the write lines WSL is connected to an output end (not illustrated) of the write line drive circuit 123 that will be described later and a gate of the write transistor Tr2. Each of the power supply lines DSL is connected to an output end (not illustrated) of the power supply line drive circuit 124 and the source or a drain of the drive transistor Tr1.

The gate of the write transistor Tr2 is connected to the write line WSL. The source or the drain of the write transistor Tr2 is connected to the signal line DTL, and a terminal not connected to the signal line DTL of the source and the drain of the write transistor Tr2 is connected to the gate of the drive transistor Tr1. The source or the drain of the drive transistor Tr1 is connected to the power supply line DSL, and a terminal not connected to the power supply line DSL of the source and the drain of the drive transistor Tr1 is connected to an anode of the organic EL device 13. An end of the retention capacitor Cs is connected to the gate of the drive transistor Tr1, and the other end of the retention capacitor Cs is connected to the source (a terminal located closer to the organic EL device 13 in FIG. 11) of the drive transistor Tr1. In other words, the retention capacitor Cs is inserted between the gate and the source of the drive transistor Tr1. It is to be noted that the organic EL device 13 includes a device capacitor Coled.

As illustrated in FIG. 11, the display panel 10 further includes a cathode line CTL connected to a cathode of the organic EL device 13. The cathode line CTL is connected to an input end of the measurement circuit 125 and the cathode of the organic EL device 13. The cathode line CTL may be configured of, for example, a strip-shaped electrode formed in a rectangular shape corresponding to a pixel row or a pixel column. The display panel 10 further includes, for example, a frame region 10B where an image is not displayed around an outer edge of the display region 10A. The frame region 10B is covered with, for example, a light-shielding member.

(Drive Circuit 20)

Next, the drive circuit 20 will be described below. As described above, the drive circuit 20 includes, for example, the display control circuit 121, the signal line drive circuit 122, the write line drive circuit 123, the power supply line drive circuit 124, and the measurement circuit 125. For example, as illustrated in FIG. 12, the display control circuit 121 includes a conversion circuit 31, a controller 32, and a memory 33.

The memory 33 holds, for example, a table 33A as illustrated in FIG. 13. The table 33A is a table relating a current value to a write pulse width or a characteristic amount (a second characteristic amount) corresponding to or relevant to the write pulse width. It is to be noted that the write pulse represents a pulse applied to the gate of the write transistor Tr2 when writing of the signal voltage corresponding to the image signal 20A is performed. Examples of the characteristic amount corresponding to or relevant to the write pulse width include an ON period of the write transistor Tr2. In this case, the current value in the table 33A is compared to a detection signal 125A input from the measurement circuit 125.

Moreover, the write pulse width in the table 33A represents a width of a write pulse illustrated in a portion enclosed by a broken line in FIG. 17, and more specifically, as illustrated in FIG. 14A, the write pulse width corresponds to a period from a start point of a rising edge of a pulse to an end point of a falling edge of the pulse. It is to be noted that FIG. 14A exemplifies a case where the write pulse width has an initial value (Pw0). It is to be noted that, although not illustrated, the write pulse width may correspond to, for example, a period from the start point of the rising edge of the pulse to a start point of the falling edge of the pulse. Moreover, the ON period of the write transistor Tr2 indicates a period in which a signal voltage Vsig is written to the gate of the drive transistor Tr1 when the write pulse illustrated in the portion enclosed by the broken line in FIG. 17 is applied to the write transistor Tr2. More specifically, as illustrated in FIG. 14A, the ON period of the write transistor Tr2 corresponds to a period (ΔT1) from a point at which a peak value becomes equal to the threshold voltage of the write transistor Tr2 at the rising edge of the write pulse to a point at which the peak value becomes equal to the threshold voltage of the write transistor Tr2 at the falling edge of the write pulse. It is to be noted that FIG. 14A exemplifies a case where the threshold voltage of the write transistor Tr2 has an initial value (Vth0). Moreover, in FIG. 14A, the ON period of the write transistor Tr2 when the threshold voltage of the write transistor Tr2 is at the initial value (Vth0) is represented by ΔT1. It is to be noted that the write pulse width is written to the table 33A, and the write pulse width in the table 33A is read from the table 33A in the memory 33 by the controller 32.

The controller 32 is configured to generate, for example, control signals 32A, 21B, 21C, and 21D that control operation timings of the conversion circuit 31, the signal line drive circuit 122, the write line drive circuit 123, and the power supply line drive circuit 124 from the synchronization signal 20B supplied from the external device. Examples of the synchronization signal 20B include a vertical synchronization signal, a horizontal synchronization signal, and a dot clock signal. Moreover, the controller 32 is configured to control (change) the pulse width of the write pulse applied to the gate of the write transistor Tr2 with use of a detection signal 125A input from the measurement circuit 125 and the table 33A in the memory 33. The controller 32 is configured to contain a control signal relating to the pulse width of the write pulse in the control signal 21C, and output the control signal 21C to the write line drive circuit 123.

Specifically, the controller 32 is configured to set the pulse width of the write pulse with use of the detection signal 125A and the table 33A. More specifically, the controller 32 sets to the pulse width of the write pulse with use of the detection signal 125A and the table 33A so as to allow the ON period of the write transistor Tr2 corresponding to the write pulse to be consistently constant (for example, ΔT1) irrespective of the threshold voltage of the write transistor Tr2. It is to be noted that it is not necessary for the pulse width of an actual write pulse to be consistently perfectly same. For example, as a result of setting the pulse width of the write pulse so as to allow the ON period of the write transistor Tr2 corresponding to the write pulse to be consistently constant (for example, ΔT1) irrespective of the threshold voltage of the write transistor Tr2, the pulse width of the actual write pulse may have an error to some extent.

Incidentally, the write pulse does not have a perfect square wave, but has rounding as illustrated in FIG. 14A. Therefore, in actuality, as illustrated in FIG. 14B, the ON period of the write transistor Tr2 may vary with the threshold voltage of the write transistor Tr2. When the ON period of the write transistor Tr2 varies, magnitude of a current Ids flowing through the organic EL device 13 when the organic EL device 13 emits light changes, and light emission luminance also changes accordingly. Therefore, the ON period of the write transistor Tr2 preferably varies as little as possible.

The threshold voltage of the write transistor Tr2 changes (decreases), for example, by continuously applying a negative bias to the gate-source voltage of the write transistor Tr2. In other words, threshold voltage characteristics of the write transistor Tr2 are shifted from enhancement to depression. As used herein, the negative bias refers to a bias state in which a gate potential is negative with respect to a source potential. Enhancement refers to a state in which a channel is formed when the write pulse is applied to a gate, and a current flows between a source and a drain. Moreover, depression refers to a state in which a current flows between the source and the drain without application of the write pulse to the gate.

Typically, the negative bias is applied to the write transistor Tr2 in a light emission period or a light quenching period of the organic EL device 13. When the negative bias is continuously applied to the gate-source voltage of the write transistor Tr2, i.e., with the passage of a drive period of the write transistor Tr2, a depression shift occurs in the threshold voltage characteristics of the write transistor Tr2, and, for example, as illustrated in FIG. 15(A), the threshold voltage is gradually decreased. Accordingly, in a case where the write pulse width is consistently constant, the length of the ON period of the write transistor Tr2 is gradually increased, and the current Ids flowing through the organic EL device 13 when the organic EL device 13 emits light is gradually decreased; therefore, light emission luminance is also gradually decreased.

On the other hand, in this embodiment, as described above, the controller 32 sets the pulse width of the write pulse so as to allow the ON period of the write transistor Tr2 corresponding to the write pulse to be consistently constant irrespective of the threshold voltage of the write transistor Tr2. For example, as illustrated in FIGS. 14A, 14B, and FIGS. 15(A) and (B), the controller 32 gradually reduces the pulse width of the write pulse with a decrease in the threshold voltage of the write transistor Tr2 so as to allow the ON period of the write transistor Tr2 to be consistently constant. The above-described table 33A allows such adjustment of the pulse width.

However, the threshold voltage of the write transistor Tr2 is not written to the table 33A. It is because variation in the threshold voltage of the write transistor Tr2 is not easily measured. In this embodiment, the drive circuit 20 measures the characteristic amount corresponding to or relevant to the threshold voltage instead of measurement of the threshold voltage. As a device that measures such a characteristic amount, the drive circuit 20 includes the measurement circuit 125.

The conversion circuit 31 includes, for example, a frame memory, a write circuit, a read circuit, and a decoder. The frame memory is a memory for image display having at least a larger storage capacity than the resolution of the display region 10A, and is allowed to hold row addresses, column addresses, and gray-scale data of respective pixels 11 associated with the row addresses and the column addresses. The write circuit is configured to generate a write address of the image signal 20A with use of the synchronization signal 20B, and output the write address of the image signal 20A to the frame memory in synchronization with the synchronization signal 20B. The write address includes, for example, a row address and a column address. The read circuit is configured to generate a read address and output the read address to the frame memory in response to the control signal 32A. The decoder is configured to output gray-scale data output from the frame memory as signal data 21A.

The signal line drive circuit 122 is configured to apply an analog signal voltage corresponding to the signal data 21A input from the conversion circuit 31 to each signal line DTL in response to input of the control signal 21B. The signal line drive circuit 122 is allowed to output, for example, two kinds of voltages (Vofs and Vsig). More specifically, the signal line drive circuit 122 is configured to supply two kinds of voltages (Vofs and Vsig) to the pixel 11 selected by the write line drive circuit 123 through the signal line DTL. As used herein, Vsig represents a voltage value corresponding to the image signal 20A. Vofs represents a fixed voltage unrelated to the image signal 20A. A minimum voltage of Vsig has a lower voltage value than Vofs, and a maximum voltage of Vsig has a higher voltage value than Vofs.

The write line drive circuit 123 is configured to output a scanning pulse for selecting of respective pixels 11 in predetermined units (for example, in row units), based on address data specified by the control signal 21C. The write line drive circuit 123 is configured to sequentially select a plurality of write lines WSL in predetermined units (for example, in row units) in response to, for example, input of the control signal 21C. The write line drive circuit 123 is allowed to output, for example, two kinds of voltages (Von and Voff). More specifically, the write line drive circuit 123 is configured to supply two kinds of voltages (Von and Voff) to the pixels 11 targeted for driving through the write line WSL to perform ON/OFF control of the write transistor Tr2.

Moreover, the write line drive circuit 123 is allowed to change the pulse width of a pulse applied to the pixel 11 targeted for driving in response to input of the control signal 21C. More specifically, the write line drive circuit 123 is configured to change, according to a predetermined characteristic amount (a first characteristic amount) in response to input of the control signal 21C, the pulse width of the pulse applied to the gate of the write transistor when writing of the signal voltage corresponding to the image signal 20A is performed. As used herein, the first characteristic amount is an amount corresponding to or relevant to an amount of decrease in the threshold voltage of the write transistor Tr2. More specifically, the write line drive circuit 123 is configured to change the pulse width of the write pulse according to the first characteristic amount in response to input of the control signal 21C. The write line drive circuit 123 is configured to reduce, by change in the pulse width, change in the ON period of the write transistor Tr2 caused by a depression shift in the threshold voltage characteristics of the write transistor Tr2. More specifically, the write line drive circuit 123 is configured to reduce, by change in the write pulse width, change in the ON period of the write transistor Tr2 caused by the depression shift in the threshold voltage characteristics of the write transistor Tr2.

As used herein, Von is a value equal to or higher than an ON voltage of the write transistor Tr2. Von is a peak value of a write pulse output from the write line drive circuit 123 in "a Vth correction period", "a writing•μ correction period", or the like that will be described later. Voff is a value lower than the ON voltage of the write transistor Tr2 and is a value lower than Von.

For example, the power supply line drive circuit 124 is configured to sequentially select a plurality of power supply lines DSL in predetermined units (for example, in row units) in response to input of the control signal 21A. The power supply line drive circuit 124 is allowed to output, for example, two kinds of voltages (Vcc and Vss). More specifically, the power supply line drive circuit 124 is configured to supply two kinds of voltages (Vcc and Vss) to the pixel 11 selected by the write line drive circuit 123 through the power supply line DSL. As used herein, Vss is a voltage value lower than a voltage (Vel+Vcath) obtained by summing a threshold voltage Vel of the organic EL device 13 and a cathode voltage Vcath of the organic EL device 13. Vcc is a voltage value equal to or higher than the voltage (Vel+Vcath).

The measurement circuit 125 is configured to measure a current flowing through the organic EL device 13. For example, as illustrated in FIG. 11, the measurement circuit 125 includes an ammeter, and is configured to output a current value measured by the ammeter as the first characteristic amount. At this time, the detection signal 125A as the first characteristic amount is the current value measured by the ammeter. It is to be noted that the measurement circuit 125 may measure a physical quantity corresponding to the current flowing through the organic EL device 13. For example, the measurement circuit 125 may include a voltmeter, and may be configured to output a voltage value measured by the voltmeter as the first characteristic amount. At this time, the detection signal 125A as the first characteristic amount is the voltage value measured by the voltmeter. It is to be noted that the measurement circuit 125 may output, as the first characteristic amount, a value obtained by performing a predetermined arithmetic operation on a measurement value measured by the ammeter or the voltmeter. At this time, the detection signal 125A as the first characteristics amount is the value obtained by performing the predetermined arithmetic operation on the measurement value measured by the ammeter or the voltmeter.

[Table Creation]

Next, a method of creating the table 33A in this embodiment will be described below. FIG. 16 illustrates an example of circuit configurations of two kinds of pixels included in a display unit (a master) for creation of the table 33A. A pixel 111 illustrated in FIG. 16 has the same configuration as that of the pixel 11 in the display unit 1.

In this display unit (master), for example, while a write pulse with a fixed pulse width is continuously applied to the above-described pixel 111, the detection signal 125A output from the measurement circuit 125 is monitored. Therefore, a state in which the value of the detection signal 125A is gradually decreased is allowed to be measured. At this time, for example, a pulse width of a write pulse at which the value of the detection signal 125A coincides with an initial value is searched on the pixel 111 at predetermined intervals. For example, the pulse width of the write pulse applied to the pixel 111 is swung to search the pulse width of the write pulse at which the value of the detection signal 125A obtained at this time coincides with (or substantially coincides with) a value of the detection signal 125A obtained at about the time driving of the above-described pixel 111 starts in the display unit for creation of the table 33A (i.e., in an initial stage). Then, the pulse width found by searching is recorded in relation to the value of the detection signal 125A, and this is executed every time the pulse width is searched. Thus, the table 33A is completed. Then, the completed table 33A is stored in the memory 33 by an operator.

[Operation]

Next, an operation (an operation from light quenching to light emission) of the display unit 1 according to this embodiment will be described below. In this embodiment, even if I-V characteristics of the organic EL device 13 change with time, or even if the threshold voltage or mobility of the drive transistor Tr1 changes with time, to keep light emission luminance of the organic EL device constant without being affected by them, a compensation operation for variation in the I-V characteristics of the organic EL device and a correction operation for variation in the threshold voltage or the mobility μ of the drive transistor Tr1 are adopted.

FIG. 17 illustrates an example of various waveforms in the display unit 1. FIG. 17 illustrates a state in which voltage switching between two values momentarily takes place in the write line WSL, the power supply line DSL, and the signal line DTL. Moreover, FIG. 17 illustrates a state in which a gate voltage Vg and a source voltage Vs of the drive transistor Tr1 momentarily change with voltage switching in the write line WSL, the power supply line DSL, and the signal line DTL.

(Vth Correction Preparation Period)

First, preparation for Vth correction is performed. It is to be noted that the Vth correction represents correction that allows a gate-source voltage Vgs of the drive transistor Tr1 to be brought close to the threshold voltage of the drive transistor Tr1. More specifically, when a voltage of the write line WSL is at Voff, a voltage of the signal line DTL is at Vofs, and a voltage of the power supply line DSL is at Vcc (i.e., when the organic EL device 13 emits light), the power supply line drive circuit 124 reduces the voltage of the power supply line DSL from Vcc to Vss in response to the control signal 21D (T1). Accordingly, the source voltage Vs is reduced to Vss, and the organic EL device 13 stops emitting light. At this time, the gate voltage Vg is reduced by coupling through the retention capacitor Cs.

Next, while the voltage of the power supply line DSL is at Vss and the voltage of the signal line DTL is at Vofs, the write line drive circuit 123 increases the voltage of the write line WSL from Voff to Von in response to the control signal 21C (T2). Accordingly, the gate voltage Vg is reduced to Vofs. At this time, a potential difference Vgs between the gate voltage Vg and the source voltage Vs may be smaller than, equal to, or larger than the threshold voltage of the drive transistor Tr2.

(Vth Correction Period)

Next, the Vth correction is performed. More specifically, while the voltage of the signal line DTL is at Vofs and the voltage of the write line WSL is at Von, the power supply line drive circuit 124 increases the voltage of the power supply line DSL from Vss to Vcc in response to the control signal 21D (T3). Accordingly, the current Ids flows between the drain and the source of the drive transistor Tr1 to increase the source voltage Vs. At this time, in a case where the source voltage Vs is lower than Vofs-Vth (in a case where the Vth correction is not yet completed), the current Ids flows between the drain and the source of the drive transistor Tr1 until the drive transistor Tr1 is cut off (until the potential difference Vgs reaches Vth). Therefore, the gate voltage Vg is turned to Vofs, and the source voltage Vs is increased, and as a result, the retention capacitor Cs is charged to Vth, and the potential difference Vgs becomes Vth.

After that, before the signal line drive circuit 122 turns the voltage of the signal line DTL from Vofs to Vsig in response to the control signal 21B, the write line drive circuit 123 reduces the voltage of the write line WSL from Von to Voff in response to the control signal 21A (T4). Accordingly, the gate of the drive transistor Tr1 is turned to a floating state; therefore, the potential difference Vgs is allowed to remain at Vth irrespective of magnitude of the voltage of the signal line DTL. Thus, even in a case where the threshold voltage Vth of the drive transistor Tr1 varies for each pixel circuit 12, variation in light emission luminance of the organic EL device 13 is allowed to be eliminated by setting the potential difference Vgs to Vth.

(Vth Correction Stop Period)

After that, in the Vth correction stop period, the signal line drive circuit 122 turns the voltage of the signal line DTL from Vofs to Vsig.

(Signal Writing•μ Correction Period)

After the Vth correction stop period ends, signal wiring and μ correction are performed. More specifically, while the voltage of the signal line DTL is at Vsig, and the voltage of the power supply line DSL is at Vcc, the write line drive circuit 123 increases the voltage of the write line WSL from Voff to Von in response to the control signal 21C (T5) to connect the gate of the drive transistor Tr1 to the signal line DTL. At this time, the write line drive circuit 123 applies a write pulse with a pulse width changed according to the control signal 21C to the write line WSL.

Accordingly, the gate voltage Vg of the drive transistor Tr1 becomes the voltage Vsig of the signal line DTL. At this time, the anode voltage of the organic EL device 13 is still smaller than the threshold voltage Vel of the organic EL device 13 at this stage, and the organic EL device 13 is cut off. Therefore, since the current Ids flows to the device capacitor Coled of the organic EL device 13 to charge the device capacitor Coled, the source voltage Vs is increased by ΔVs, and the potential difference Vgs reaches Vsig+Vth−ΔVs in the end. Thus, the μ correction is performed simultaneously with the writing. In this case, the larger the mobility μ of the drive transistor Tr1 is, the more ΔVs is increased; therefore, when the potential difference Vgs is reduced by ΔV before light emission, variation in mobility μ for each pixel 11 is allowed to be eliminated.

(Light Emission)

Finally, the write line drive circuit 123 reduces the voltage of the write line WSL from Von to Voff in response to the control signal 21C (T6). Accordingly, the gate of the drive transistor Tr1 is turned to a floating state, and the current Ids flows between the drain and source of the drive transistor Tr1 to increase the source voltage Vs. As a result, a voltage equal to or higher than the threshold voltage Vel is applied to the organic EL device 13, and the organic EL device 13 emits light with desired luminance.

In the display unit 1 according to this embodiment, as described above, when ON/OFF of the pixel circuit 12 is controlled in each pixel 11, and a drive current is injected into the organic EL device 13 of each pixel 11, holes and electrons are recombined to cause light emission. As a result, an image is displayed on the display region 10A.

[Effects]

Next, effects of the display unit 1 according to this embodiment will be described below.

The mobility correction period is determined by the width of the write pulse applied to the gate of the write transistor Tr2 (i.e., the ON period of the write transistor Tr2). However, the write pulse does not have a perfect square wave, but has rounding as illustrated in FIG. 26A. Therefore, in actuality, as illustrated in FIG. 26B, the mobility correction period may vary with the threshold voltage of the write transistor. When the mobility correction period varies, as illustrated in FIG. 27, magnitude of the current Ids flowing through the organic EL device when the organic EL device emits light changes, and light emission luminance also changes accordingly. Therefore, the mobility correction period preferably varies as little as possible.

A negative bias is applied to the write transistor Tr2 in the light emission period. Moreover, even in the threshold correction preparation period after completion of light emission, the negative bias is applied to the write transistor Tr2. When the negative bias is continuously applied to the gate-source voltage of the write transistor Tr2 in such a manner, a depression shift occurs in the threshold voltage characteristics of the write transistor Tr2, and, for example, as illustrated in FIG. 26B, the threshold voltage changes (decreases) from Vth1 to Vth2. Therefore, the mobility correction period becomes longer by Δt1+Δt2 than an initial period. As a result, as illustrated in FIG. 27, the current Ids flowing through the organic EL device when the organic EL device emits light is decreased by ΔIds, and light emission luminance is also decreased accordingly. In other words, light emission luminance is decreased with the duration of use of the organic EL display unit.

On the other hand, in this embodiment, the pulse width of the write pulse applied to the gate of the write transistor Tr2 is changed according to the first characteristic amount (the detection signal 125A). Therefore, change in the ON period of the write transistor Tr2 caused by a depression shift in the threshold voltage characteristics of the write transistor Tr2 is allowed to be reduced. Accordingly, for example, change in a write pulse application period is allowed to be reduced. As a result, a decrease in light emission luminance caused by the depression shift is allowed to be reduced.

2-2. Modification Examples

First Modification Example

FIG. 18 illustrates a schematic configuration of a modification example of the display unit 1 according to the second embodiment. The configuration of the display unit 1 according to this modification example differs from that according to the above-described embodiment in that the display panel 10 includes two kinds of dummy pixels 114 and 115 (a first dummy pixel and a second dummy pixel) in the frame region 10B. Therefore, description will be given of, mainly, points different from the display unit 1 according to the above-described embodiment, and points common to the display unit 1 according to the above-described embodiment will not be repeated as appropriate.

In this modification example, as described above, the display panel 10 includes two kinds of dummy pixels 114 and 115. As illustrated in FIG. 19A, the dummy pixel 114 includes the same components as those of the pixel 11 in the above-described embodiment. On the other hand, as illustrated in FIG. 19B, the dummy pixel 115 corresponds to a circuit equivalent to the pixel 11 in the above-described embodiment from which the organic EL device 13 is removed and of which a portion where the organic EL device 13 was located in the pixel 11 is short-circuited.

Next, a method of creating the table 33A in this modification example will be described below. It is to be noted that the table 33A in this modification example is updated whenever necessary while a user uses the display unit 1 according to this modification example after the display unit 1 is shipped.

In the display unit 1 according to this modification example, the drive circuit 20 continuously applies a write pulse with a fixed pulse width to the above-described two kinds of dummy pixels 114 and 115, and monitors the detection signal 125A output from the measurement circuit 125. Thus, the drive circuit 20 is allowed to measure a state in which the value of the detection signal 125A on the dummy pixel 114 side is gradually decreased. At this time, for example, a pulse width of a write pulse at which the value of the detection signal 125A coincides with (or substantially coincides with) the initial value is searched on the dummy pixel 114 at predetermined intervals. For example, the drive circuit 20 swings the pulse width of the write pulse applied to the pixel 114, and continuously applies the write pulse with the fixed pulse width to the dummy pixel 115 to search a pulse width of a write pulse at which a value (a differential current value) obtained by subtracting the value of the detection signal 125A on the dummy pixel 114 side from the value of the detection signal 125A on the dummy pixel 115 side coincides with (or substantially coincides with) an initial differential current value. Then, the drive circuit 20 records, in the memory 33, the pulse width found by searching in relation to the differential current value, and this is executed every time the pulse width is searched. The drive circuit 20 appends the table 33A created in such a manner to the memory every time the pulse width is searched.

Next, effects of the display unit 1 according to this modification example will be described below. In this modification example, the pulse width of the write pulse applied to the gate of the write transistor Tr2 is changed according to the first characteristic amount (the detection signal 125A). Therefore, change in the ON period of the write transistor Tr2 caused by a depression shift in the threshold voltage characteristics of the write transistor Tr2 is allowed to be reduced. Accordingly, for example, change in the write pulse application period is allowed to be reduced. Therefore, a decrease in light emission luminance caused by the depression shift is allowed to be reduced.

Modification Example 2

FIG. 20 illustrates a schematic configuration of the display control circuit 121 in the display unit 1 according to a second modification example. The configuration of the display unit 1 according to this modification example differs from that according to the above-described second embodiment in that the memory 33 holds a table 33B in addition to the table 33A. Therefore, description will be given of, mainly, points different from the display unit 1 according to the above-described second embodiment, and points common to the display unit 1 according to the above-described second embodiment will not be repeated as appropriate.

As illustrated in FIG. 21, the table 33B is a table relating a current value to a Vth correction pulse width (or the ON period of the write transistor Tr2). In this case, the current value in the table 33B is compared to the detection signal 125A input from the measurement circuit 125.

Moreover, the Vth correction pulse width in the table 33B represents a width of a Vth correction pulse illustrated in a portion enclosed by a broken line in FIG. 22, and more specifically, as illustrated in FIG. 23, the Vth correction pulse width corresponds to a period from a start point of a rising edge of a pulse to an end point of a falling edge of the pulse. It is to be noted that FIG. 23 exemplifies a case where the Vth correction pulse width has an initial value (Pc0). It is to be noted that, although not illustrated, the Vth correction pulse width may correspond to, for example, a period from the start point of the rising edge of the pulse to a start point of the falling edge of the pulse. Moreover, the ON period of the write transistor Tr2 indicates a period including a period in which the fixed signal voltage Vsig unrelated to the signal voltage Vsig is written to the gate of the drive transistor Tr1 when the Vth correction pulse illustrated in the portion enclosed by the broken line in FIG. 22 is applied to the write transistor Tr2. More specifically, as illustrated in FIG. 23, an ON period ΔT1 of the write transistor Tr2 corresponds to a period from a point at which a peak value becomes equal to the threshold voltage of the write transistor Tr at the rising edge of the Vth correction pulse to a point at which the peak value becomes equal to the threshold voltage of the write transistor Tr2 at the falling edge of the Vth correction pulse. It is to be noted that FIGS. 22 and 23 exemplify a case where the Vth correction pulse is applied not only in the Vth correction period ΔT2 but also in a part of the Vth correction preparation period ΔT3.

Next, a method of creating the table 33B in this modification example will be described below. FIG. 16 illustrates an example of a circuit configuration of a pixel included in a display unit (a master) for creation of the table 33B.

In this display unit (master), for example, while the Vth correction pulse with a fixed pulse width is continuously applied to the above-described pixel 111, the detection signal 125A output from the measurement circuit 125 is monitored. Therefore, a state in which the value of the detection signal 125A is gradually decreased is allowed to be measured. At this time, for example, a pulse width of a Vth correction pulse at which the value of the detection signal 125A coincides with an initial value is searched on the pixel 111 at predetermined intervals. For example, the pulse width of the Vth correction pulse applied to the pixel 111 is swung to search the pulse width of the Vth correction pulse at which the value of the detection signal 125A obtained at this time coincides with (or substantially coincides with) a value of the detection signal 125A obtained at about the time driving of the above-described pixel 111 starts in the display unit for creation of the table 33B (i.e., in an initial stage). Then, the pulse width found by searching is recorded in relation to the value of the detection signal 125A, and this is executed every time the pulse width is searched. Thus, the table 33B is completed. Then, the completed table 33B is stored in the memory 33 by an operator.

In this modification example, the controller 32 is configured to change the pulse width of the write pulse applied to the gate of the write transistor Tr2 with use of the detection signal 125A input from the measurement circuit 125 and the tables 33A and 33B in the memory 33 and to change the pulse width of the Vth correction pulse applied to the gate of the write transistor Tr2. The controller 32 is configured to contain a control signal related to the pulse widths of the write pulse and the Vth correction pulse in the control signal 21C, and output the control signal 21C to the write line drive circuit 123. Control of the pulse width of the Vth correction pulse by the controller 32 will be described below.

The controller 32 is configured to set the pulse width of the Vth correction pulse with use of the detection signal 125A and the table 33B. More specifically, the controller 32 sets the pulse width of the Vth correction pulse with use of the detection signal 125A and the table 33B so as to allow the ON period of the write transistor Tr2 corresponding to the Vth correction pulse to be consistently constant irrespective of the threshold voltage of the write transistor Tr2. It is to be noted that it is not necessary for the pulse width of an actual Vth correction pulse to be consistently perfectly same. For example, as a result of setting the pulse width of the Vth correction pulse so as to allow the ON period of the write transistor Tr2 corresponding to the Vth correction pulse to be consistently constant irrespective of the threshold voltage of the write transistor Tr2, the pulse width of the actual Vth correction pulse may have an error to some extent.

In this modification example, the write line drive circuit 123 is allowed to change the pulse width of the pulse applied to the pixel 11 targeted for driving in response to input of the control signal 21C. Specifically, the write line drive circuit 123 is configured to change the pulse width of the pulse applied to the gate of the write transistor when writing of the signal voltage corresponding to the image signal 20A is performed according to a characteristic amount (first characteristic amount) corresponding to or relevant to an amount of decrease in the threshold voltage of the write transistor Tr2 in response to input of the control signal 21C. More specifically, the write line drive circuit 23 is configured to change, according to the characteristic amount corresponding to or relevant to the amount of decrease in the threshold voltage of the write transistor Tr2 in response to input of the control signal 21C, the pulse width of the write pulse applied to the gate of the write transistor when writing of the signal voltage corresponding to the image signal 20A is performed.

Moreover, the write line drive circuit 123 is configured to change the pulse width of the Vth correction pulse applied to the gate of the write transistor Tr2 when Vth correction that allows the gate-source voltage Vgs of the drive transistor Tr1 to be brought close to the threshold voltage of the drive transistor Tr1 is performed according to the characteristic amount (first characteristic amount) corresponding to or relevant to the amount of decrease in the threshold voltage of the write transistor Tr2 in response to input of the control signal 21C. More specifically, the write line drive circuit 123 is configured to change, according to the characteristic amount corresponding to or relevant to the amount of decrease in the threshold voltage of the write transistor Tr2 in response to input of the control signal 21C, the pulse width of the Vth correction pulse applied to the gate of the write transistor Tr2 when the Vth correction is performed.

The write line drive circuit 123 is configured to reduce, by change in the pulse width, change in the ON period of the write transistor Tr2 caused by the depression shift in the threshold voltage characteristics of the write transistor Tr2. More specifically, the write line drive circuit 123 is configured to reduce, by change in the write pulse width, change in the ON period of the write transistor Tr2 caused by the depression shift in the threshold voltage characteristics of the write transistor Tr2. Moreover, the write line drive circuit 123 is configured to reduce, by change in the Vth correction pulse width, change in the ON period of the write transistor Tr2 caused by the depression shift in the threshold voltage characteristics of the write transistor Tr2.

Incidentally, as with the write pulse, the Vth correction pulse does not have a perfect square wave, but has rounding as illustrated in FIG. 23. Therefore, in actuality, the ON period of the write transistor Tr2 may vary with the threshold voltage of the write transistor Tr2. When the ON period of the write transistor Tr2 varies, the Vth correction is not performed properly, and the gate-source voltage Vgs of the write transistor Tr2 does not become Vth. As a result, magnitude of the current Ids flowing through the organic EL device 13 when the organic EL device 13 emits light changes, and light emission luminance changes accordingly. Therefore, the ON period of the write transistor Tr2 preferably varies as little as possible.

The threshold voltage of the write transistor Tr2 changes (decreases), for example, by continuously applying a negative bias to the gate-source voltage of the write transistor Tr2. In other words, the threshold voltage characteristics of the write transistor Tr2 are shifted from enhancement to depression. Typically, the negative bias is applied to the write transistor Tr2 in the light emission period or the light quenching period of the organic EL device 13. When the negative bias is continuously applied to the gate-source voltage of the write transistor Tr2, i.e., with the passage of the drive period of the write transistor Tr2, a depression shift occurs in the threshold voltage characteristics of the write transistor Tr2, and, for example, as illustrated in FIG. 24(A), the threshold voltage is gradually decreased. Accordingly, in a case where the Vth correction pulse width is consistently constant, the length of the ON period of the write transistor Tr2 is gradually increased, and the current Ids flowing through the organic EL device 13 when the organic EL device 13 emits light is gradually decreased; therefore, light emission luminance is also gradually decreased.

On the other hand, in this modification example, as described above, the controller 32 sets the pulse width of the Vth correction pulse so as to allow the ON period of the write transistor Tr2 corresponding to the Vth correction pulse to be consistently constant irrespective of the threshold voltage of the write transistor Tr2. For example, as illustrated in FIG. 23 and FIGS. 24(A) and (B), the controller 32 gradually reduces the pulse width of the Vth correction pulse with a decrease in the threshold voltage of the write transistor Tr2 so as to allow the ON period of the write transistor Tr2 corresponding to the Vth correction pulse to be consistently constant. The above-described table 33B allows such adjustment of the pulse width.

However, as with the table 33A, the threshold voltage of the write transistor Tr2 is not written to the table 33B. It is because variation in the threshold voltage of the write transistor Tr2 is not easily measured. In this modification example, the drive circuit 20 measures the characteristic amount corresponding to or relevant to the threshold voltage instead of measurement of the threshold voltage, and more specifically, the drive circuit 20 includes the measurement circuit 125.

Next, effects of the display unit 1 according to this modification example will be described below. In this modification example, the pulse width of the write pulse applied to the gate of the write transistor Tr2 is changed according to the characteristic amount corresponding to or relevant to the amount of decrease in the threshold voltage of the write transistor Tr2 (more specifically, the detection signal 125A output from the detection circuit 125). Moreover, the pulse width of the Vth correction pulse applied to the gate of the write transistor Tr2 is changed according to the characteristic amount corresponding to or relevant to the amount of decrease in the threshold voltage of the write transistor Tr2 (more specifically, the detection signal 125A output from the detection circuit 125). Therefore, change in the ON period of the write transistor Tr2 caused by the depression shift in the threshold voltage characteristics of the write transistor Tr2 is allowed to be reduced. Accordingly, change in the write pulse application period or change in a period of the Vth correction that allows the gate-source voltage Vgs of the drive transistor Tr2 to be brought close to the threshold voltage of the drive transistor is allowed to be reduced. Thus, a decrease in light emission luminance caused by the depression shift is allowed to be further reduced.

Third Modification Example

The display panel 10 according to the above-described second modification example may include two kinds of dummy pixels 114 and 115 in the frame region 10B. In this case, the tables 33A and 33B are updated whenever necessary while a user uses the display unit 1 according to this modification example after the display unit is shipped. In other words, the display unit (master) for creation of the tables 33A and 33B is not used to create the tables 33A and 33B in this modification example.

In this modification example, as with the above-described modification example 1, the pulse width of the write pulse applied to the gate of the write transistor Tr2 is changed according to the characteristic amount corresponding to or relevant to the amount of decrease in the threshold voltage of the write transistor Tr2 (more specifically, the detection signal 125A output from the detection circuit 125). Moreover, the pulse width of the Vth correction pulse applied to the gate of the write transistor Tr2 is changed according to the characteristic amount corresponding to or relevant to the amount of decrease in the threshold voltage of the write transistor Tr2 (more specifically, the detection signal 125A output from the detection circuit 125). Therefore, change in the ON period of the write transistor Tr2 caused by the depression shift in the threshold voltage characteristics of the write transistor Tr2 is allowed to be reduced. Therefore, change in the write pulse application period or change in the period the Vth correction that allows the gate-source voltage Vgs of the drive transistor Tr2 to be brought close to the threshold voltage of the drive transistor is allowed to be reduced. Thus, a decrease in light emission luminance caused by the depression shift is allowed to be further reduced.

2-3. Module and Application Examples

Application examples of the display units 1 described in the above-described second embodiment and the above-described modification examples will be described below. The display units 1 according to the above-described embodiment and the like are applicable to display units of electronic apparatuses, in any fields, displaying an image signal supplied from an external device or an image signal produced inside as an image or a picture, such as televisions, digital cameras, notebook personal computers, portable terminal devices such as cellular phones, and video cameras.

(Module)

The display unit 1 according to any one of the above-described second embodiment and the like is incorporated into various electronic apparatuses such as Application Examples 1 to 5 that will be described later as a module as illustrated in FIG. 25. In this module, for example, the region 210 exposed from a member (not illustrated) sealing the display section 10 is provided on a side of the substrate 2, and an external connection terminal (not illustrated) is formed in the exposed region 210 by extending wiring of a timing control circuit 121, an image signal processing circuit 122, the signal line drive circuit 122, the write line drive circuit 123, the power supply line drive circuit 124, and a current detection circuit 126. In the external connection terminal, a flexible printed circuit (FPC) 220 for signal input and output may be provided.

Application Example 1

FIG. 40 illustrates an appearance of a television to which the display unit 1 according to any one of the above-described second embodiment and the like is applied. The television includes, for example, an image display screen section 300 including a front panel 310 and a filter glass 320, and the image display screen section 300 is configured of the display unit 1 according to any one of the above-described second embodiment and the like.

Application Example 2

FIGS. 41A and 41B illustrate an appearance of a digital camera to which the display unit 1 according to any one of the above-described second embodiment and the like is applied. The digital camera includes, for example, a light-emitting section 410 for a flash, a display section 420, a menu switch 430, and a shutter button 440, and the display section 420 is configured of the display unit 1 according to any one of the above-described second embodiment and the like.

Application Example 3

FIG. 42 illustrates an appearance of a notebook personal computer to which the display unit 1 according to any one of the above-described second embodiment and the like is applied. The notebook personal computer includes, for example, a main body 510, a keyboard 520 for operation of inputting characters and the like, and a display section 530 for displaying of an image, and the display section 530 is configured of the display unit 1 according to any one of the above-described second embodiment and the like.

Application Example 4

FIG. 43 illustrates an appearance of a video camera to which the display unit 1 according to any one of the above-described second embodiment and the like is applied. The video camera includes, for example, a main section 610, a lens 620 provided on a front surface of the main section 610 and for shooting an image of an object, a shooting start/stop switch 630, and a display section 640, and the display section 640 is configured of the display unit 1 according to any one of the above-described second embodiment.

Application Example 5

FIG. 44 illustrates an appearance of a cellular phone to which the display unit 1 according to any one of the above-described second embodiment and the like is applied. The cellular phone is formed by connecting, for example, a top-side enclosure 710 and a bottom-side enclosure 720 to each other by a connection section (hinge section) 730, and the cellular phone includes a display 740, a sub-display 750, a picture light 760, and a camera 770. The display 740 or the sub-display 750 is configured of the display unit 1 according to any one of the above-described second embodiment and the like.

Although the present technology is described referring to the second embodiment, the modification examples thereof, and the application examples, the present technology is not limited thereto, and may be variously modified.

In the above-described second embodiment and the like, the configuration of the pixel circuit 12 for active matrix drive is not limited to those described in the above-described embodiment and the like, and a capacitor element or a transistor may be added as necessary. In this case, a necessary drive circuit may be included in addition to the above-described signal line drive circuit 122, the write line drive circuit 123, the power supply line drive circuit 124, the current detection circuit 126, and the like according to a modification of the pixel circuit 12.

Moreover, the present technology may have the following configurations.

(1) A display unit including:

a display section including a light-emitting device and a pixel circuit in each pixel in a display region; and a drive section configured to drive the pixel circuit, based on an image signal, in which the pixel circuit includes a drive transistor configured to drive the light-emitting device, and a write transistor configured to control application of a signal voltage corresponding to the image signal to a gate of the drive transistor, and the drive section changes a pulse width of a pulse applied to a gate of the write transistor according to a first characteristic amount corresponding to or relevant to an amount of decrease in a threshold voltage of the write transistor.

(2) The display unit according to (1), in which the drive section reduces change in an ON period of the write transistor caused by a depression shift in threshold voltage characteristics of the write transistor by change in the pulse width.

(3) The display unit according to (1) or (2), in which the drive section changes, according to the first characteristic amount, a pulse width of a write pulse applied to the gate of the write transistor when writing of the signal voltage corresponding to the image signal is performed.

(4) The display unit according to (3), in which the drive section changes, according to the first characteristic amount, a pulse width of a Vth correction pulse applied to the gate of the write transistor when Vth correction that allows a gate-source voltage of the drive transistor to be brought close to a threshold voltage of the drive transistor is performed, (5) The display unit according to any one of (1) to (4), in which the drive section includes a measurement section configured to measure a value of a current flowing through the light-emitting device or a physical quantity corresponding to the value of the current, and the drive section changes the pulse width of the pulse applied to the gate of the write transistor with use of a measurement value by the measurement section or a value obtained by performing a predetermined arithmetic operation on the measurement value.

(6) The display unit according to (5), in which the drive section includes a table exhibiting a relationship between the first characteristic amount and the pulse width of the pulse applied to the gate of the write transistor or a second characteristic amount corresponding to or relevant the pulse width of the pulse, and the drive section changes the pulse width of the pulse applied to the gate of the write transistor with use of the measurement value by the measurement section or the value obtained by performing a predetermined arithmetic operation on the measurement value, and the table.

(7) The display unit according to (6), in which the display section includes, in a frame region located around the display region, a first dummy pixel including the same configurations as the light-emitting device and the pixel circuit and a second dummy pixel corresponding to a circuit equivalent to the first dummy pixel from which the light-emitting device is removed and of which a portion where the light-emitting device was located is short-circuited, and the drive section updates the table with use of the first dummy pixel and the second dummy pixel.

(8) An electronic apparatus provided with a display unit, the display unit including:

a display section including a light-emitting device and a pixel circuit in each pixel in a display region; and a drive section configured to drive the pixel circuit, based on an image signal, in which the pixel circuit includes a drive transistor configured to drive the light-emitting device, and a write transistor configured to control application of a signal voltage corresponding to the image signal to a gate of the drive transistor, and the drive section changes a pulse width of a pulse applied to a gate of the write transistor according to a first characteristic amount corresponding to or relevant to an amount of decrease in a threshold voltage of the write transistor.

(9) A method of driving a display unit, the method including:

in the display unit including a light-emitting device and a pixel circuit in each pixel in a display region, the pixel circuit including a drive transistor configured to drive the light-emitting device and a write transistor configured to control application of a signal voltage corresponding to an image signal to a gate of the drive transistor, changing a pulse width of a pulse applied to a gate of the write transistor according to a first characteristic amount corresponding to or relevant to an amount of decrease in a threshold voltage of the write transistor.

A third embodiment for embodying the present technology will be described below referring to the accompanying drawings. It is to be noted that description will be given in the following order.

3-1. Embodiment (display unit)

3-2. Modification Examples (display unit)

3-3. Application Examples (electronic apparatuses)

3-1. Embodiment

[Configuration]

FIG. 28 illustrates a schematic configuration of a display unit 1 according to an embodiment of the present technology. This display unit 1 includes a display panel 10 and a drive circuit 20 that drives the display panel 10, based on an image signal 20A and a synchronization signal 20B. The drive circuit 20 includes, for example, a timing generation circuit 21, an image signal processing circuit 22, a signal line drive circuit 23, a scanning line drive circuit 24, and a power supply line drive circuit 25.

(Display Panel 10)

The display panel 10 is configured of a plurality of pixels 11 two-dimensionally arranged on an entire surface of a display region 10A of the display panel 10. The display panel 10 displays an image, based on the image signal 20A input from an external device by driving respective pixels 11 in an active matrix mode by the drive circuit 20.

FIG. 29 illustrates an example of a circuit configuration of the pixel 11. Each of the pixels 11 includes, for example, a pixel circuit 12 and an organic EL device 13. The organic EL device 13 has, for example, a configuration in which an anode electrode, an organic layer, and a cathode electrode are laminated in order. The pixel circuit 12 is configured of, for example, a drive transistor Tr1, a write transistor Tr2, and a retention capacitor Cs, and has a 2Tr1C circuit configuration. The write transistor Tr2 is configured to control application of a signal voltage corresponding to an image signal to a gate of the drive transistor Tr1. More specifically, the write transistor Tr2 is configured to sample a voltage of a signal line DTL that will be described later and write the voltage to the gate of the drive transistor Tr1. The drive transistor Tr1 is configured to drive the organic EL device 13, and is connected in series to the organic EL device 13. The drive transistor Tr1 is configured to control a current flowing through the organic EL device 13, based on magnitude of the voltage written by the write transistor Tr2. The retention capacitor Cs is configured to keep a predetermined voltage between the gate and a source of the drive transistor Tr1. It is to be noted that the pixel circuit 12 may have a circuit configuration different from the above-described 2Tr1C circuit configuration.

Each of the drive transistor Tr1 and the write transistor Tr2 is configured of, for example, an n-channel MOS thin film transistor (TFT). It is to be noted that the kind of TFT is not specifically limited, and may be an inverted stagger configuration (a so-called bottom gate type) or a stagger configuration (a top gate type). Moreover, each of the drive transistor Tr1 and the write transistor Tr2 may be configured of a P-channel MOS TFT.

The display panel 10 includes a plurality of scanning lines WSL (first wiring lines) extending along a row direction, a plurality of signal lines DTL (third wiring lines) extending along a column direction, and a plurality of power supply lines DSL (second wiring lines) extending along the row direction. The scanning lines WSL are used to select respective pixels 11. The signal lines DTL are used to supply a signal voltage corresponding to an image signal to respective pixels 11. The power supply lines DSL are used to supply a drive current to respective pixel 11. The pixel 11 is disposed near an intersection of each signal line DTL and each scanning line WSL. Each of the signal lines DTL is connected to an output end (not illustrated) of the signal line drive circuit 23 that will be described later and a source or a drain of the write transistor Tr2. Each of the scanning lines WSL is connected to an output end (not illustrated) of the scanning line drive circuit 24 that will be described later and a gate of the write transistor Tr2. Each of the power supply lines DSL is connected to an output end (not illustrated) of a power supply outputting a fixed voltage and the source or a drain of the drive transistor Tr1.

The gate of the write transistor Tr2 is connected to the scanning line WSL. The source or the drain of the write transistor Tr2 is connected to the signal line DTL, and a terminal not connected to the signal line DTL of the source and the drain of the write transistor Tr2 is connected to the gate of the drive transistor Tr1. The source or the drain of the drive transistor Tr1 is connected to the power supply line DSL, and a terminal not connected to the power supply line DSL of the source and the drain of the drive transistor Tr1 is connected to an anode of the organic EL device 13. An end of the retention capacitor Cs is connected to the gate of the drive transistor Tr1, and the other end of the retention capacitor Cs is connected to the source (a terminal located closer to the organic EL device 13 in FIG. 29) of the drive transistor Tr1. In other words, the retention capacitor Cs is inserted between the gate and the source of the drive transistor Tr1. It is to be noted that the organic EL device 13 includes a device capacitor Coled.

As illustrated in FIG. 29, the display panel 10 further includes a ground line GND connected to a cathode of the organic EL device 13. The ground line GND is configured to be electrically connected to an external circuit (not illustrated) having a ground potential. The ground line GND is a sheet-shaped electrode formed over the entire display region 10A. It is to be noted that the ground line GND may be a strip-shaped electrode formed in a rectangular shape corresponding to a pixel row or a pixel column. The display panel 10 further includes, for example, a frame region 10B where an image is not displayed around an outer edge of the display region 10A. The frame region 10B is covered with, for example, a light-shielding member.

FIGS. 30 and 31 illustrate an example of a layout of the respective pixels 11. FIG. 30 illustrates an example of a layout of the respective pixels 11 in an nth pixel row ($1 \leq n < N$, where N is the total number (even number) of pixel rows) and an n+1th pixel rows, and FIG. 31 illustrates an example of the respective pixels in an n+2th pixel rows and an n+3th pixel rows. The layout of the respective pixels 11 is common to the nth and n+1th pixel rows and the n+2th and n+3th pixel rows. It is to be noted that description will not be given of the layout of the respective pixels 11 in the n+2th and n+3th pixel rows to avoid repetition of description.

Each of the pixels 11 corresponds to a point that is a smallest unit configuring a screen on the display panel 10. The display panel 10 is a color display panel, and each of the pixels 11 corresponds to, for example, a sub-pixel emitting light of a single color such as red, green, blue, or the like. In this embodiment, a display pixel 14 is configured of three pixels 11 of emission colors different from one another. In other words, the number of kinds of emission colors is three. The three pixels 11 included in the display pixel 14 are configured of a pixel 11R emitting red light, a pixel 11G emitting green light, and a pixel 11B emitting blue light. The respective display pixels 14 are arranged in a so-called stripe arrangement. In other words, the plurality of pixels 11 are periodically arranged in order of the pixel 11R, 11G, and 11B along a row direction, and the pixels 11 of a same emission color are arranged along a column direction.

In case where a k ($k \geq 2$) number of pixel rows are considered as one unit, the k number of scanning lines WSL of the plurality of scanning lines WSL are assigned to each one unit. The number of pixel rows included in one unit is equal to or larger than two, and is equal to or smaller than the number of kinds of emission colors. More specifically, in a case where two pixel rows is considered as one unit, two of the plurality of scanning lines WSL are assigned to each one unit. Therefore, the number of pixel rows included in one unit is two, and the number of scanning lines WSL included in the one unit is also two. The total number of scanning lines WSL is equal to the total number of pixel rows, and is an N number. It is to be noted that "n" in FIG. 30 is a positive integer of 1 to N/2 both inclusive, and WSL(n) in FIG. 30 means an nth scanning line WSL. Each of the scanning lines WSL is connected to a plurality of pixels 11 of a same emission color in one unit. More specifically, in two scanning lines WSL(n) and WSL(n+1) included in one unit, the scanning line WSL(n) is connected to a plurality of pixels 11R and a plurality of pixels 11B included in the one unit, and the scanning line WSL(n+1) is connected to a plurality of pixels 11G included in the one unit. Moreover, each of the scanning lines WSL is connected to all pixels 11 of a same emission color in one unit. More specifically, in two scanning lines WSL(n) and WSL(n+1) included in one unit, the scanning line WSL(n) is connected to all pixels 11R and all pixels 11B in the one unit, and the scanning line WSL(n+1) is connected to all pixels 11G in the one unit.

One of the plurality of power supply lines DSL is assigned to each one unit. Therefore, the number of power supply lines DSL included in one unit is one. The total number of power supply lines DSL is equal to half of the total number of pixel rows, i.e., a J (=N/2) number. It is to be noted that "j" in FIG. 30 is a positive integer of 1 to N/2 both inclusive, and DSL(j) in FIG. 30 means a jth power supply line DSL. Each of the power supply lines DSL is connected to all pixels 11 in one unit. More specifically, one power supply line DSL included in one unit is connected to all pixels (11R, 11G, and 11B) included in the one unit.

Two of the plurality of signal lines DTL are assigned to each display pixel 14 in each pixel row. In two signal lines DTL assigned to each display pixel 14 in each pixel row, one of the signal lines DTL is connected to two kinds of pixels 11 of emission colors that do not share a same scanning line WSL with each other, and the other one of the signal lines DTL is connected to remaining kinds of pixels 11 of emission colors. More specifically, first, attention is focused on two display pixels 14 located adjacent to each other along the column direction (i.e., two display pixels 14 located in different rows and adjacent to each other in one unit) of a plurality of display pixels 14 included in the nth and n+1th pixel rows. Two signal lines DTL(m) and DTL(m+2) are assigned to the display pixel 14 included in the nth pixel row of the two display pixels 14. It is to be noted that the number of signal lines DTL is equal to the number of pixels 11 included in one pixel row, and is an M (M is a multiple of 4) number. In FIG. 30, m is a positive integer of 1 to M−4 both inclusive, and is a number corresponding to (a multiple of 4+1) in a case where m is not 1. Therefore, DTL(m) in FIG. 30 means an mth signal line DTL.

In the above-described two signal lines DTL(m) and DTL(m+2), the signal line DTL(m+2) as one of them is connected to the pixels 11G and 11B of two kinds of emission colors that do not share a same scanning line WSL with each other, and signal line DTL(m) as the other of them is connected to the pixel 11R of the remaining kind of emission color. Moreover, two signal lines DTL(m+1) and DTL(m+3) are assigned to the display pixel 14 included in the n+1th pixel row of the above-described two display pixels 14. In the two signal lines DTL(m+1) and DTL(m+3), the signal line DTL(m+1) as one of them is connected to the pixels 11R and 11G of two kinds of emission colors that do not share a same scanning line WSL with each other, and the signal line DTL(m+3) is connected to the pixel 11B of the remaining kind of emission color.

In other words, two display pixels 14 located in different rows and adjacent to each other in one unit, two signal lines DTL(m) and DTL(m+2) in even-numbered rows are assigned to one of the display pixels 14, and two signal lines DTL(m+1) and DTL(m+3) in odd-numbered rows are assigned to the other display pixel 14. Moreover, a combination two kinds of emission colors of pixels 11 of emission colors that share a same scanning line WSL with each other is different between two display pixels 14 located in different rows and adjacent to each other in one unit. Therefore, the total number of signal lines DTL is kept to a minimum.

(Drive Circuit 20)

Next, the drive circuit 20 will be described below. As described above, the drive circuit 20 includes, for example, the timing generation circuit 21, the image signal processing circuit 22, the signal line drive circuit 23, the scanning line drive circuit 24, and the power supply line drive circuit 25. The timing generation circuit 21 is configured to control respective circuits in the drive circuit 20 to operate in conjunction with one another. The timing generation circuit 21 is configured to output, for example, a control signal 21A to the above-described respective circuits in response to (in synchronization with) a synchronization signal 20B input from an external device.

For example, the image signal processing circuit 22 is configured to perform predetermined correction on the digital image signal 20A input from the external device, and output an image signal 22A obtained by the correction to the signal line drive circuit 23. Examples of the predetermined correction include gamma correction, overdrive correction, and the like.

For example, the signal line drive circuit 23 is configured to apply an analog signal voltage corresponding to the image signal 22A input from the image signal processing circuit 22 to each of the signal lines DTL in response to (in synchronization with) input of the control signal 21A. The signal line drive circuit 23 is allowed to output, for example, two kinds of voltages (Vofs and Vsig). More specifically, the signal line drive circuit 23 is configured to supply two kinds of voltages (Vofs and Vsig) to the pixel 11 selected by the scanning line drive circuit 24 through the signal line DTL.

FIG. 32 illustrates an example of voltages V(n), V(n+1), V(n+2), and V(n+3) sequentially applied to four signal lines DTL (DTL(m), DTL(m+1), DTL(m+2), and DTL(m+3)) connected to two display pixels 14 located adjacent to each other along the column direction in one given unit with scanning on the scanning lines WSL. For example, as illustrated in FIG. 32, the signal line drive circuit 23 is configured to supply voltage Vsig (Vsig(n, m) and Vsig(n, m+2)) corresponding to the nth pixel row to a plurality of pixels 11 located in the nth pixel row of a plurality of pixels 11 simultaneously selected by the scanning line drive circuit 24 through even-numberth signal lines DTL(m) and DTL (m+2). Moreover, the signal line drive circuit 23 is configured to supply the voltage Vsig (Vsig(n+l, m+1) and Vsig (n+l, m+3)) corresponding to the n+1th pixel rows to a plurality of pixels 11 located in the n+1th pixel rows of the plurality of pixels 11 simultaneously selected by the scanning line drive circuit 24 through odd-numberth signal lines DTL(m+1) and DTL(m+3). In other words, when the voltage V(n) is applied to the signal lines DTL (DTL(m) to DTL(m+3)) at the time of selecting the scanning line WSL (n), the signal line drive circuit 23 simultaneously outputs the voltage Vsig corresponding to the nth pixel row and the voltage Vsig corresponding to the n+1th pixel row to the even-numberth signal lines DTL(m) and DTL(m+2) and the odd-numberth signal lines DTL(m+1) and DTL(m+3), respectively.

When the voltage V(n+1) is applied to the signal lines DTL (DTL(m) to DTL(m+3)) at the time of selecting the scanning line WSL(n+1), the signal line drive circuit 23 simultaneously outputs the voltage Vsig (Vsig(n+l, m) and Vsig(n+l, m+2)) corresponding to the n+1th pixel row and the voltage Vsig (Vsig(n, m+1) and Vsig(n, m+3)) corresponding to the nth pixel row to the even-numberth signal lines DTL(m) and DTL(m+2) and the odd-numberth signal lines DTL(m+1) and DTL(m+3), respectively. It is to be noted that the signal line drive circuit 23 applies a voltage to the n+2th pixel row and the n+3th pixel row in a similar manner to the case of the nth pixel row and the n+1th pixel row.

As used herein, Vsig represents a voltage value corresponding to the image signal 20A. Vofs represents a fixed voltage unrelated to the image signal 20A. A minimum voltage of Vsig has a lower voltage value than Vofs, and a maximum voltage of Vsig has a higher voltage value than Vofs.

The scanning line drive circuit 24 is configured to sequentially select a plurality of scanning lines WSL in predetermined units in response to (in synchronization with) input of the control signal 21A. The scanning line drive circuit 24 is allowed to output, for example, two kinds of voltages (Von and Voff). More specifically, the scanning line drive circuit 24 is configured to supply two kinds of voltages (Von and Voff) to the pixel 11 targeted for driving through the scanning line WSL to perform ON/OFF control of the write transistor Tr2.

As used herein, Von is a value equal to or higher than an ON voltage of the write transistor Tr2. Von is a peak value of a write pulse output from the scanning line drive circuit 24 in "a latter half part of a Vth correction preparation period", "a Vth correction period", "a writing•μ, correction period", or the like that will be described later. Voff is a value lower than the ON voltage of the write transistor Tr2 and is a value lower than Von. Voff is a peak value of the write pulse output from the scanning line drive circuit 24 in "a former half part of the Vth correction preparation period", "a light emission period", or the like that will be described later.

For example, the power supply line drive circuit 25 is configured to sequentially select a plurality of power supply lines DSL in predetermined units in response to (in synchronization with) input of the control signal 21A. The power supply line drive circuit 25 is allowed to output, for example, two kinds of voltages (Vcc and Vss). More specifically, the power supply line drive circuit 25 is configured to supply two kinds of voltages (Vcc and Vss) to the entire one unit including the pixels 11 selected by the scanning line drive circuit 24 (i.e., all pixels 11 included in the one unit) through the power supply line DSL. As used herein, Vss is a voltage value lower than a voltage (Vel+Vcath) obtained by summing a threshold voltage Vel of the organic EL device 13 and a cathode voltage Vcath of the organic EL device 13. Vcc is a voltage value equal to or higher than the voltage (Vel+Vcath).

[Operation]

Next, an operation (an operation from light quenching to light emission) of the display unit 1 according to this embodiment will be described below. In this embodiment, even if I-V characteristics of the organic EL device 13 change with time, or even if a threshold voltage or mobility of the drive transistor Tr1 changes with time, to keep light emission luminance of the organic EL device constant without being affected by them, a compensation operation for variation in the I-V characteristics of the organic EL device and a correction operation for variation in the threshold voltage or the mobility μ of the drive transistor Tr1 are adopted.

FIG. 33 illustrates an example of various waveforms in the display unit 1. FIG. 33 illustrates a state in which voltage switching between two values momentarily takes place in the scanning line WSL, the power supply line DSL, and the signal line DTL. Moreover, FIG. 33 illustrates a state in which a gate voltage Vg and a source voltage Vs of the drive transistor Tr1 momentarily changes with voltage switching in the scanning line WSL, the power supply line DSL, and the signal line DTL.

(Vth Correction Preparation Period)

First, the drive circuit 20 prepares for Vth correction that allows a gate-source voltage Vgs of the drive transistor Tr1 to be brought close to a threshold voltage of the drive transistor Tr1. More specifically, when a voltage of the scanning line WSL is at Voff, a voltage of the signal line DTL is at Vofs, and a voltage of the power supply line DSL is at Vcc (i.e., when the organic EL device 13 emits light), the power supply line drive circuit 25 reduces the voltage of the power supply line DSL from Vcc to Vss in response to the control signal 21A (T1). Accordingly, the source voltage Vs is reduced to Vss, and the organic EL device 13 stops emitting light. At this time, the gate voltage Vg is also reduced by coupling through the retention capacitor Cs.

Next, while the voltage of the power supply line DSL is at Vss and the voltage of the signal line DTL is at Vofs, the scanning line drive circuit 24 increases the voltage of the scanning line WSL from Voff to Von in response to the control signal 21A (T2). Accordingly, the gate voltage Vg is reduced to Vofs. At this time, a potential difference Vgs between the gate voltage Vg and the source voltage Vs may be smaller than, equal to, or larger than the threshold voltage of the drive transistor Tr2.

(Vth Correction Period)

Next, the drive circuit 20 performs the Vth correction. More specifically, while the voltage of the signal line DTL is at Vofs and the voltage of the scanning line WSL is at Von, the power supply line drive circuit 25 increases the voltage of the power supply line DSL from Vss to Vcc in response to the control signal 21A (T3). Accordingly, the current Ids flows between the drain and the source of the drive transistor Tr1 to increase the source voltage Vs. At this time, in a case where the source voltage Vs is lower than Vofs−Vth (in a case where the Vth correction is not yet completed), the current Ids flows between the drain and the source of the drive transistor Tf1 until the drive transistor Tr1 is cut off (until the potential difference Vgs reaches Vth). Therefore, the gate voltage Vg is turned to Vofs, and the source voltage Vs is increased, and as a result, the retention capacitor Cs is charged to Vth, and the potential difference Vgs becomes Vth.

After that, before the signal line drive circuit 23 turns the voltage of the signal line DTL from Vofs to Vsig in response to the control signal 21A, the scanning line drive circuit 24 reduces the voltage of the scanning line WSL from Von to Voff in response to the control signal 21A (T4). Accordingly, the gate of the drive transistor Tr1 is turned to a floating state; therefore, the potential difference Vgs is allowed to remain at Vth irrespective of magnitude of the voltage of the signal line DTL. Thus, even in a case where the threshold voltage Vth of the drive transistor Tr1 varies for each pixel circuit 12, variation in light emission luminance of the organic EL device 13 is allowed to be eliminated by setting the potential difference Vgs to Vth.

(Vth Correction Stop Period)

After that, in a Vth correction stop period, the signal line drive circuit 23 turns the voltage of the signal line DTL from Vofs to Vsig.

(Signal writing•μ Correction Period)

After the Vth correction stop period ends (i.e., after the Vth correction is completed), the drive circuit 20 performs writing of a signal voltage corresponding to the image signal 20A and μ correction. More specifically, while the voltage of the signal line DTL is at Vsig, and the voltage of the power supply line DSL is at Vcc, the scanning line drive circuit 24 increases the voltage of the scanning line WSL from Voff to Von in response to the control signal 21A (T5) to connect the gate of the drive transistor Tr1 to the signal line DTL. Accordingly, the gate voltage Vg of the drive transistor Tr1 becomes the voltage Vsig of the signal line DTL. At this time, an anode voltage of the organic EL device 13 is still smaller than the threshold voltage Vel of the organic EL device 13 at this stage, and the organic EL device 13 is cut off. Therefore, since the current Ids flows to the device capacitor Coled of the organic EL device 13 to charge the device capacitor Coled, the source voltage Vs is increased by ΔVs, and the potential difference Vgs reaches Vsig+Vth−ΔVs in the end. Thus, the μl. correction is performed simultaneously with the writing. In this case, the larger the mobility μ of the drive transistor Tr1 is, the more ΔVs is increased; therefore, when the potential difference Vgs is reduced by ΔV before light emission, variation in mobility μ for each pixel 11 is allowed to be eliminated.

(Light Emission)

Finally, the scanning line drive circuit 24 reduces the voltage of the scanning line WSL from Von to Voff in response to the control signal 21A (T6). Accordingly, the gate of the drive transistor Tr1 is turned to a floating state, and the current Ids flows between the drain and source of the drive transistor Tr1 to increase the source voltage Vs. As a result, a voltage equal to or higher than the threshold voltage Vel is applied to the organic EL device 13, and the organic EL device 13 emits light with desired luminance.

Next, an example of scanning for the Vth correction and the signal writing•μ, correction in the display unit 1 according to this embodiment will be described below referring to FIGS. 32 and 34. It is to be noted that FIG. 34 illustrates an example of scanning for the Vth correction and the signal writing•μ, correction on given four successive pixel rows (the nth pixel row, the n+1th row, the n+2th pixel row, and the n+3th pixel row).

It is to be noted that description will be given in a case where all pixels 11 in one unit is divided into groups by the scanning lines WSL connected thereto. In this embodiment, all pixels 11R and all pixels 11B in one unit are included in one group, and all pixels 11G in the one unit are included in one group. Then, hereinafter, all pixels 11R and all pixels 11B to which the scanning lines WSL(n) and WSL(n+1) are connected in a unit are included in a first group, and all pixels 11G in the unit are included in a second group. Moreover, all pixels 11R and all pixels 11B to which the scanning lines WSL(n+2) and WSL(n+3) are connected in a unit are included in a third group, and all pixels 11G in the unit are included in a fourth group.

The drive circuit 20 performs Vth correction on all groups (the first and second groups) in one unit simultaneously, and then sequentially performs writing of the signal voltage (and μ correction) on all groups (the first and second groups) in the unit from one group to another. After that, the drive circuit 20 performs Vth correction on all groups (the third and fourth groups) in the next unit simultaneously, and then sequentially performs writing of the signal voltage (and μ correction) on all groups in the unit from one group to another. At this time, the drive circuit 20 performs the Vth correction on one unit in one horizontal period (1H), and then performs the writing of the signal voltage (and the μ correction) in the next one horizontal period. In other words, the drive circuit 20 performs the Vth correction and the wiring of the signal voltage (and the μ correction) on one unit with use of two successive horizontal periods (2H).

Moreover, when signal writing is performed on each group, the drive circuit 20 simultaneously performs the signal wiring on all pixels 11 included in the group. More specifically, the drive circuit 20 outputs the above-described voltage V(n) to each signal line DTL when the scanning line WSL(n) is selected. In other words, when the scanning line WSL(n) is selected, the drive circuit 20 simultaneously outputs Vsig in the nth pixel row (Vsig(n, m), Vsig(n, m+2)) and the voltage Vsig (Vsig(n+l, m+1) and Vsig(n+1, m+3)) corresponding to the n+1th pixel row to even-numberth signal lines DTL (DTL(m) and DTL(m+2)) and odd-numberth signal lines DTL(m+1) and DTL(m+3), respectively. Further, when the scanning line WSL(n+1) is selected, the drive circuit 20 simultaneously outputs Vsig in the n+1th pixel row (Vsig(n+1, m) and Vsig(n+1, m+2)) and the voltage Vsig (Vsig(n, m+1) and Vsig(n, m+3)) corresponding to the nth pixel row to even-numberth signal lines DTL (DTL(m) and DTL(m+2)) and odd-numberth signal lines DTL(m+1) and DTL(m+3), respectively.

As a result of doing so, periods (so-called waiting periods Δt1) from end of the Vth correction to start of the μ correction in the respective pixels 11R of a same color coincide with one another; therefore, the waiting periods Δt1 of a plurality of pixels 11R in each pixel row coincide with one another. It is to be noted that, in this embodiment, a waiting period Δt2 of each pixel 11B is equal to the waiting period Δt1 of each pixel 11R. Therefore, the waiting periods Δt2 in the respective pixels 11B of a same color coincide with each other; therefore, the waiting periods Δt2 in a plurality of pixels 11B in each pixel row coincide with one another. Moreover, waiting periods Δt3 in the respective pixels 11G of a same color coincide with one another; therefore, the waiting periods Δt3 of a plurality of pixels 11G in each pixel row coincide with one another. It is to be noted that the waiting periods Δt1 and Δt2 of the pixels 11R and 11B are different from the waiting period Δt3 of the pixel 11G; however, this only slightly affects color reproducibility, and does not affect color unevenness.

[Effects]

Next, effects of the display unit 1 according to this embodiment will be described below.

FIG. 35 illustrates an example of pixel arrangement according to a reference example. In the reference example, the pixels 11R, 11G, and 11B included in the display pixel 14 are connected to a common scanning line WSL(n) and a common power supply line DSL(n). In a case where such a pixel arrangement is adopted, for example, as illustrated in FIG. 36, when the Vth correction and the signal writing are performed in each 1H period, it is difficult to shorten the 1H period and shorten a scanning period per 1F (i.e., to achieve speed-up of driving). Therefore, for example, as illustrated in FIG. 37, after the Vth correction is performed collectively on two lines in a common 1H period, the signal writing is performed from one line to another in the next 1H period. Since the Vth correction is performed collectively on lines, this driving method is suitable for high-speed driving. However, a waiting period Δt from end of the Vth correction to start of the signal writing differs from one line to another. Therefore, even if a signal voltage with a same gray scale is applied to the gates of the drive transistors on respective lines, light emission luminance differs for each line, thereby causing an issue that luminance unevenness occurs.

On the other hand, in this embodiment, each scanning line WSL used to select respective pixels 11 is connected to a plurality of pixels 11 of a same emission color in one unit. Moreover, each power supply line DSL used to supply a drive current to respective pixels 11 is connected to all pixels 11 in one unit. Therefore, as described above, after the Vth correction is simultaneously performed on all groups in one unit, the wiring of the signal voltage is allowed to be performed on all groups in the one unit from one group to another. As a result, waiting periods from end of the Vth correction to start of the μ correction in respective pixels of a same color coincide with one another; therefore, the waiting periods of the pixels 11 of a same color in each line coincide with one another. Therefore, the occurrence of luminance unevenness by performing the Vth correction collectively on lines is allowed to be reduced.

3-2. Modification Examples

Various modification examples of the display unit 1 according to the above-described third embodiment will be described below. It is to be noted that components common to the display unit 1 according to the above-described third embodiment are denoted by same reference numerals. Moreover, description of the components common to the display unit 1 according to the above-described third embodiment will not be repeated as appropriate.

Modification Example 1

In the above-described third embodiment, for example, the layout of respective pixels may be as illustrated in FIG.

38. In FIG. 38, each of the scanning lines WSL (WSL(n) to WSL(n+3)) has the same number of branches (i.e., two branches) as the number of pixel rows included in one unit. In each of the scanning lines WSL (WSL(n) to WSL(n+3)), the branches are connected to each other in the display panel 10. A connection point C1 between the branches may be located in the display region 10A or in a region (a frame region) around an outer edge of the display region 10A. Moreover, when viewed from a direction of a normal to the display panel 10, in a same unit, each of the scanning lines WSL intersects with another scanning line WSL. Moreover, in FIG. 38, each of the power supply lines DSL (DSL(j) and DSL(j+1)) includes the same number of branches (i.e., two branches) as the number of pxiel rows included in one unit. In each of the power supply lines DSL (DSL(j) and DSL (j+1)), the branches are connected each other in the display panel 10. A connection point C2 between the branches may be located in the display panel 10 or in the region (frame region) around the outer edge of the display region 10A. Thus, when each of the scanning lines WSL or each of the power supply lines DSL includes branches, intervals between the scanning lines WSL or intervals between the power supply lines DSL are allowed to be widened. As a result, a wiring layout is made easier.

Modification Example 2

In the above-described third embodiment, the display pixel 14 is configured of three kinds of pixels 11R, 11G, and 11B of emission colors different from one another; however, the display pixel 14 may be configured of four or more kinds of pixels 11 of emission colors different from one another. For example, as illustrated in FIG. 39, the display pixel 14 may be configured of four kinds of pixels 11R, 11G, 11B, and 11W of emission colors different from one another. At this time, the number of kinds of emission colors is four. At this time, the pixel 11W is a pixel emitting white light, and has a similar configuration to that of the other pixels 11R, 11G, and 11B. It is to be noted that, in this modification example, instead of the pixel 11W, a pixel 11Y emitting yellow light may be provided. Each display pixel 14 has a so-called tiled arrangement. In other words, four kinds of pixels 11R, 11G, 11B, and 11W are arranged in the display pixel 14 in a lattice form.

In this modification example, one pixel row is considered, based on the display pixel 14 as a reference. In a case where two pixel rows are considered as one unit, two of the plurality of scanning lines WSL are assigned to each one unit. Therefore, the number of scanning lines WSL included in one unit is two. The total number of scanning lines WSL is equal to the total number of pixel rows, and is the N number. Each of the scanning lines WSL is connected to a plurality of pixels 11 of a same emission color. More specifically, in two scanning lines WSL(n) and WSL(n+1) included in one unit, the scanning line WSL(n) is connected to the pixels 11R and 11G of two kinds of emission colors included in the one unit, and the scanning line WSL(n+1) is connected to the pixels 11B and 11W of two kinds of emission colors included in the one unit. Moreover, each of the scanning lines WSL is connected to all pixels 11 of a same emission in the one unit. More specifically, in two scanning lines WSL(n) and WSL(n+1) included in one unit, the scanning line WSL(n) is connected to all pixels 11R and all pixels 11G in the one unit, and the scanning line WSL(n+1) is connected to all pixels 11B and all pixels 11W in the one unit.

One of the plurality of power supply lines DSL is assigned to each one unit. Therefore, the number of power supply lines DSL included in one unit is one. The total number of power supply lines DSL corresponds to half of the total number of pixel rows, i.e., the J (=N/2) number. Each of the power supply lines DSL is connected to all pixels 11 in one unit. More specifically, one power supply line DSL included in one unit is connected to all pixels 11 (11R, 11G, 11B, and 11W) included in the one unit.

Two of the plurality of signal lines DTL are assigned to each display pixel 14 in each pixel row. In two signal lines DTL assigned to each display pixel 14 in each pixel row, one of the signal lines DTL is connected to pixels 11 of two kinds of emission colors that do not share a same scanning line WSL with each other, and the other signal line DTL is connected to pixels 11 of two kinds of emission colors that do not share a same scanning line WSL with each other. More specifically, attention is focused on two display pixels 14 located adjacent to each other along the column direction (i.e., two display pixels 14 located in different rows and adjacent to each other in one unit) of a plurality of display pixels 14 included in the nth and the n+1th pixel rows. Two signal lines DTL(m) and DTL(m+2) are assigned to the display pixel 14 included in the nth pixel row of the two display pixels 14. It is to be noted the number of signal lines DTL is equal to the number of pixels 11 included in one pixel row, and is the M (M is a multiple of 4) number.

In the above-described two signal lines DTL(m) and DTL(m+2), the signal line DTL(m) as one of them is connected to the pixels 11R and 11G of two kinds of emission colors that do not share a same scanning line WSL with each other, and the signal line DTL(m+2) as the other line of them is connected to the pixels 11B and 11W of two kinds of emission colors that do not share a same scanning line WSL with each other. Moreover, two signal lines DTL(m+1) and DTL(m+3) are assigned to the display pixel 14 included in the n+1th pixel row of the above-described two display pixels 14. In the two signal lines DTL(m+1) and DTL(m+3), the signal line DTL(m+1) as one of them is connected to the pixels 11R and 11G of two kinds of emission colors that do not share a same scanning line WSL with each other, and the signal line DTL(m+3) as the other line of them is connected to the pixels 11B and 11W of two kinds of emission colors that do not share a same scanning line WSL with each other.

In other words, in two display pixels 14 located in different rows and adjacent to each other in one unit, two even-numberth signal lines DTL(m) and DTL(m+2) are assigned to one of the display pixels 14, and two odd-numberth signal lines DTL(m+1) and DTL(m+3) are assigned to the other display pixel 14. Moreover, combinations of pixels of two kinds of emission colors that share a same scanning line WSL with each other in two display pixels 14 located in different rows and adjacent to each other in one unit are equal to each other. Therefore, the total number of signal lines DTL is kept to a minimum.

Incidentally, in this modification example, the drive circuit 20 performs driving in a similar manner to the above-described embodiment. As a result, the waiting periods from end of the Vth correction to start of the μ correction in the pixels 11 of a same color coincide with one another; therefore, the waiting periods of a plurality of pixels 11 of a same color in each pixel row coincide with one another.

Next, effects of the display unit 1 according to this modification example will be described below. In this modification example, as with the above-described embodiment, each of the scanning lines WSL used to select respective pixels 11 is connected to a plurality of pixels of a same emission color in one unit. Moreover, each of the power supply lines DSL used to supply a drive current to respective pixels 11 is connected to all pixels 11 in one unit. Therefore, after the Vth correction is simultaneously performed on all groups in one unit, the writing of the signal voltage is allowed to be performed on all groups in the one unit from one group to another. As a result, the waiting periods from end of the Vth correction to start of the μ correction in the respective pixels 11 of a same color coincide with one another; therefore, the waiting periods of the pixels 11 of a same color in each line coincide with one another. Therefore, the occurrence of luminance unevenness caused by performing Vth correction collectively on lines is allowed to be reduced.

3-3. Application Examples

Application examples of the display unit 1 described in the above-described third embodiment will be described below. The display unit 1 according to the above-described third embodiment is applicable to display units of electronic apparatuses, in any fields, displaying an image signal supplied from an external device or an image signal produced inside as an image or a picture, such as televisions, digital cameras, notebook personal computers, portable terminal devices such as cellular phones, and video cameras.

Application Example 1

FIG. 40 illustrates an appearance of a television to which the display unit 1 according to the above-described third embodiment is applied. The television includes, for example, an image display screen section 300 including a front panel 310 and a filter glass 320, and the image display screen section 300 is configured of the display unit 1 according to the above-described embodiment.

Application Example 2

FIGS. 41A and 41B illustrate an appearance of a digital camera to which the display unit 1 according to the above-described third embodiment is applied. The digital camera includes, for example, a light-emitting section 410 for a flash, a display section 420, a menu switch 430, and a shutter button 440, and the display section 420 is configured of the display unit 1 according to the above-described third embodiment.

Application Example 3

FIG. 42 illustrates an appearance of a notebook personal computer to which the display unit 1 according to the above-described third embodiment is applied. The notebook personal computer includes, for example, a main body 510, a keyboard 520 for operation of inputting characters and the like, and a display section 530 for displaying of an image, and the display section 530 is configured of the display unit 1 according to the above-described third embodiment.

Application Example 4

FIG. 43 illustrates an appearance of a video camera to which the display unit 1 according to the above-described third embodiment is applied. The video camera includes, for example, a main section 610, a lens 620 provided on a front surface of the main section 610 and for shooting an image of an object, a shooting start/stop switch 630, and a display section 640, and the display section 640 is configured of the display unit 1 according to the above-described third embodiment.

Application Example 5

FIG. 44 illustrates an appearance of a cellular phone to which the display unit 1 according to the above-described third embodiment is applied. The cellular phone is formed by connecting, for example, a top-side enclosure 710 and a bottom-side enclosure 720 to each other by a connection section (hinge section) 730, and the cellular phone includes a display 740, a sub-display 750, a picture light 760, and a camera 770. The display 740 or the sub-display 750 is configured of the display unit 1 according to the above-described third embodiment.

Although the present technology is described referring to the third embodiment and the application examples, the present technology is not limited thereto, and may be variously modified.

In the above-described third embodiment and the like, the configuration of the pixel circuit 12 for active matrix drive is not limited to those described in the above-described third embodiment and the like, and a capacitor element or a transistor may be added as necessary. In this case, a necessary drive circuit may be included in addition to the above-described signal line drive circuit 23, the scanning line drive circuit 24, the power supply line drive circuit 25, and the like according to a modification of the pixel circuit 12.

Moreover, the present technology may have the following configurations.

(1) A display panel including:

a plurality of pixels each including a plurality of sub-pixels of emission colors different from one another;

a plurality of first wiring lines of which a k (k≥2) number are assigned to each one unit, the first wiring lines used to select the respective pixels, the one unit including the k number of pixel rows; and a plurality of second wiring lines of which one is assigned to the one unit, the second wiring lines used to supply a drive current to the respective pixels, in which each of the first wiring lines is connected to a plurality of the sub-pixels of a same emission color in the one unit, and each of the second wiring lines is connected to all of the sub-pixels in the one unit.

(2) The display panel according to (1), in which the k number of pixel rows included in the one unit is equal to or larger than two, and equal to or smaller than the number of kinds of emission colors, and each of the first wiring lines is connected to all of the sub-pixels of a same emission color in the one unit.

(3) The display panel according to (2), in which the number of pixel rows included in the one unit is two, the number of kinds of emission colors is three, and one wiring, line of the two first wiring lines included in the one unit is connected to the sub-pixels of two kinds of emission colors in the one unit.

(4) The display panel according to (3), in which the display panel includes a plurality of third wiring lines of which two are assigned to each of the pixels in each pixel row, the third wiring lines used to supply a signal voltage corresponding to an image signal to each of the pixels, and one wiring line of the two third wiring lines assigned to each of the pixels in each pixel row is connected to the sub-pixels of two kinds of emission colors that do not share the first wiring line with each other.

(5) The display unit according to (2), in which the number of pixel rows included in the one unit is two, the number of kinds of emission colors is four, and one wiring line of the two first wiring lines included in the one unit is connected to the sub-pixels of two kinds of emission colors in the one unit.

(6) The display panel according to (5), in which the display panel includes a plurality of third wiring lines of which two are assigned to each of the pixels, the third wiring lines used to supply a signal voltage corresponding to an image signal to each of the pixels, and one wiring line of the two third wiring lines assigned to each of the pixels in each pixel row is connected to the sub-pixels of two kinds of emission colors that do not share the first wiring line with each other.

(7) The display panel according to any one of (1) to (6), in which each of the first wiring lines includes a same number of branches as the number of pixel rows included in the one unit, and in each of the first wiring lines, the branches are connected to one another in the display panel.

(8) The display panel according to any one of (1) to (7), in which when viewed from a direction of a normal to the display panel, in a same unit, each of the first wiring lines intersects with another first wiring line, (9) The display panel according to any one of (1) to (7), in which each of the sub-pixels includes a light-emitting device, a drive circuit configured to drive the light-emitting device, and a write circuit configured to write a signal voltage corresponding to and image signal to the drive circuit, the drive circuit includes a drive transistor connected in series to the light-emitting device, and a retention capacitor configured to hold a gate-source voltage of the drive transistor, the write circuit includes a write transistor connected to a gate of the drive transistor, each of the first wiring lines is connected to a gate of the write transistor, and each of the second wiring lines is connected to a source or a drain of the drive transistor,

(10) A display unit provided with a display panel and a drive circuit configured to drive the display panel, the display panel including:

a plurality of pixels each including a plurality of sub-pixels of emission colors different from one another;

a plurality of first wiring lines of which a k (k≥2) number are assigned to each one unit, the first wiring lines used to select the respective pixels, the one unit including the k number of pixel rows; and a plurality of second wiring lines of which one is assigned to the one unit, the second wiring lines used to supply a drive current to the respective pixels, in which each of the first wiring lines is connected to a plurality of the sub-pixels of a same emission color in the one unit and the drive circuit, and each of the second wiring lines is connected to all of the sub-pixels in the one unit and the drive circuit.

(11) The display unit according to (10), in which each of the sub-pixels includes a light-emitting device, a drive transistor connected in series to the light-emitting device, and a write transistor configured to write a signal voltage corresponding to an image signal to a gate of the drive transistor, each of the first wiring lines is connected to a gate of the write transistor, and each of the second wiring lines is connected to a source or a drain of the drive transistor.

(12) The display unit according to (11), in which when all of the sub-pixels in one unit are divided into groups by the first wiring lines connected thereto, the drive circuit simultaneously performs Vth correction that allows a gate-source voltage of the drive transistor to be brought close to a threshold voltage of the drive transistor on all of the groups in the one unit, and then performs writing of the signal voltage to all of the groups in the one unit from one group to another.

(13) An electronic apparatus provided with a display unit, the display unit including a display panel, and a drive circuit configured to drive the display panel, the display panel including:

a plurality of pixels each including a plurality of sub-pixels of emission colors different from one another;

a plurality of first wiring lines of which a k (k≥2) number are assigned to each one unit, the first wiring lines used to select the respective pixels, the one unit including the k number of pixel rows; and a plurality of second wiring lines of which one is assigned to the one unit, the second wiring lines used to supply a drive current to the respective pixels, in which each of the first wiring lines is connected to a plurality of the sub-pixels of a same emission color in the one unit, and each of the second wiring lines is connected to all of the sub-pixels in the one unit.

(14) A method of driving a display panel, the display panel including a plurality of pixels each including a plurality of sub-pixels of emission colors different from one another, a plurality of first wiring lines of which a k (k≥2) number are assigned to each one unit, the first wiring lines used to select the respective pixels, the one unit including the k number of pixel rows, and a plurality of second wiring lines of which one is assigned to the one unit, the second wiring lines used to supply a drive current to the respective pixels, each of the first wiring lines being connected to a plurality of the sub-pixels of a same emission color in the one unit, each of the second wiring lines being connected to all of the sub-pixels in the one unit, each of the sub-pixels including a light-emitting device, a drive transistor connected in series to the light-emitting device, and a write transistor configured to write a signal voltage corresponding to an image signal to a gate of the drive transistor, each of the first wiring lines being connected to a gate of the write transistor, each of the second wiring lines being connected to a source or a drain of the drive transistor, the method including:

in the display panel, dividing all of the sub-pixels in the one unit into groups by the first wiring lines connected thereto; and simultaneously performing Vth correction that allows a gate-source voltage of the drive transistor to be brought close to a threshold voltage of the drive transistor on all of the groups in the one unit, and then performing writing of the signal voltage to all of the groups in the one unit from one group to another.

(15) A method of driving a display panel, the method including:

in the display panel including a plurality of pixels, each of the pixels including a plurality of sub-pixels of emission colors different from one another, each of the sub-pixels including a light-emitting device, a drive transistor connected in series to the light-emitting device, and a write transistor configured to write a signal voltage corresponding to an image signal to a gate of the drive transistor, considering a plurality of pixel rows as one unit, and dividing all of the sub-pixels in the one unit into groups each including a plurality of the sub-pixels, based on emission colors as a classification criterion; and simultaneously performing Vth correction that allows a gate-source voltage of the drive transistor to be brought close to a threshold voltage of the drive transistor on all of the groups in the one unit, and then performing writing of the signal voltage to all of the groups in the one unit from one group to another.

The first to third embodiments of the present technology is applicable to a display unit not only singly, but also in a combination of all of the first and third embodiments. In such a case, the present technology obtains a more synergistic effect. Likewise, the first to third embodiments of the present technology is applicable in a combination of the first and second embodiments, in a combination of the second and third embodiments, or a combination of the first and third embodiments. Also in such a case, the present technology obtains a more synergistic effect.

The present disclosure contains subject matter related to that disclosed in Japanese Priority Patent Application No. 2011-269988 filed in the Japan Patent Office on Dec. 9, 2011, Japanese Priority Patent Application No. 2011-274444 filed in the Japan Patent Office on Dec. 15, 2011, and Japanese Priority Patent Application No. 2012-059695 filed in the Japan Patent Office on Mar. 16, 2012, the entire content of which is hereby incorporated by reference.

It should be understood by those skilled in the art that various modifications, combinations, sub-combinations, and alterations may occur depending on design requirements and other factors insofar as they are within the scope of the appended claims or the equivalents thereof.

The invention claimed is:

1. A display unit comprising:

a display section including a light-emitting device and a pixel circuit in each pixel; and a drive section configured to drive the pixel circuit, based on an image signal, wherein the pixel circuit includes a drive transistor configured to drive the light-emitting device, and a write transistor configured to control application of a signal voltage corresponding to the image signal to a gate of the drive transistor, the drive section performs, on all pixel rows, correction that allows a gate-source voltage of the drive transistor to be brought close to a threshold voltage of the drive transistor, and then performs, on all pixel rows, writing of the signal voltage corresponding to the image signal to gates of the drive transistors, the drive section performs scanning for the correction at shorter intervals than one horizontal period, the drive section performs the correction and the writing to keep an nth period in which the light-emitting device emits light in an nth frame and an n+1th period in which the light-emitting device emits light in an n+1th frame from overlapping, and to have a black period in which black is displayed on an entirety of the display section, and during the black period for a given frame, the drive section performs the correction for the given frame for at least a first pixel row, and performs the writing for the given frame for at least a second pixel row.

2. The display unit according to claim 1, wherein the drive section performs the correction on each pixel row throughout a longer period than one horizontal period.

3. The display unit according to claim 1, wherein the display section includes a signal line connected to the gate of the drive transistor, and the drive section continuously outputs a fixed voltage unrelated to the image signal to the signal line in a correction period in which the correction is performed, and continuously outputs the signal voltage to the signal line in a writing period in which the writing is performed.

4. An electronic apparatus provided with a display unit, the display unit comprising:

a display section including a light-emitting device and a pixel circuit in each pixel; and a drive section configured to drive the pixel circuit, based on an image signal, wherein the pixel circuit includes a drive transistor configured to drive the light-emitting device, and a write transistor configured to control application of a signal voltage corresponding to the image signal to a gate of the drive transistor, the drive section performs, on all pixel rows, correction that allows a gate-source voltage of the drive transistor to be brought close to a threshold voltage of the drive transistor, and then performs, on all pixel rows, writing of the signal voltage corresponding to the image signal to gates of the drive transistors, the drive section performs scanning for the correction at shorter intervals than one horizontal period, the drive section performs the correction and the writing to keep an nth period in which the light-emitting device emits light in an nth frame and an n+1th period in which the light-emitting device emits light in an n+1th frame from overlapping, and to have a black period in which black is displayed on an entirety of the display section, and during the black period for a given frame, the drive section performs the correction for the given frame for at least a first pixel row, and performs the writing for the given frame for at least a second pixel row.

5. A method of driving a display unit, the method comprising:

in the display unit including a light-emitting device and a pixel circuit in each pixel, the pixel circuit including a drive transistor configured to drive the light-emitting device and a write transistor configured to control application of a signal voltage corresponding to an image signal to a gate of the drive transistor, performing, on all pixel rows, correction that allows a gate-source voltage of the drive transistor to be brought close to a threshold voltage of the drive transistor, and then performing writing of the signal voltage corresponding to the image signal to gates of the drive transistors in all pixel rows, performing scanning for the correction at shorter intervals than one horizontal period, performing the correction and the writing to keep an nth period in which the light-emitting device emits light in an nth frame and an n+1th period in which the light-emitting device emits light in an n+1th frame from overlapping, and to have a black period in which black is displayed on an entirety of the display section, and during the black period for a given frame, performing the correction for the given frame for at least a first pixel row, and performing the writing for the given frame for at least a second pixel row.

* * * * *